US006093529A

United States Patent [19]

Tsuzuki et al.

[11] Patent Number: 6,093,529

[45] Date of Patent: Jul. 25, 2000

[54] IMAGING MATERIALS

[75] Inventors: Hirohiko Tsuzuki; Hisashi Okamura; Itsuo Fujiwara; Yoshiharu Yabuki; Masaki Noro, all of Kanagawa, Japan

[73] Assignee: Fuji Photo Film Co., Ltd., Kanagawa, Japan

[21] Appl. No.: 09/060,881

[22] Filed: Apr. 16, 1998

[30] Foreign Application Priority Data

Apr. 16, 1997 [JP] Japan ..... 9-114440
Jul. 28, 1997 [JP] Japan ..... 9-217165

[51] Int. Cl.[7] ..... G03C 1/490; G03C 1/815

[52] U.S. Cl. ..... 430/619; 430/512; 430/530; 430/531; 430/604; 430/605; 430/607; 430/613; 430/627

[58] Field of Search ..... 430/617, 619, 430/512, 604, 607, 605, 613, 524, 531, 627, 530

[56] References Cited

U.S. PATENT DOCUMENTS 2,910,377 10/1959 Owen .
5,656,419 8/1997 Toya et al. ..... 430/619

*Primary Examiner*—Thorl Chea
*Attorney, Agent, or Firm*—Birch, Stewart, & Birch, LLP

[57] ABSTRACT

An imaging material is provided in the form of a photothermographic or thermographic image forming layer containing an organic silver salt on one surface of a support and further comprising a polyvalent metal ion and a phthalic acid compound on the image forming layer-bearing surface of the support. The imaging material has improved shelf stability before and after image formation and the ease of handling and produces high-quality blue black tone images.

19 Claims, No Drawings

IMAGING MATERIALS

This invention relates to imaging materials including photosensitive thermographic imaging materials and thermographic imaging materials.

BACKGROUND OF THE INVENTION

As computer network systems are widely furnished in the current medical field, image output devices are handled like many other precision machines. One concern about prior art laser image setters and laser imagers is the risk of deteriorating various precision machines because potentially corrosive developer and fixer liquids are used. It is also a problem that waste liquid from such processing solution is ecologically detrimental and that processing is impossible under water-shortage situations as in disaster. There is a strong desire to develop an image forming system dispensing with processing solution. Needed in this regard is a technology relating to photothermographic imaging materials capable of forming clear black images at a high resolution and sharpness and finding use in medical diagnosis and photographic applications and thermographic imaging materials capable of forming images using thermal heads. These thermal imaging materials can offer to the customer a simple image forming system which eliminates a need for solution type chemical agents and is not detrimental to the environment.

While a similar requirement is sometimes raised in the general imaging material field, medical images require high definition, that is, high image quality characterized by excellent sharpness and graininess. From the standpoint of ease of diagnosis, blue black tone images are favorable. At present, various hard copy systems using pigments and dyes such as ink jet printers and electrophotographic printers are widely marketed as the image forming system, but none of them are satisfactory as the output system for medical images.

Thermal image forming systems utilizing organic silver salts are disclosed in the literature, for example, U.S. Pat. No. 2,910,377 and JP-B 4924/1968. Although these thermal image forming systems utilizing organic silver salts can produce images of quality and tone regarded satisfactory as medical images, the image forming ability of such material can be altered prior to image formation. Once images are formed, the images can be degraded by light, heat, and water.

It is a serious problem that photographic properties become worse, especially fog increases, during shelf storage. One common practice is to use mercury compounds for suppressing fog. The use of mercury compounds, however, is hazardous. As a substitute, various oxidizing agents, especially polyhalogenated compounds have been proposed. Materials using such oxidizing agents still suffer from the problem that discoloration occurs in images during storage.

SUMMARY OF THE INVENTION

An object of the invention is to provide an imaging material having improved storage stability before and after image formation and improved ease of handling and producing quality images of blue black tone.

Another object of the invention is to provide an imaging material which prevents its photographic properties from deteriorating during storage and produces images having improved Dmin areas and experiencing minimized discoloration during storage.

In a first aspect of the present invention, there is provided an imaging material comprising a photothermographic imaging material comprising an image forming layer containing an organic silver salt on one surface of a support. The imaging material further comprises a polyvalent metal ion and a phthalic acid compound on the image forming layer-bearing surface of the support.

Preferably, the polyvalent metal ion is contained in an amount of 10 $\mu$mol to 1 mol per square meter of the element. The polyvalent metal ion is preferably a metal cation other than alkaline earth metal ions. The imaging material may further include an uppermost layer on the image forming layer-bearing surface of the support, the uppermost layer containing 100 mg/m$^2$ to 5 g/m$^2$ of a polymer bearing a carboxylic acid residue.

In one preferred embodiment, the photothermographic imaging material contains a photosensitive silver halide, a non-photosensitive organic silver salt, a reducing agent therefor, an oxidizing agent, and a binder on the support, and the photothermographic imaging material further contains a UV absorber at a site other than a layer containing the oxidizing agent. The oxidizing agent is preferably of the general formula (I):

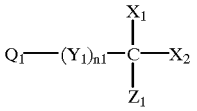

wherein $Q_1$ is an alkyl, aryl or heterocyclic group, each of $X_1$ and $X_2$ is a halogen atom, $Z_1$ is a hydrogen atom or electron attractive group, $Y_1$ is —C(=O)—, —SO— or —$SO_2$—, and letter $n_1$ is equal to 0 or 1. Preferably the oxidizing agent is solid dispersed.

In another preferred embodiment, the photothermographic imaging material comprises at least one photosensitive layer containing a photosensitive silver halide, a non-photosensitive organic silver salt, and a reducing agent therefor, and at least one non-photosensitive layer. The oxidizing agent is contained in the at least one photosensitive layer. The UV absorber is contained in the at least one non-photosensitive layer.

In a second aspect of the present invention, there is provided an imaging material comprising a thermographic imaging material comprising an image forming layer containing an organic silver salt on one surface of a support. The imaging material further comprising a polyvalent metal ion and a phthalic acid compound on the image forming layer-bearing surface of the support.

In one preferred embodiment, the thermographic imaging material contains a non-photosensitive organic silver salt, a reducing agent therefor, an oxidizing agent, and a binder on the support, and the thermographic imaging material further contains a UV absorber at a site other than a layer containing the oxidizing agent. The oxidizing agent is preferably of the general formula (I) defined above. Preferably the oxidizing agent is solid dispersed.

In both the first and second aspect, the support is preferably a transparent support. The UV absorber is preferably contained in layers disposed on opposite sides of a layer containing the non-photosensitive organic silver salt. The non-photosensitive organic silver salt is typically a silver salt of a carboxylic acid.

DETAILED DESCRIPTION OF THE INVENTION

The imaging material of the invention is defined as a photothermographic (photosensitive heat-developable)

imaging material or thermographic (heat-sensitive) imaging material comprising an image forming layer containing an organic silver salt on one surface of a support. The imaging material further contains a polyvalent metal ion and a phthalic acid compound on the one surface, that is, the image forming layer-bearing side surface of the support. The polyvalent metal ion and the phthalic acid compound are typically contained in a protective layer or overcoat layer as will be described later.

With the combined use of polyvalent metal ion and phthalic acid compound, the imaging material is given improved photographic performance which does not deteriorate during storage, and thus produces images of improved tone. If the polyvalent metal ion is not added, the image tone is poor and the photographic performance changes before and after storage. If the phthalic acid compound is not added, formation of acceptable images is impossible.

In one preferred embodiment, the imaging material has a layer containing at least one oxidizing agent on one side of the support, and a UV absorber is contained at a site other than the oxidizing agent-containing layer.

The inclusion of an oxidizing agent and a UV absorber is effective for realizing an imaging material which prevents its photographic properties from deteriorating, especially fog from increasing, during shelf storage, and produces images having improved Dmin areas and experiencing little or no discoloration during storage. In contrast, if the oxidizing agent is added, but not the UV absorber, then the resulting images tend to discolor during storage. Conversely, if the UV absorber is added, but not the oxidizing agent, then Dmin areas are likely to worsen and photographic properties deteriorate during shelf storage. If the oxidizing agent and the UV absorber are added to a common layer, then the resulting images tend to discolor during storage.

The imaging material containing an oxidizing agent and a UV absorber according to the invention is either a thermographic imaging material comprising a non-photosensitive organic silver salt and a reducing agent for the non-photosensitive organic silver salt or a photothermographic imaging material comprising a photosensitive silver halide, a non-photosensitive organic silver salt, and a reducing agent for the non-photosensitive organic silver salt. The invention is advantageously applied to the photothermographic imaging material (also referred to as photosensitive material).

In the photothermographic imaging material according to the invention, it is preferred that the oxidizing agent is contained in a photosensitive layer (or emulsion layer) serving as an image forming layer while the UV absorber is contained in the support or non-photosensitive layers other than the image forming layer, and especially in non-photosensitive layers.

The non-photosensitive layers include a non-photosensitive layer disposed between the photosensitive layer and the support, an intermediate layer on the photosensitive layer (including, where two or more photosensitive layers are on the same side of the support, a layer interleaved between photosensitive layers), and a surface protective layer. Where the material has a photosensitive layer or layers only on one surface of the support, the non-photosensitive layers include layers on the back surface, for example, a back layer and a back surface protective layer.

Whether the imaging material of the invention is a thermographic imaging material or a photothermographic imaging material, the UV absorber is preferably contained in at least one of layers disposed on opposite sides of a non-photosensitive organic silver salt-containing layer serving as the image forming layer, more preferably in at least one layer on each side.

UV absorber

The UV absorber used herein is not critical although preferable UV absorbers are compounds of the general formulae [1] to [7] which are given below.

General Formula [1]

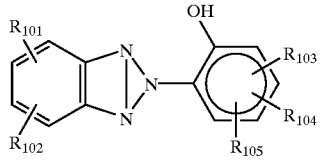

In formula [1], $R_{101}$, $R_{102}$, $R_{103}$, $R_{104}$ and $R_{105}$ may be the same or different and each represent a hydrogen atom, halogen atom, alkyl group, cycloalkyl group, alkoxy group, aryl group, aryloxy group, alkenyl group, nitro group, carboxyl group or salt thereof, sulfonic acid group or salt thereof, or hydroxyl group.

General Formula [2]

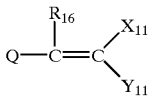

In formula [2], Q is an aryl group or 5- or 6-membered heterocyclic group; $R_{116}$ is a hydrogen atom or alkyl group; $X_{11}$ and $Y_{11}$ each represent a cyano group, —$COOR_{117}$, —$CONHR_{117}$, —$COR_{117}$, —$SO_2R_{117}$ or —$SO_2NHR_{117}$ wherein $R_{117}$ is a hydrogen atom, alkyl group or aryl group. Alternatively, $X_{11}$ and $Y_{11}$ taken together, may form a 5- or 6-membered ring. Where $X_{11}$ and $Y_{11}$ are carboxyl groups, they may take the form of a salt.

General Formula [3]

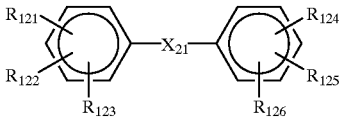

In formula [3], $R_{121}$ to $R_{126}$ may be the same or different and each represent a hydrogen atom, halogen atom, alkyl group, aryl group, alkoxy group, aryloxy group, alkylthio group, arylthio group, amino group, hydroxyl group, cyano group, nitro group, carbonamide group, carbamoyl group, sulfonamide group, sulfamoyl group, carboxyl group or salt thereof, sulfonic acid group or salt thereof, sulfonyl group, acyloxy group or oxycarbonyl group. $X_{21}$ is —CO— or —COO—.

General Formula [4]

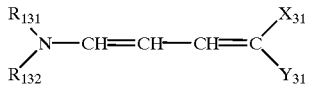

In formula [4], $R_{131}$ and $R_{132}$ may be the same or different and each represent a hydrogen atom, alkyl group or aryl group, or a group of non-metallic atoms necessary to form a 5- or 6-membered ring, taken together. $X_{31}$ and $Y_{31}$ may be the same or different and are as defined for $X_{11}$ and $Y_{11}$ in formula [2].

General Formula [5]

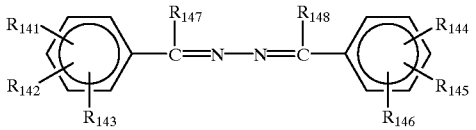

In formula [5], $R_{141}$ to $R_{146}$ may be the same or different and each represent a hydrogen atom, halogen atom, alkyl group, aryl group, alkoxy group, aryloxy group, alkylthio group, arylthio group, amino group, carbonamide group, hydroxyl group, cyano group, nitro group, carbamoyl group, sulfonyl group, sulfamoyl group, sulfonamide group, carboxyl group or salt thereof, sulfonic acid group or salt thereof, acyloxy group or oxycarbonyl group. $R_{147}$ and $R_{148}$ may be the same or different and each represent a hydrogen atom, alkyl group or aryl group, or they, taken together, may form a 5- or 6-membered ring.

General Formula [6]

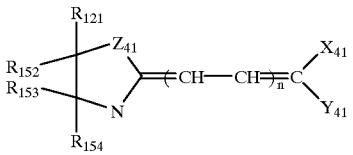

In formula [6], $R_{151}$ to $R_{154}$ may be the same or different and each represent a hydrogen atom, alkyl group or aryl group. Alternatively, $R_{151}$ and $R_{154}$, taken together, form a double bond, and in this case, $R_{152}$ and $R_{153}$ taken together, may form a benzene or naphthalene ring. $R_{155}$ is an alkyl or aryl group. $Z_{41}$ is an oxygen atom, sulfur atom, methylene group, ethylene group, $=N—R_{156}$ or $=C(R_{157})(R_{158})$ wherein $R_{156}$ is an alkyl or aryl group, and $R_{157}$ and $R_{158}$, which may be the same or different, each represent a hydrogen atom or alkyl group. $X_{41}$ and $Y_{41}$, which may be the same or different, are as defined for $X_{11}$ and $Y_{11}$ in formula [2]. Letter n is equal to 0 or 1.

General Formula [7]

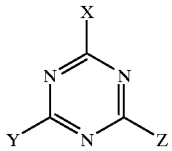

In formula [7], X, Y and Z are independently selected from alkyl, aryl, alkoxy, aryloxy and heterocyclic groups. At least one of X, Y and Z is of the following general formula (a):

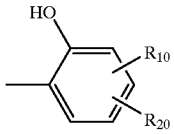

wherein $R_{10}$ and $R_{20}$ are independently selected from hydrogen atoms, halogen atoms, alkyl groups, cycloalkyl groups, aryl groups, alkoxy groups, and aryloxy groups.

In the general formulae [1] through [6], the alkyl groups represented by $R_{101}$ to $R_{105}$, $R_{116}$, $R_{117}$, $R_{121}$ to $R_{126}$, $R_{131}$, $R_{132}$, $R_{141}$ to $R_{148}$, and $R_{151}$ to $R_{158}$ are preferably those having 1 to 20 carbon atoms, which may have substituents, for example, hydroxyl groups, cyano groups, nitro groups, halogen atoms (e.g., chlorine, bromine and fluorine), alkoxy groups (e.g., methoxy, ethoxy, butoxy, octyloxy and phenoxyethoxy), aryloxy groups (e.g., phenoxy), oxycarbonyl groups (e.g., methoxycarbonyl, ethoxycarbonyl, octyloxycarbonyl and dodecyloxycarbonyl), acyloxy groups (e.g., ethylcarbonyloxy, heptylcarbonyloxy and phenylcarbonyloxy), amino groups (e.g., dimethylamino, ethylamino and diethylamino), aryl groups (e.g., phenyl, tolyl and 4-methoxyphenyl), carbonamide (e.g., methylcarbonylamide and phenylcarbonylamide), carbamoyl groups (e.g., ethylcarbamoyl and phenylcarbamoyl), sulfonamide groups (e.g., methanesulfonamide and benzenesulfonamide), sulfamoyl groups (e.g., butylsulfamoyl, phenylsulfamoyl and methyloctylaminosulfonyl), carboxyl groups or salts thereof, and sulfonic acid groups or salts thereof. Illustrative examples of the alkyl group are methyl, ethyl, propyl, isopropyl, butyl, sec-butyl, t-butyl, pentyl, t-pentyl, hexyl, octyl, 2-ethylhexyl, t-octyl, decyl, dodecyl, hexadecyl, octadecyl, benzyl, and phenethyl groups and substituted ones of these groups having substituents as exemplified above.

The cycloalkyl groups represented by $R_{101}$ to $R_{105}$ are preferably those having 3 to 8 carbon atoms, for example, cyclopropyl, cyclopentyl, cyclohexyl, and bicyclo[2,2,2] octyl and substituted ones of these groups having substituents as exemplified above for the alkyl groups.

The aryl groups represented by Q, $R_{101}$ to $R_{105}$, $R_{117}$, $R_{121}$ to $R_{126}$, $R_{131}$, $R_{132}$, $R_{141}$ to $R_{148}$, and $R_{151}$, to $R_{156}$ are preferably those having 6 to 10 carbon atoms, which may have substituents, for example, alkyl groups such as methyl, ethyl, propyl, isopropyl, butyl, sec-butyl, t-butyl, pentyl, t-pentyl, octyl, decyl, dodecyl, tetradecyl, and hexadecyl groups as well as those groups exemplified above as the substituents on the alkyl groups. Illustrative examples of the aryl group include phenyl and naphthyl.

The alkenyl group represented by $R_{101}$ to $R_{105}$ are preferably those having 3 to 20 carbon atoms, for example, allyl, 2-butenyl, 3-butenyl and oleyl groups, which may have substituents as exemplified above as the substituents on the alkyl groups.

The alkoxy groups represented by $R_{101}$ to $R_{105}$, $R_{121}$ to $R_{126}$, and $R_{141}$ to $R_{146}$ are preferably those having 1 to 20 carbon atoms, for example, methoxy, ethoxy, butoxy, isobutoxy, n-octoxy, isooctoxy, dodecyloxy, benzyloxy and octadecyloxy groups, which may have substituents as exemplified above as the substituents on the alkyl groups.

The aryloxy groups represented by $R_{101}$ to $R_{105}$, $R_{121}$ to $R_{126}$, and $R_{141}$ to $R_{146}$ are preferably those having 6 to 10 carbon atoms, for example, phenoxy and naphthoxy groups, which may have substituents as exemplified above as the substituents on the aryl groups.

The alkylthio groups represented by $R_{121}$ to $R_{126}$ and $R_{141}$ to $R_{146}$ are preferably those having 1 to 20 carbon atoms, for example, methylthio, hexylthio, octylthio and hexadecylthio groups.

The arylthio groups represented by $R_{121}$ to $R_{126}$ and $R_{141}$ to $R_{146}$ are preferably those having 6 to 10 carbon atoms, for example, phenylthio and naphthylthio groups. These alkylthio and arylthio groups may have substituents as exemplified above as the substituents on the alkyl and aryl groups.

The amino groups represented by $R_{121}$ to $R_{126}$ and $R_{141}$ to $R_{146}$ are preferably those having 0 to 40 carbon atoms, for example, unsubstituted amino, methylamino, dimethylamino, diethylamino, octylamino, dihexylamino, distearylamino, diisobutylamino, anilino, diphenylamino, and methylphenylamino groups, which may have substituents as exemplified above as the substituents on the aryl groups. It is acceptable that substituents on the amino group bond with each other to form a ring.

The carbonamide groups represented by $R_{121}$ to $R_{126}$ and $R_{141}$ to $R_{146}$ are preferably those having 1 to 20 carbon atoms, for example, formamide, acetylamino, hexanoylamino, decanoylamino, stearoylamino and benzoylamino groups, which may have substituents as exemplified above as the substituents on the aryl groups.

The carbamoyl groups represented by $R_{121}$ to $R_{126}$ and $R_{141}$ to $R_{146}$ are preferably those having 1 to 20 carbon atoms, for example, unsubstituted carbamoyl, methylcarbamoyl, propylcarbamoyl, diethylcarbamoyl, octylcarbamoyl, dodecylcarbamoyl, hexadecylcarbamoyl, octadecylcarbamoyl and phenylcarbamoyl groups, which may have substituents as exemplified above as the substituents on the aryl groups.

The sulfonamide groups represented by $R_{121}$ to $R_{126}$ and $R_{141}$ to $R_{146}$ are preferably those having 1 to 20 carbon atoms, for example, methanesulfonamide, ethanesulfonamide, nonanesulfonamide, butanesulfonamide, dodecanesulfonamide, octadecanesulfonamide, and benzenesulfonamide groups, which may have substituents as exemplified above as the substituents on the aryl groups.

The sulfamoyl groups represented by $R_{121}$ to $R_{126}$ and $R_{141}$ to $R_{146}$ are preferably those having 0 to 20 carbon atoms, for example, unsubstituted sulfamoyl, ethylsulfamoyl, butylsulfamoyl, heptylsulfamoyl, tetradecylsulfamoyl, dibutylsulfamoyl, octadecylsulfamoyl, and phenylsulfamoyl groups, which may have substituents as exemplified above as the substituents on the aryl groups.

The acyloxy groups represented by $R_{121}$ to $R_{126}$ and $R_{141}$ to $R_{146}$ are preferably those having 2 to 20 carbon atoms, for example, acetyloxy, hexanoyloxy, decanoyloxy, stearoyloxy, and benzoyloxy groups, which may have substituents as exemplified above as the substituents on the aryl groups.

The oxycarbonyl groups represented by $R_{121}$ to $R_{126}$ and $R_{141}$ to $R_{146}$ are preferably those having 2 to 20 carbon atoms, for example, methoxycarbonyl, ethoxycarbonyl, butoxycarbonyl, isobutoxycarbonyl, heptyloxycarbonyl, tetradecyloxycarbonyl, octadecyloxycarbonyl, and phenoxycarbonyl groups, which may have substituents as exemplified above as the substituents on the aryl groups.

The sulfonyl groups represented by $R_{121}$ to $R_{126}$ and $R_{141}$ to $R_{146}$ are preferably those having 1 to 20 carbon atoms, for example, methanesulfonyl, pentanesulfonyl, decanesulfonyl, octadecanesulfonyl, and benzenesulfonyl groups, which may have substituents as exemplified above as the substituents on the aryl groups.

The halogen atoms represented by $R_{101}$ to $R_{105}$, $R_{121}$ to $R_{136}$, and $R_{141}$ to $R_{146}$ include fluorine, chlorine and bromine.

The 5- or 6-membered heterocyclic groups represented by Q are, for example, furan, thiophene, indole, pyrrole, pyrazole, imidazole, and pyridine, which may have substituents as exemplified above as the substituents on the aryl groups.

The 5- or 6-membered rings formed by $X_{11}$ and $Y_{11}$, $X_{31}$ and $Y_{31}$, and $X_{41}$ and $Y_{41}$, taken together, are preferably rings known as acidic nuclei, for example, 2-pyrazolin-5-one, pyrazolidine-2,4-dione, rhodanine, hydantoin, 2-thiohydantoin, 4-thiohydantoin, 2,4-oxazolidinedione, isooxazolone, barbituric acid, thiobarbituric acid, indanedione, hydroxypyridone, furanone, 1,3-cyclohexanedione, and meldolamic acid, which may have substituents as exemplified above as the substituents on the aryl groups.

The 5- or 6-membered rings formed by $R_{131}$ and $R_{132}$, taken together, include pyrrolidine, piperidine, and morpholine.

Next, the general formulae [7] and (a) are described in detail.

In formula [7], X, Y and Z are independently selected from substituted or unsubstituted alkyl groups, aryl groups, alkoxy groups, aryloxy groups, which have 1 to 20 carbon atoms, and heterocyclic groups. The substituents on these groups include hydroxyl groups, halogen atoms (e.g., fluorine, chlorine and bromine atoms), alkyl groups of 1 to 12 carbon atoms (e.g., methyl, ethyl and butyl), alkoxy groups of 1 to 18 carbon atoms (e.g., methoxy, ethoxy, butoxy and benzyloxy), aryl groups of 6 to 18 carbon atoms (e.g., phenyl, tolyl and naphthyl), aryloxy groups of 6 to 18 carbon atoms (e.g., phenoxy and m-methylphenoxy), alkoxycarbonyl groups (e.g., ethoxycarbonyl and 2-methoxyethoxycarbonyl), aryloxycarbonyl groups (e.g., phenoxycarbonyl and p-methylphenoxycarbonyl), thioalkyl groups of 1 to 18 carbon atoms (e.g., methylthio and butylthio), and carbamoyl groups (e.g., methylcarbamoyl and butylcarbamoyl).

Preferably, X, Y and Z are substituted or unsubstituted aryl and alkoxy groups. A hydroxyl group, if present as a substituent thereon, is preferably at the ortho-position relative to the carbon atom attached to the triazine ring.

In formula (a), $R_{10}$ and $R_{20}$ are independently selected from hydrogen atoms, halogen atoms (e.g., fluorine, chlorine and bromine atoms), substituted or unsubstituted alkyl groups of 1 to 18 carbon atoms (e.g., methyl, trifluoromethyl and glycidyl), substituted or unsubstituted cycloalkyl groups of 6 to 18 carbon atoms (e.g., cyclohexyl), substituted or unsubstituted aryl groups of 6 to 18 carbon atoms (e.g., phenyl and tolyl), substituted or unsubstituted alkoxy groups of 1 to 20 carbon atoms (e.g., methoxy, butoxy, 2-butoxyethoxy and 3-butoxy-2-hydroxypropyloxy), and substituted or unsubstituted aryloxy groups of 6 to 18 carbon atoms (e.g., phenoxy and p-methylphenoxy). Preferably, $R_{10}$ and $R_{20}$ are substituted or unsubstituted alkoxy groups of 1 to 20 carbon atoms while their substituting position is preferably at the para-position relative to the carbon atom attached to the triazine ring.

Of the UV absorbers of formulae [1] through [7], those compounds of formulae [1], [3] and [7] are especially preferred because they themselves are highly light fast.

Where the UV absorbers are used under basic conditions those compounds of formulae [2], [4], [5] and [6] are favorable because coloring due to dissociation does not occur.

Illustrative, non-limiting, examples of the UV absorbers of formulae [1] through [7] are given below.

1-1

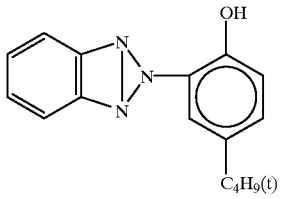

1-2

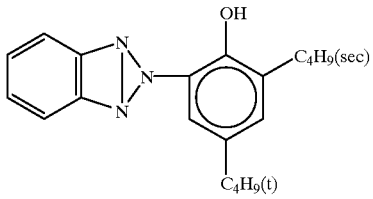

1-3

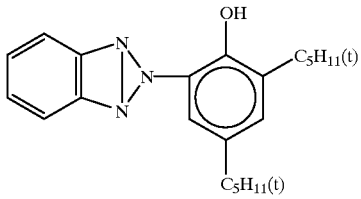

1-4

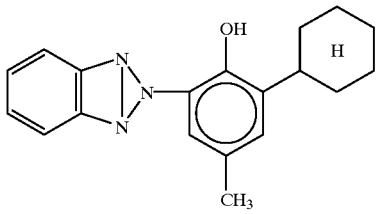

1-5

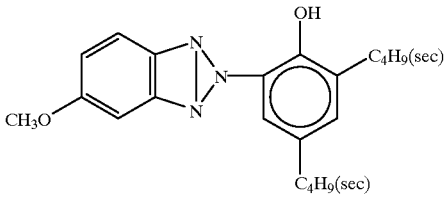

1-6

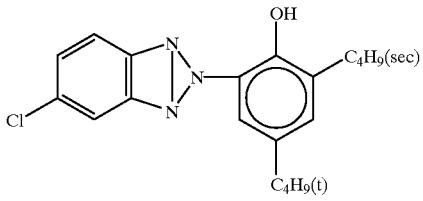

-continued
1-7
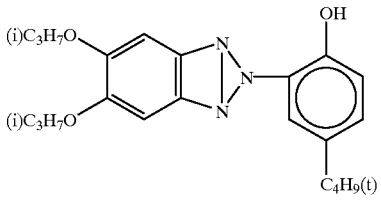
1-8
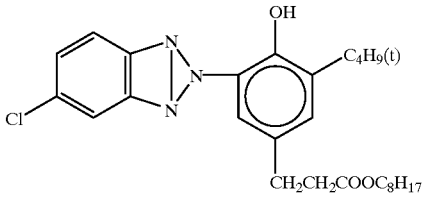
1-9
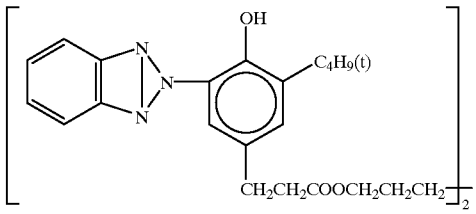
2-1
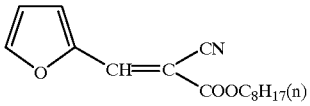
2-2
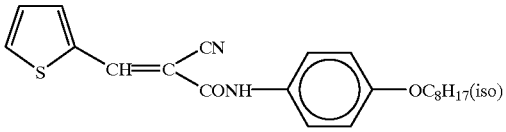
2-3
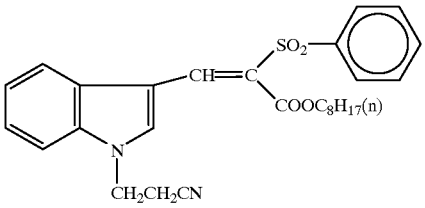
2-4
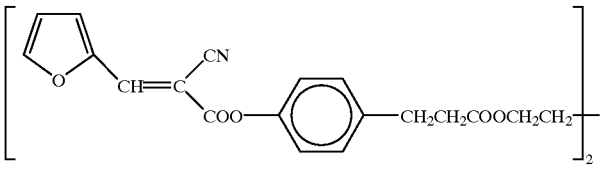
2-5
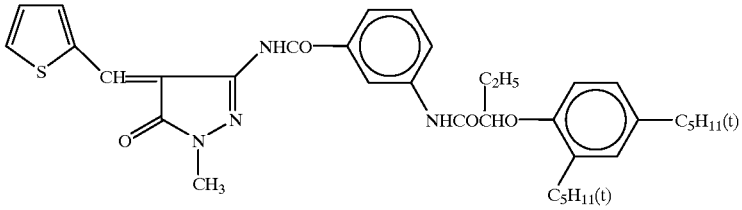

-continued
2-6
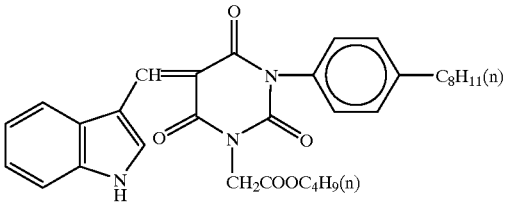
2-7
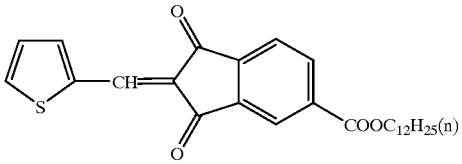
2-8
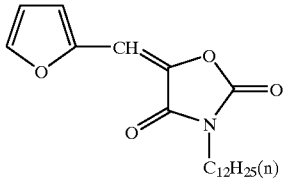
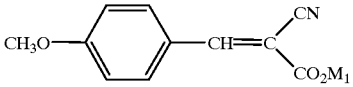
2-9
$M_1$═H
2-10
$M_1$═Na
2-11
$M_1$═Li
2-12
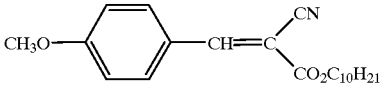
2-13
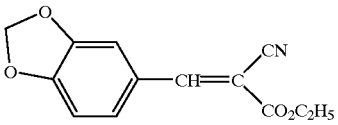
2-14
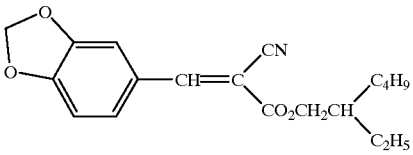
2-15
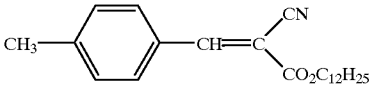
2-16
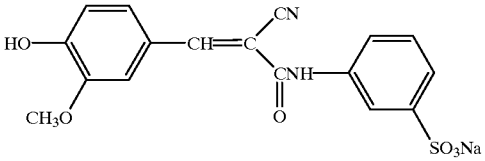

-continued
2-17
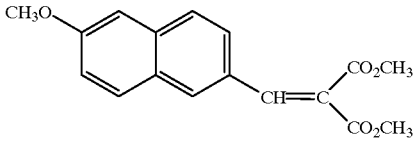
3-1
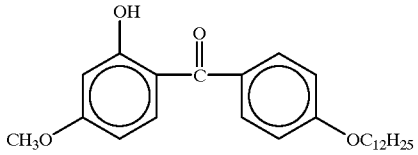
3-2
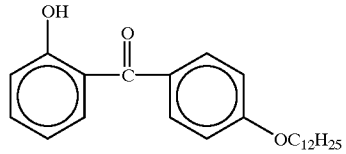
3-3
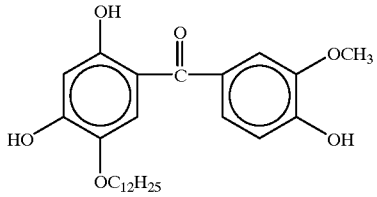
3-4
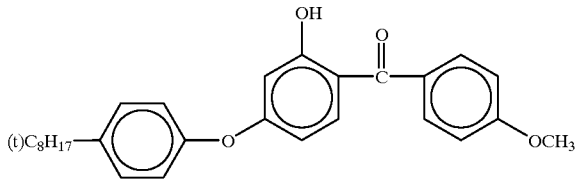
3-5
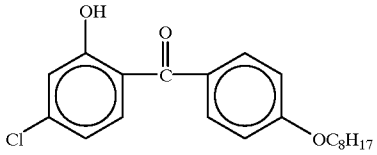
3-6
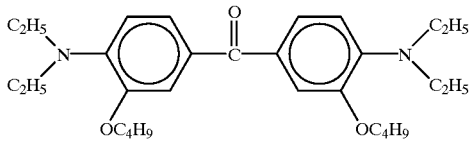
3-7
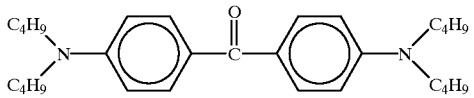
3-8
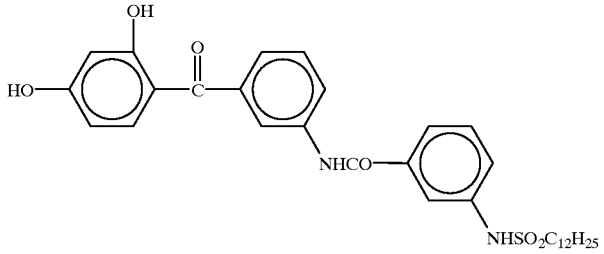

-continued
3-9
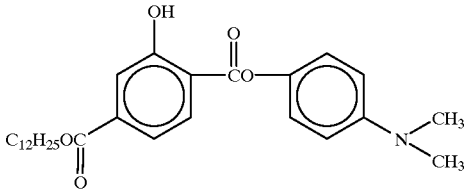
3-10
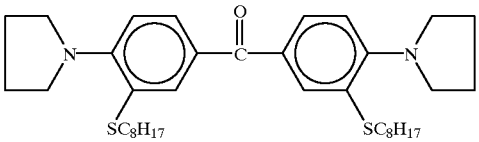
3-11
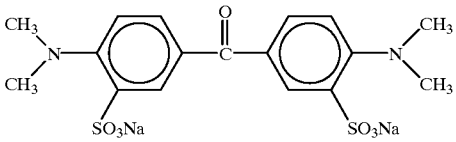
4-1
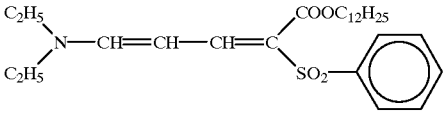
4-2
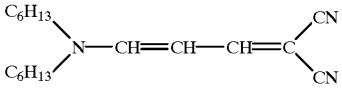
4-3
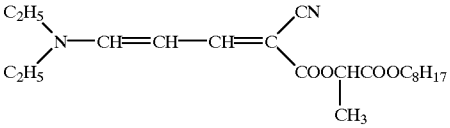
4-4
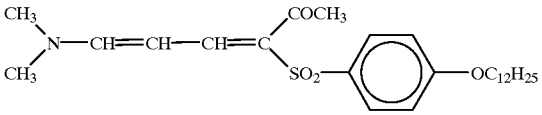
4-5
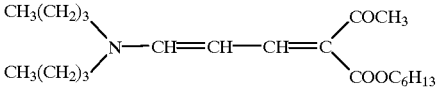
4-6
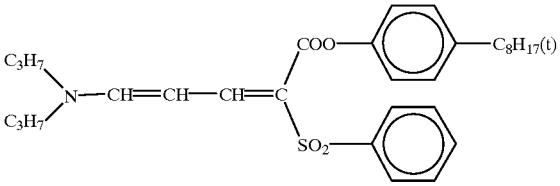
4-7
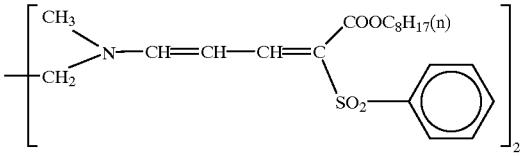

-continued
5-1
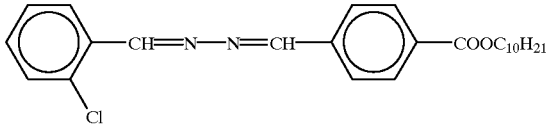
5-2
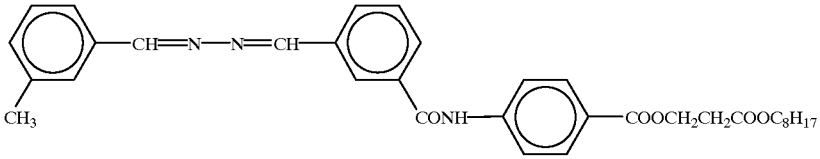
5-3
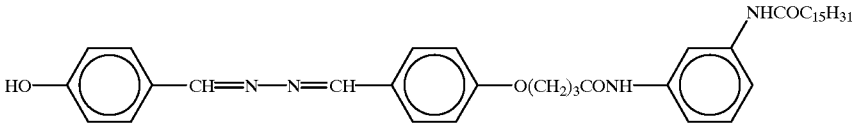
6-1
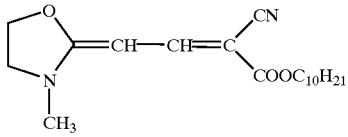
6-2
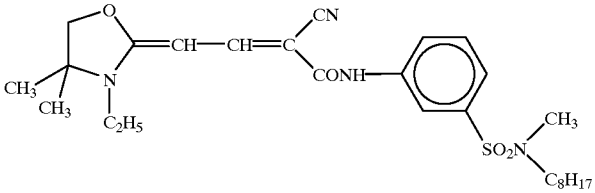
6-3
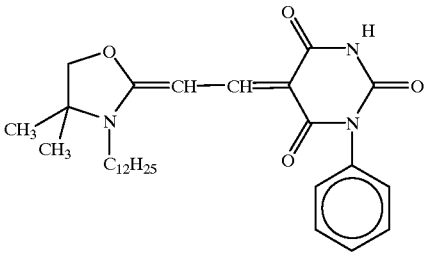
6-4
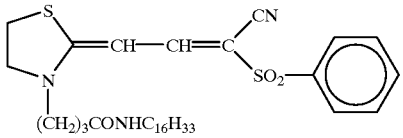
6-5
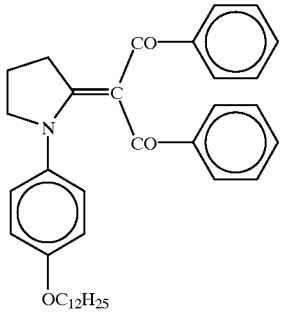

-continued
6-6
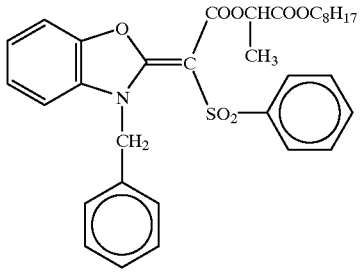
6-7
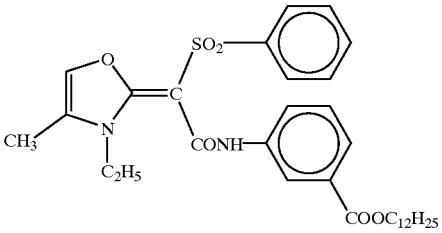
7-1
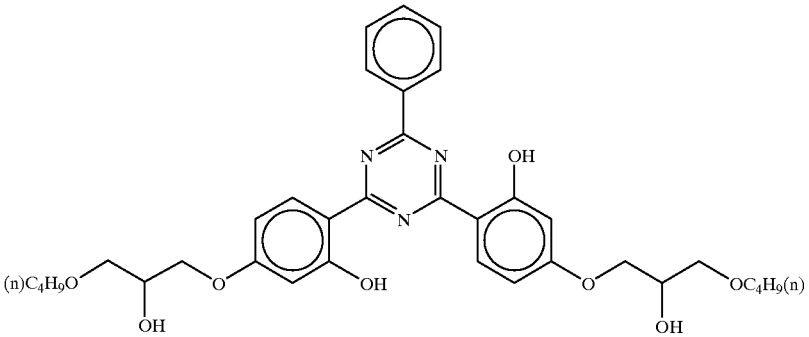
7-2
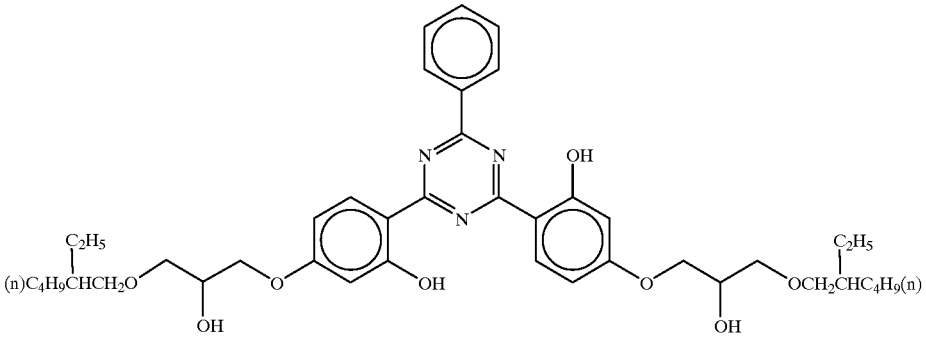
7-3
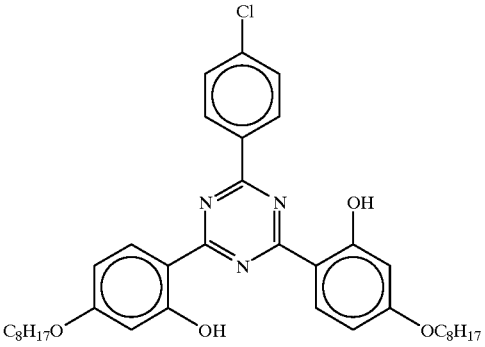

-continued
7-4
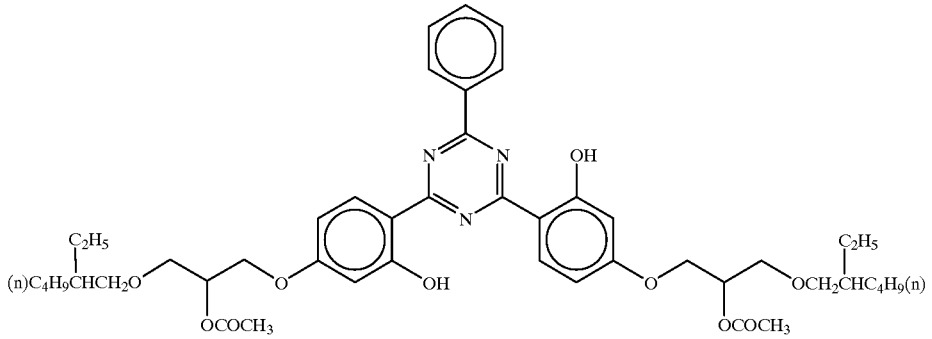
7-5
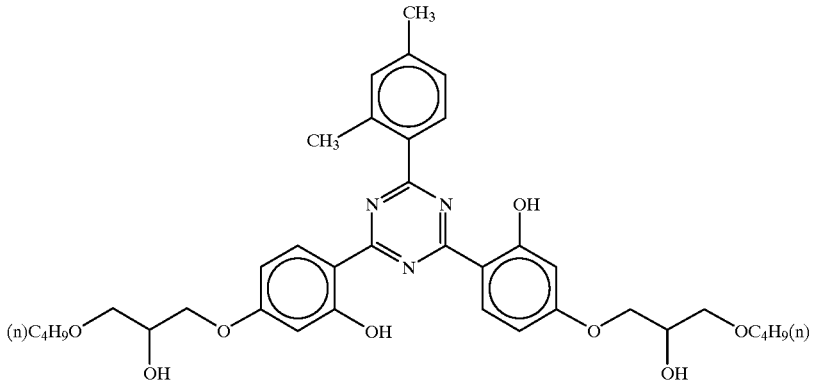
7-6
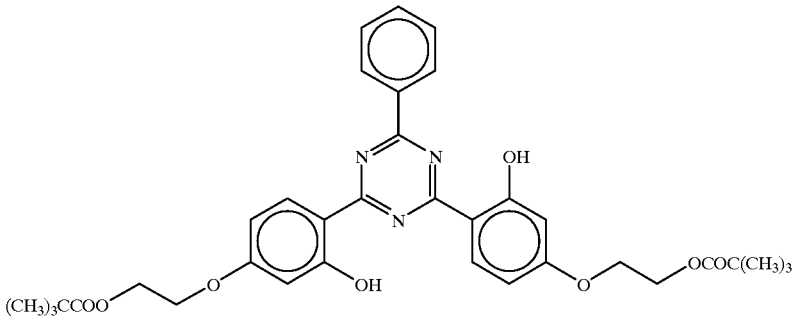
7-7
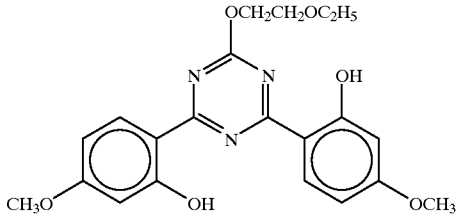
7-8
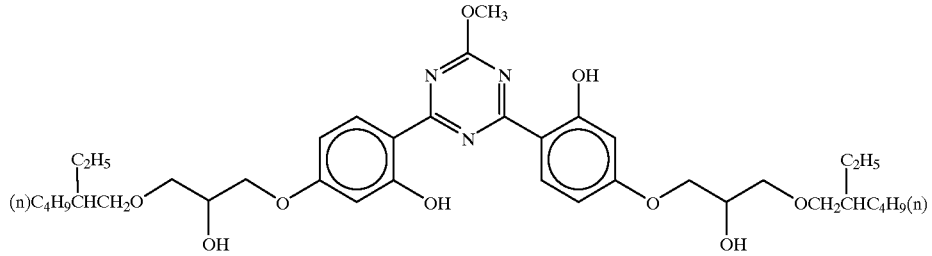

-continued
7-9
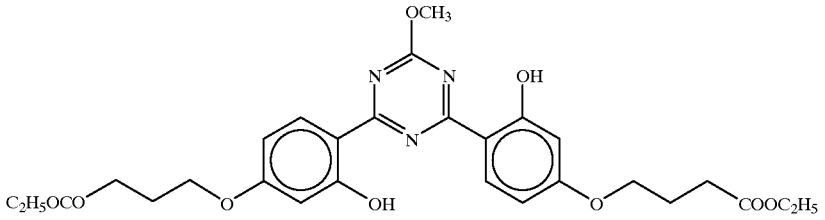
7-10
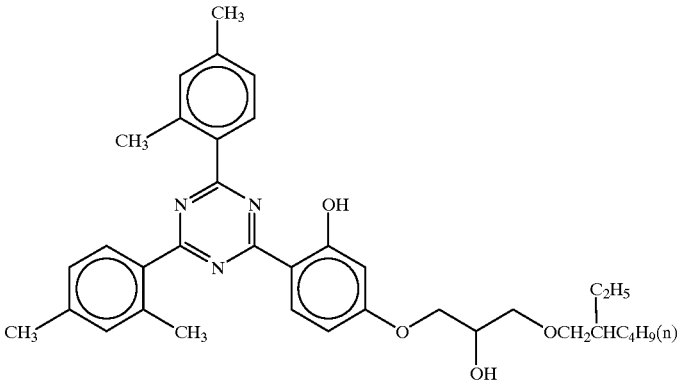
7-11
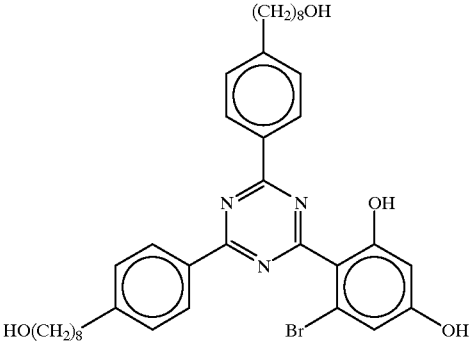
7-12
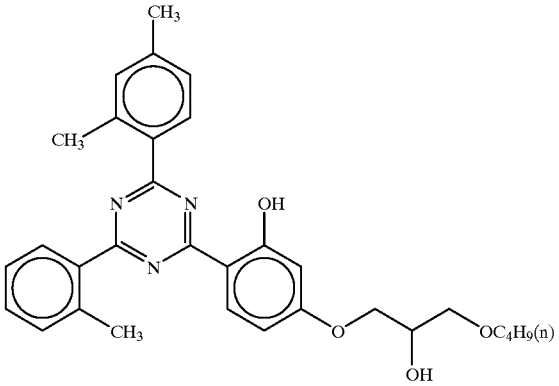

-continued
7-13
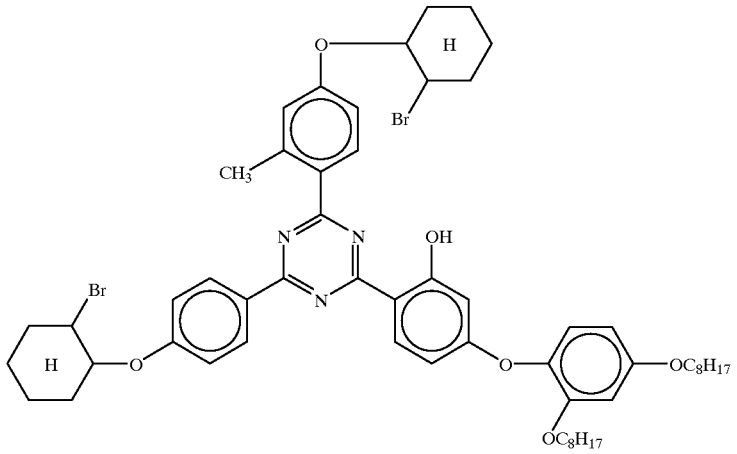
7-14
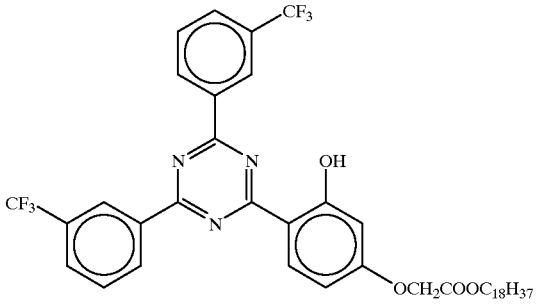
7-15
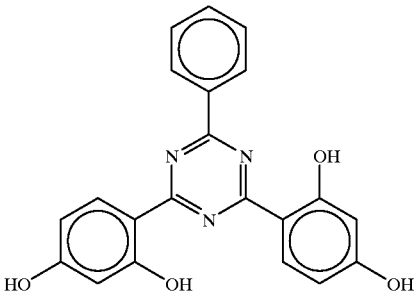
7-16
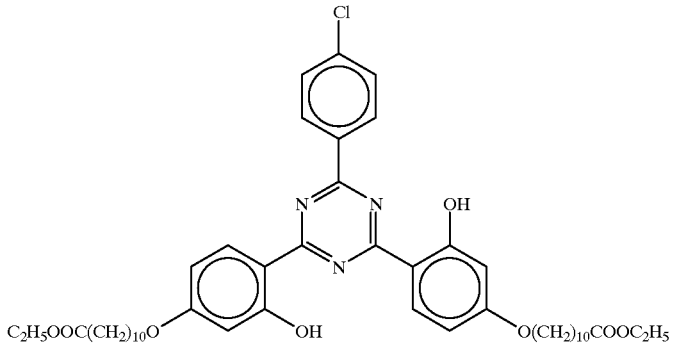

-continued
7-17
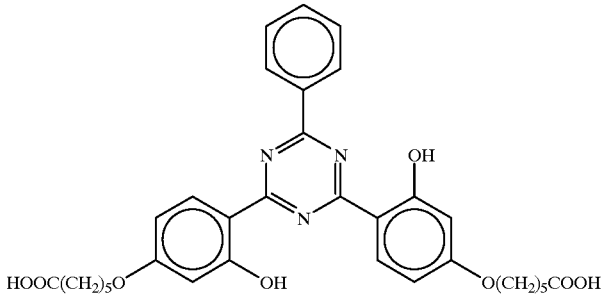
7-18
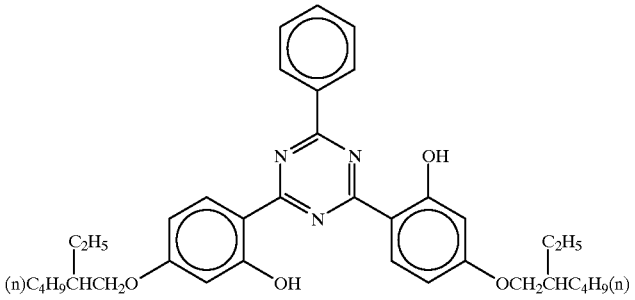
7-19
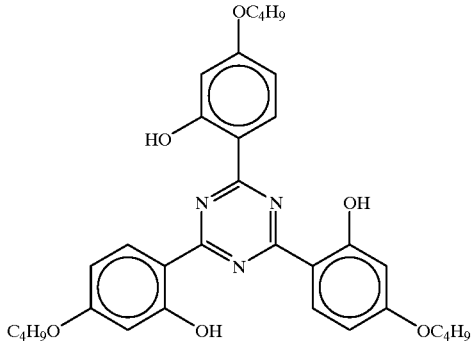
7-20
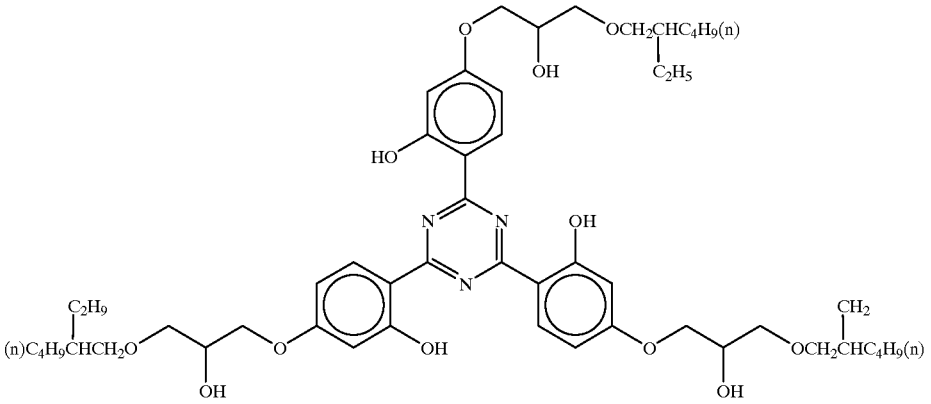

-continued
7-21
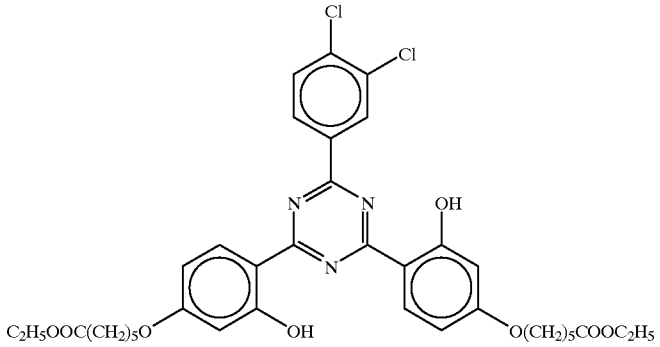
7-22
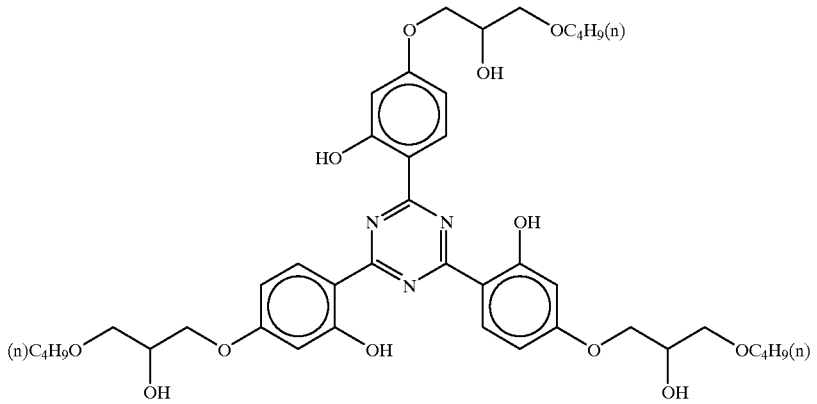
7-23
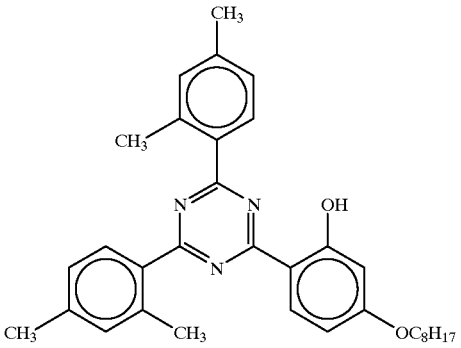
7-24
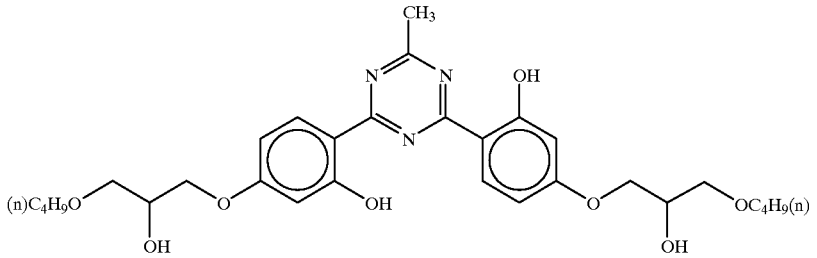

-continued
7-25
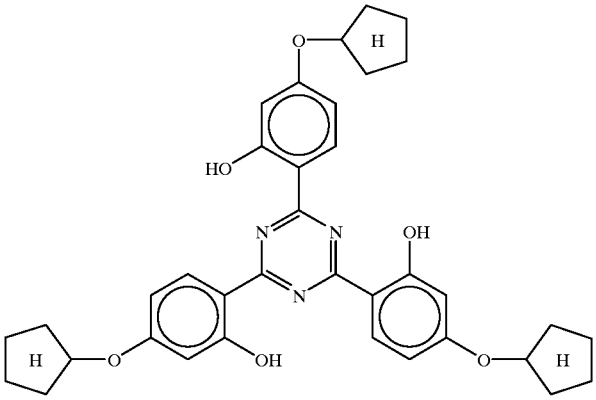
7-26
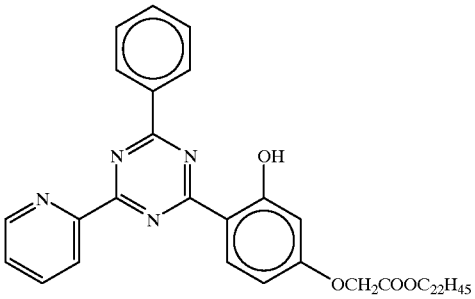
7-27
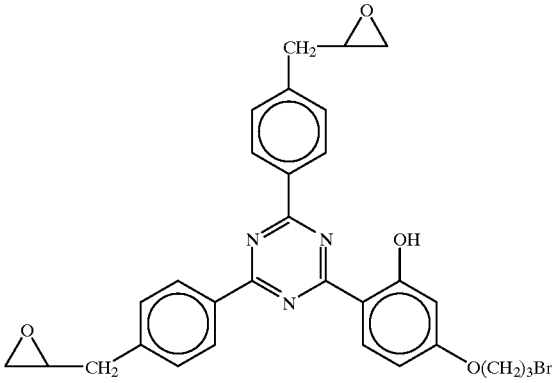
7-28
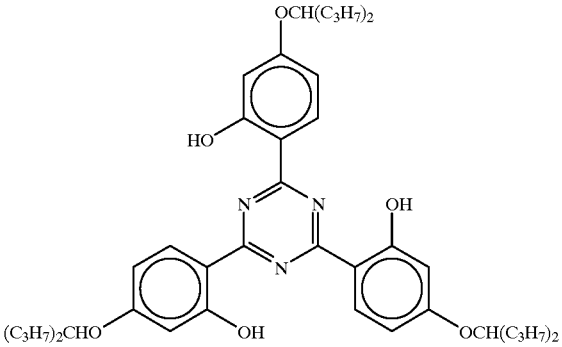

-continued
7-29
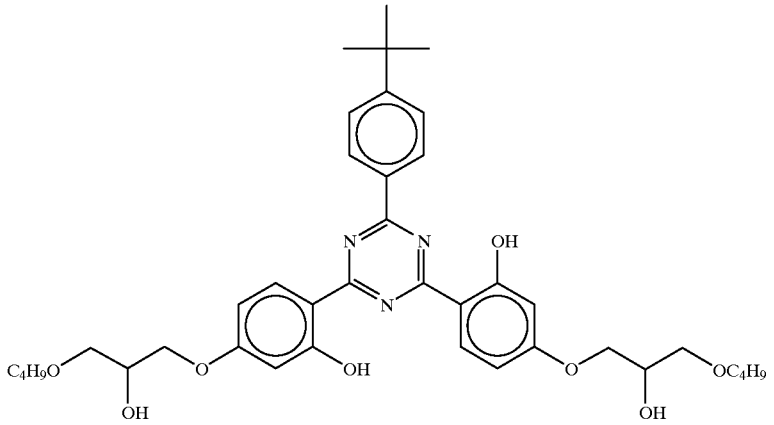
7-30
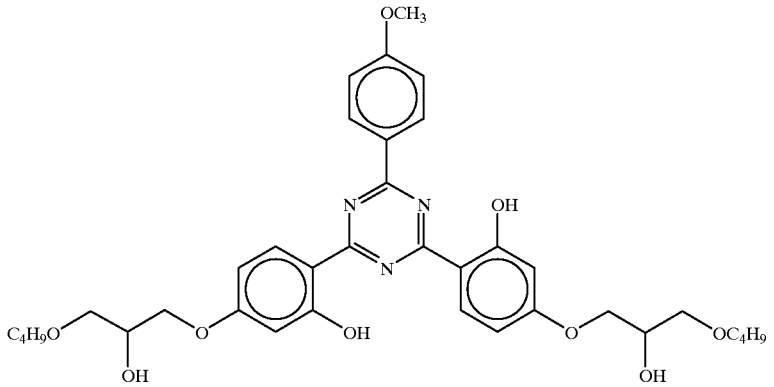
7-31
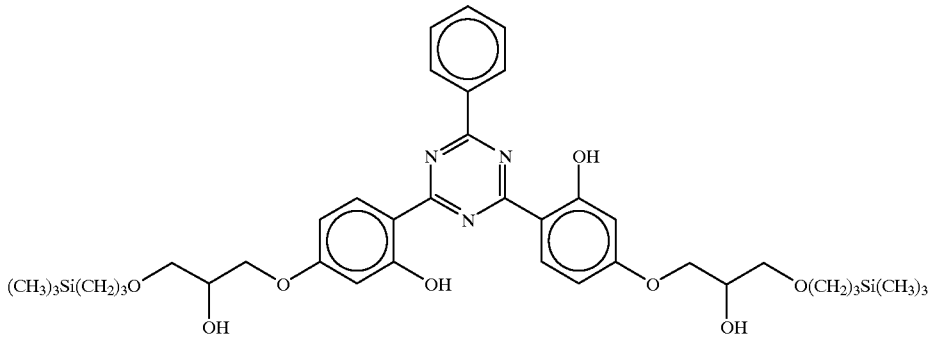
7-32
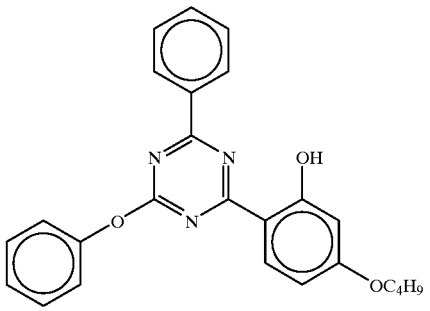
The compounds of formulae [1] through [6] can be synthesized by the methods described, for example, in JP-B 36984/1989, 125875/1980, 10466/1961, 5496/1973, JP-A 214152/1983, 221844/1983, U.S. Pat. Nos. 3,754,919, 4,220,711, 2,719,086, 3,698,707, 3,707,375, JP-B 30492/1973, JP-A 10537/1972, 19945/1984, 53544/1988, 56620/1976, 128333/1978, 181040/1983, BP 1,198,337 or similar methods. The compounds of formula [7] can be synthesized by the methods described, for example, in JP-A 3335/1971 and EP 520938A1.

In the practice of the invention, polymeric UV absorbers may also be used. The polymeric UV absorbers are preferably those having the chemical structures of formulae [1] to [7] as the sole or partial constituent units. UV absorbers having the chemical structure of formula [1] as constituent units are described, for example, in EP 747755, JP-A 127649/1997, 179464/1996, 82962/1994, 193869/1992, 139590/1991, 55542/1988, 24247/1987, 560/1972, and 185677/1983; UV absorbers having the chemical structure of formula [2] as constituent units are described, for example, in Japanese Publication of International Patent Application No. 500228/1992 and JP-B 53541/1988; UV absorbers having the chemical structure of formula [3] as constituent units are described, for example, in JP-A 35660/1988 and 180909/1990; UV absorbers having the chemical structure of formula [4] as constituent units are described, for example, in EP 27242, JP-B 53455/1989 and JP-A 189530/1986; UV absorbers having the chemical structure of formula [6] as constituent units are described, for example, in JP-A 53543/1988; UV absorbers having the chemical structure of formula [7] as constituent units are described, for example, in EP 706083. They are also disclosed in JP-A 192/1972, 169831/1986, 53543/1988, 53544/1988, 56651/1988 and EP 343246.

Illustrative preferred examples of the polymeric UV absorbers are given below although the absorbers are not limited thereto. The numerical values of x, y and z are weight ratios.

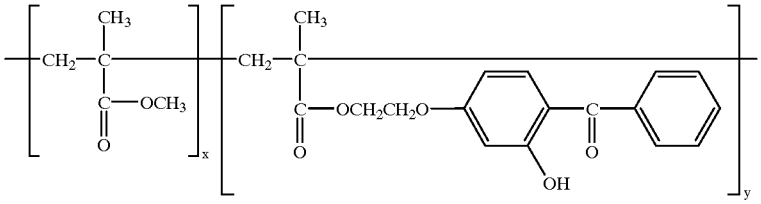

P-1 x = 1 y = 1

P-2 x = 7 y = 3

P-3 x = 0 y = 1 (homopolymer)

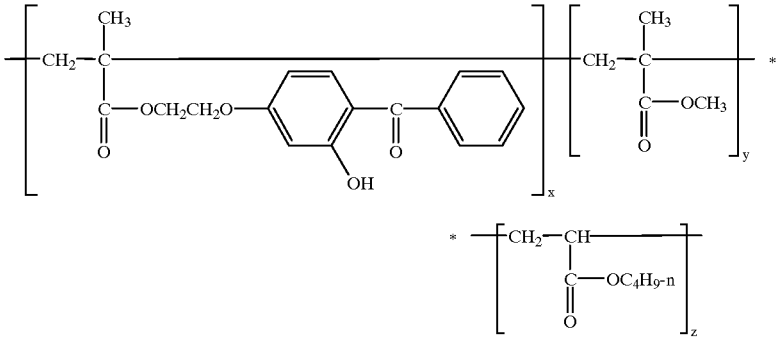

P-4 x = 1 y = 7 z = 2

P-5 x = 1 y = 5 z = 4

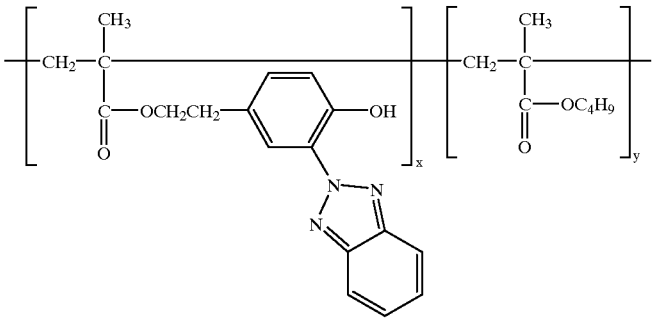

P-6 x = 1 y = 0 (homopolymer)

P-7 x = 1 y = 1

-continued
P-8
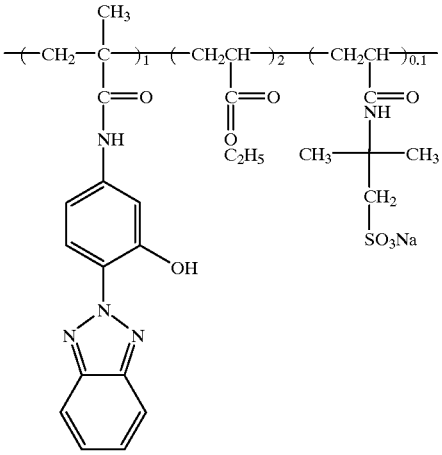
P-9
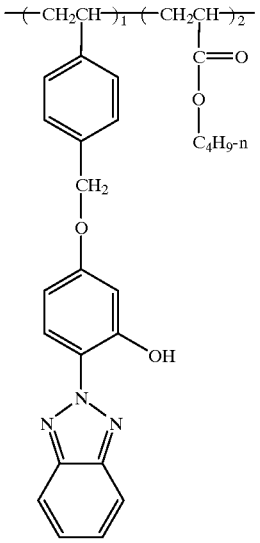
P-10
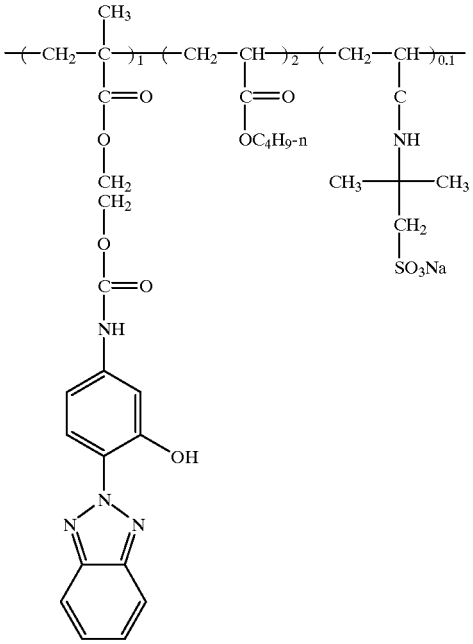

-continued
P-11
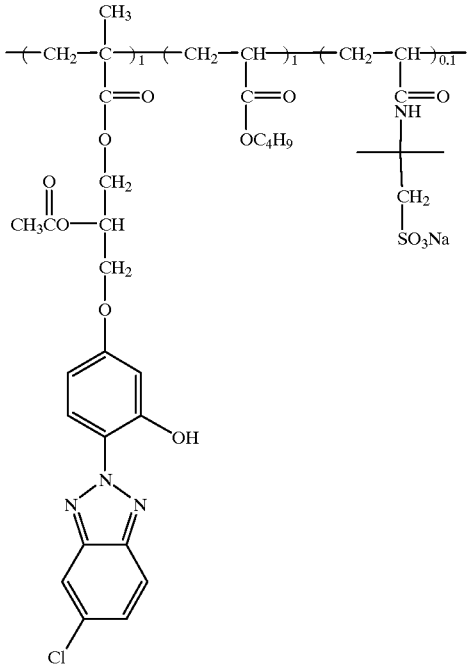
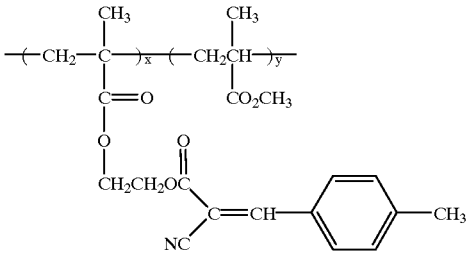
P-12 x = 1 y = 0 (homopolymer)
P-13 x = 7 y = 3
P-14
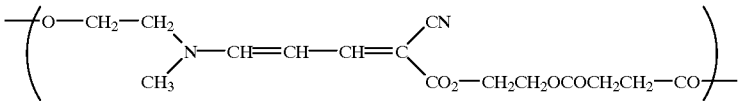
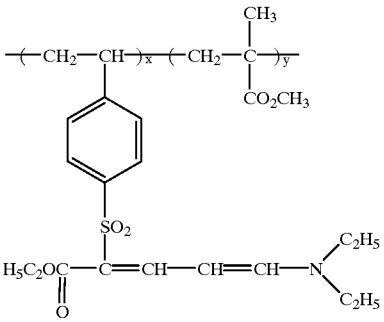
P-15 x = 1 y = 0 (homopolymer)
P-16 x = 8 y = 2
P-17
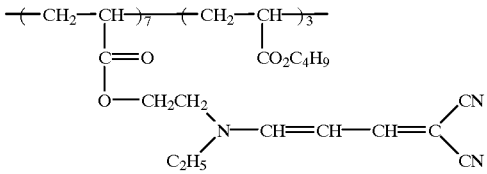

-continued

P-18

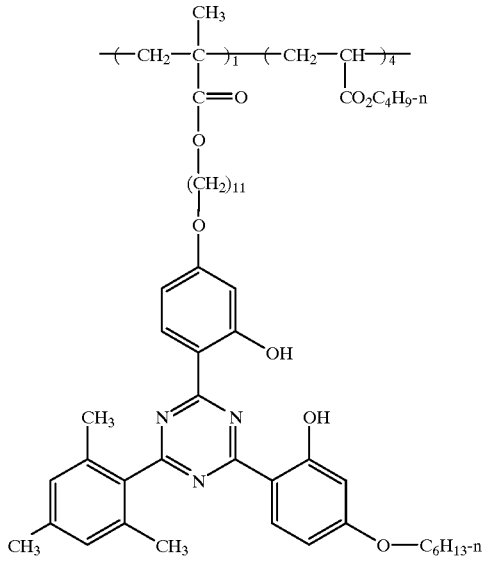

Also useful in the practice of the invention are inorganic UV absorbers. The UV absorbers in the form of inorganic compounds include a titania particle dispersion as disclosed in German Patent No. 19511316 and particle dispersions of other metal oxides such as cerium oxide and zinc oxide.

The UV absorbers may be used alone or in admixture of two or more.

The amount of UV absorber added varies with the desired effect although it is preferably 1 mg/m$^2$ to 10 g/m$^2$, more preferably 10 mg/m$^2$ to 2 g/m$^2$, when expressed by a coating weight per square meter of the imaging material.

Oxidizing agent

The oxidizing agent which is used herein may be any of well-known oxidizing agents insofar as it is effective for reducing fog during storage. Such oxidizing agents are described, for example, in JP-A 119624/1975, 120328/1975, 121332/1976, 58022/1979, 70543/1981, 99335/1981, 90842/1984, 129642/1986, 129845/1987, 208191/1994, 5621/1995, 2781/1995, and 15809/1996, U.S. Pat. Nos. 5,340,712, 5,369,000, 5,464,737, 3,874,946, 4,756,999, 5,340,712, EP 605981A1, 622666A1, 631176A1 JP-B 165/1979, JP-A 2781/1995, U.S. Pat. Nos. 4,180,665 and 4,442,202.

Also useful are polyhalogenated compounds of the following general formula (I).

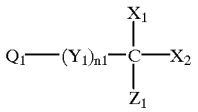

(I)

In formula (I), $Q_1$ is an alkyl, aryl or heterocyclic group, each of $X_1$ and $X_2$ is a halogen atom, $Z_1$ is a hydrogen atom or electron attractive group, $Y_1$ is —C(=O)—, —SO— or —$SO_2$—, and letter $n_1$ is equal to 0 or 1.

The aryl group represented by $Q_1$ may be monocyclic or a fused ring, preferably a monocyclic or bicyclic aryl group of 6 to 30 carbon atoms (e.g., phenyl or naphthyl), more preferably phenyl or naphthyl, especially phenyl.

The heterocyclic group represented by $Q_1$ is a 3- to 10-membered, saturated or unsaturated, heterocyclic group containing at least one atom selected from nitrogen, oxygen and sulfur, which may be monocyclic or form a fused ring with another ring.

Preferred heterocyclic groups are 5- or 6-membered unsaturated heterocyclic groups which may have a fused ring, more preferably 5- or 6-membered aromatic heterocyclic groups which may have a fused ring. Further preferred are 5- or 6-membered aromatic heterocyclic groups which may have a nitrogen atom-containing fused ring, especially 5- or 6-membered aromatic heterocyclic groups which may have a fused ring containing one to four nitrogen atoms. Exemplary heterocycles in these heterocyclic groups include imidazole, pyrazole, pyridine, pyrimidine, pyrazine, pyridazine, triazole, triazine, indole, indazole, purine, thiadiazole, oxadiazole, quinoline, phthalazine, naphthyridine, quinoxaline, quinazoline, cinnoline, pteridine, acridine, phenanthroline, phenazine, tetrazole, thiazole, oxazole, benzimidazole, benzoxazole, benzthiazole, indolenine, and tetraazaindene; more preferably imidazole, pyridine, pyrimidine, pyrazine, pyridazine, triazole, triazine, thiadiazole, oxadiazole, quinoline, phthalazine, naphthyridine, quinoxaline, quinazoline, cinnoline, tetrazole, thiazole, oxazole, benzimidazole, benzoxazole, benzthiazole, and tetraazaindene; further preferably imidazole, pyridine, pyrimidine, pyrazine, pyridazine, triazole, triazine, thiadiazole, quinoline, phthalazine, naphthyridine, quinoxaline, quinazoline, cinnoline, tetrazole, thiazole, benzimidazole, and benzthiazole; most preferably pyridine, thiadiazole, quinoline, and benzthiazole.

The aryl group and heterocyclic group represented by $Q_1$ may have another substituent in addition to —$(Y_1)_{n1}$—$CZ_1(X_1)(X_2)$. Such substituents include alkyl, alkenyl, aryl, alkoxy, aryloxy, acyloxy, acyl, alkoxycarbonyl, aryloxycarbonyl, acyloxy, acylamino, alkoxycarbonylamino, aryloxycarbonylamino, sulfonylamino, sulfamoyl, carbamoyl, sulfonyl, ureido, phosphoramido, halogen, cyano, sulfo, carboxyl, nitro and heterocyclic groups; preferably alkyl, aryl, alkoxy, aryloxy, acyl, acylamino, alkoxycarbonylamino, aryloxycarbonylamino, sulfonylamino, sulfamoyl, carbamoyl, ureido, phosphoramido, halogen, cyano, nitro and heterocyclic groups; more preferably alkyl, aryl, alkoxy, aryloxy, acyl, acylamino, sulfonylamino, sulfamoyl, carbamoyl, halogen, cyano, nitro and heterocyclic groups; most preferably alkyl groups, aryl groups and halogen atoms.

The alkyl group represented by $Q_1$ may be selected from normal, branched or cyclic groups, preferably having 1 to 30 carbon atoms, more preferably 1 to 15 carbon atoms, for example, methyl, ethyl, n-propyl, isopropyl and tert-octyl.

The alkyl group represented by $Q_1$ may have another substituent in addition to $—(Y_1)_{n1}—CZ_1(X_1)(X_2)$. The substituents are as exemplified for the substituents on the heterocyclic or aryl group represented by $Q_1$. Preferred substituents include alkenyl, aryl, alkoxy, aryloxy, acyloxy, acylamino, alkoxycarbonylamino, aryloxycarbonylamino, sulfonylamino, alkylthio, arylthio, ureido, phosphoramido, hydroxy, halogen, and heterocyclic groups; more preferably aryl, alkoxy, aryloxy, acylamino, alkoxycarbonylamino, aryloxycarbonylamino, sulfonylamino, ureido, phosphoramido groups, and halogen atoms; further preferably aryl, alkoxy, aryloxy, acylamino, sulfonylamino, ureido, and phosphoramido groups.

$Y_1$ is —C(═O)—, —SO— or $—SO_2—$, preferably —C(═O)— or $—SO_2—$, more preferably $—SO_2—$.

Letter $n_1$ is equal to 0 or 1, preferably 1.

Each of $X_1$ and $X_2$ is a halogen atom. The halogen atoms represented by $X_1$ and $X_2$ may be the same or different and are selected from fluorine, chlorine, bromine and iodine atoms, preferably chlorine, bromine and iodine atoms, more preferably chlorine and bromine atoms, most preferably bromine atoms.

$Z_1$ is a hydrogen atom or electron attractive group. The electron attractive group represented by $Z_1$ is preferably a substituent having a $\sigma_p$ value of at least 0.01, more preferably at least 0.1. With respect to the Hammett's substituent constant, reference should be made to Journal of Medicinal Chemistry, 1973, Vol. 16, No. 11, 1207–1216.

Preferably, $Z_1$ is an electron attractive group, more preferably a halogen atom, an aliphatic aryl or heterocyclic sulfonyl group, an aliphatic aryl or heterocyclic oxycarbonyl group, a carbamoyl group or a sulfamoyl group, most preferably a halogen atom. Of the halogen atoms, chlorine, bromine and iodine atoms are preferred, and chlorine and bromine atoms are more preferred, with bromine atoms being most preferred.

Among the polyhalogenated compounds, compounds of the following general formula (I-b) are more preferred.

(I-b)

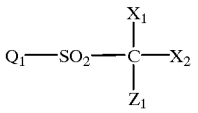

In formula (I-b), $Q_1$, $X_1$, $X_2$, and $Z_1$ are as defined in formula (I), with their preferred ranges being also as defined in formula (I).

Illustrative non-limiting examples of the polyhalogenated compounds which can be used herein are given below.

II-1

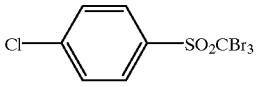

-continued

II-2

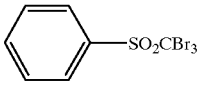

II-3

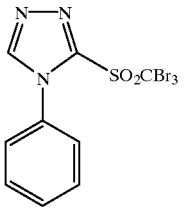

II-4

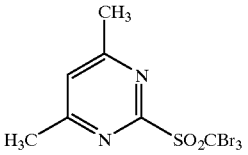

II-5

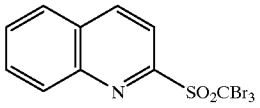

II-6

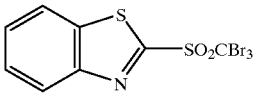

II-7

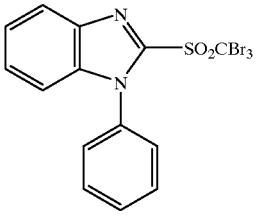

II-8

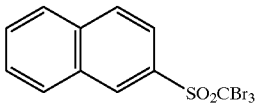

II-9

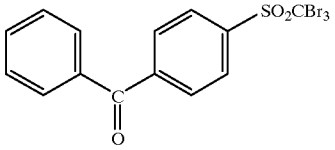

II-10

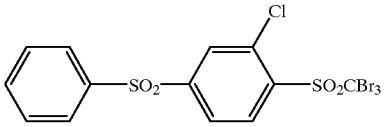

II-11

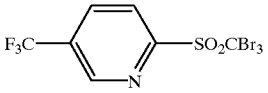

-continued
II-12
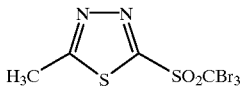
II-13
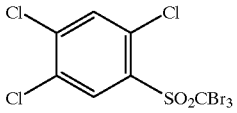
II-14
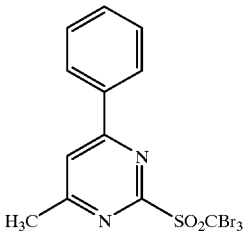
II-15
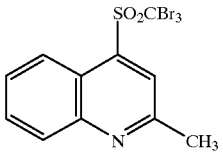
II-16
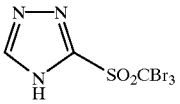
II-17
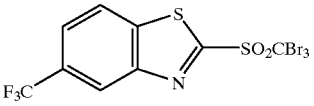
II-18
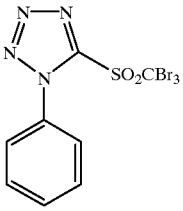
II-19
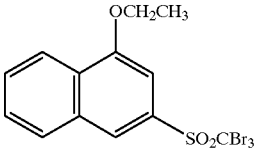
II-20
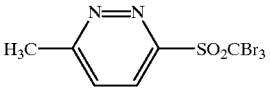
II-21
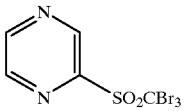
-continued
II-22
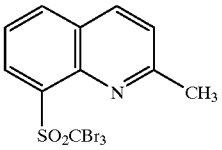
II-23
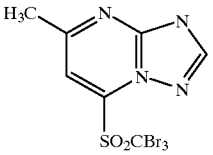
II-24
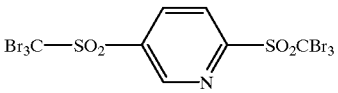
II-25
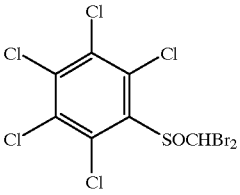
II-26
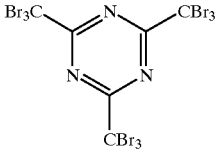
II-27
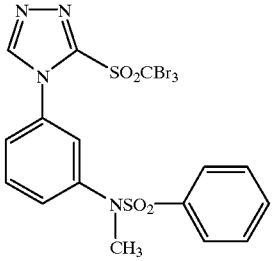
II-28
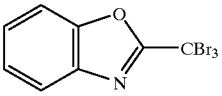
II-29
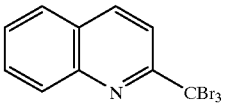
II-30
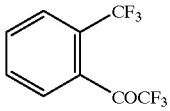

-continued

II-31

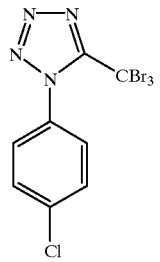

II-32

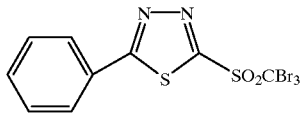

II-33

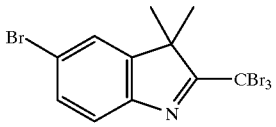

II-34

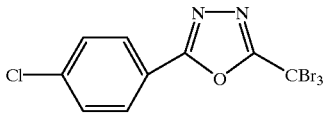

II-35

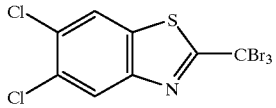

II-36

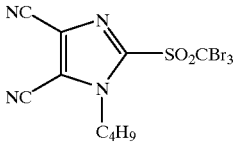

II-37

$CH_3(CH_2)_2CBr_2SO_2CBr_3$

II-38

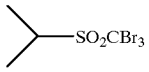

The amount of oxidizing agent added is preferably 10 $mg/m^2$ to 3 $g/m^2$, more preferably 50 $mg/m^2$ to 1 $g/m^2$, when expressed by a coating weight per square meter of the imaging material. The oxidizing agents may be used alone or in admixture of two or more.

The oxidizing agent may be added in any desired form such as solution, powder or solid particle dispersion although it is preferably added in a solid particle dispersion form.

The oxidizing agent is preferably contained in an image forming layer containing a non-photosensitive organic silver salt (which is a heat-sensitive layer or a photosensitive or emulsion layer). In the case of photothermographic imaging material, the oxidizing agent is preferably dispersed as solid particles in a photosensitive layer containing a photosensitive silver halide, a non-photosensitive organic silver salt, and a reducing agent therefor.

The solid particle dispersion of the oxidizing agent may be prepared by well-known comminuting means such as ball mills, vibrating ball mills, sand mills, colloidal mills, jet mills, and roller mills. Dispersing aids may be used for facilitating dispersion. The oxidizing agent may also be added as a solution obtained by mixing it with other additives such as sensitizing dyes, reducing agents and toners.

Dye and Pigment

In the photothermographic imaging material, a variety of dyes and pigments may be used from the standpoints of improving tone and preventing irradiation. Any desired dyes and pigments may be used in the invention. The dyes and pigments may be added in any desired form such as solution, emulsion or solid particle dispersion or in a form mordanted with polymeric mordants. The amounts of these compounds used are determined in accordance with the desired absorption although the compounds are generally used in amounts of 1 $\mu$g to 1 g per square meter of the imaging material.

In the practice of the invention, an antihalation layer may be disposed on the side of the photosensitive layer remote from the light source. The antihalation layer preferably has a maximum absorbance of 0.3 to 2 in the desired wavelength range, more preferably an absorbance of 0.5 to 2 at the exposure wavelength, and an absorbance of 0.001 to less than 0.5 in the visible region after processing, and is also preferably a layer having an optical density of 0.001 to less than 0.3.

Where an antihalation dye is used in the invention, it may be selected from various compounds insofar as it has the desired absorption in the wavelength range, is sufficiently low absorptive in the visible region after processing, and provides the antihalation layer with the preferred absorbance profile.

The pigments which can be used herein include commercially available ones and well-known ones described in the following literature. Included are Colour Index, edited by The Society of Dyersand Colourists; "New Edition Pigment Handbook," edited by the Japanese Pigment Technology Society, 1989; "Advanced Pigment Application Technology," CMC Publishing K.K., 1986, "Printing Ink Technology," CMC Publishing K.K., 1984, and W. Herbst & K. Hunger, "Industrial Organic Pigments," VCH Verlagsgesellshaft, 1993. More illustratively, organic pigments which can be used herein include azo pigments (e.g., azo lake pigments, insoluble azo lake pigments, condensed azo pigments, and chelate azo pigments), polycyclic pigments (e.g., phthalocyanine pigments, anthraquinone pigments, perylene and perinone pigments, indigo pigments, quinacridone pigments, dioxazine pigments, isoindolinone pigments, quinophthalone pigments, and diketopyrrolopyrrole pigments), dyeing lake pigments (e.g., lake pigments of acidic or basic dyes), and azine pigments. Inorganic pigments are also useful. Inter alia, phthalocyanine pigments, anthraquinone family indanthrone pigments, triarylcarbonium pigments belonging to the dyeing lake pigments, indigo pigments as well as inorganic pigments such as ultramarine and cobalt blue are preferable for obtaining favorable blue tone. In combination with the above blue pigments, red or purple pigments such as dioxazine pigments, quinacridone pigments, and diketopyrrolopyrrole pigments may be used for adjusting the tone.

Illustrative preferred examples of the pigment are given below. Examples of the blue pigment include phthalocyanine C.I. Pigment Blue 15, 15:1, 15:2, 15:3, 15:4, 15:6 (copper phthalocyanine), monochloro or low chlorinated copper phthalocyanine, C.I. Pigment Blue 16 (metal-free phthalocyanine), phthalocyanine having Zn, Al or Ti as the center metal, indanthrone family C.I. Pigment Blue 60, also known as vat dye, and halogen-substituted ones thereof, for example, C.I. Pigment Blue 64, 21, azo family C.I. Pigment Blue 25, indigo family C.I. Pigment Blue 66, C.I. Pigment Blue 63 belonging to lake pigments, C.I. Pigment Blue 1, 2, 3, 9, 10, 14, 18, 19, 24:1, 24:x, 56, 61 and 62 belonging to lake pigments of triarylcarbonium type acidic dyes or basic dyes. The red or purple pigments include dioxazine family C.I. Pigment Violet 23 and 37, azo family C.I. Pigment Violet 13, 25, 32, 44 and 50, C.I. Pigment Red 23, 52:1, 57:1, 63:2, 146, 150, 151, 175, 176, 185, 187 and 245, quinacridone family C.I. Pigment Violet 19 and 42, C.I. Pigment Red 122, 192, 202, 207, and 209, C.I. Pigment Violet 1, 2, 3, 27 and 39 belonging to triarylcarbonium type lake pigments, C.I. Pigment Violet 81:1, perylene family C.I. Pigment Violet 29, anthraquinone family C.I. Pigment Violet 5:1, 31 and 33, thioindigo family C.I. Pigment Red 38 and 88.

The pigments which can be used herein may be either bare pigments as described above or surface-treated pigments. The methods of surface treatment include surface coating of resins or wax, application of surfactants, and binding of reactive substances (e.g., silane coupling agent, epoxy compounds, and polyisocyanates) to the pigment surface. These methods are described in "Properties and Application of Metal Soaps," Yuki Shobo K.K., "Printing Ink Technology," CMC Publishing K.K., 1984, and "Advanced Pigment Application Technology," CMC Publishing K.K., 1986.

In the practice of the invention, the pigment is used as a dispersion in a binder. A dispersant is selected in accordance with a particular binder and pigment, for example, from surfactant type low molecular weight dispersants and high molecular weight dispersants. For use in hydrophobic binders, it is more preferable from the standpoint of dispersion stability to use high molecular weight dispersants. Exemplary dispersants are described, for example, in JP-A 69949/1991 and EP 549,486.

The pigment used herein preferably has a particle size in the range of 0.01 to 10 $\mu$m, more preferably 0.05 to 1 $\mu$m after dispersion.

In dispersing the pigment in a binder, any of well-known dispersing techniques employed in the ink and toner manufacturing processes may be used. The dispersing machines include sand mills, attritors, pearl mills, super mills, ball mills, impellers, dispersers, KD mills, colloidal mills, dynatron mills, three-roll mills, and pressure kneaders. The detail is described in "Advanced Pigment Application Technology," CMC Publishing K.K., 1986.

The dye which is used herein is not critical. Useful dyes include the dyes described in Colour Index, for example, pyrazoloazole dyes, anthraquinone dyes, azo dyes, azomethine dyes, oxonol dyes, carbocyanine dyes, styryl dyes, triphenylmethane dyes, indoaniline dyes, and indophenol dyes. The preferred dyes used herein include anthraquinone dyes (e.g., Compounds 1 to 9 described in JP-A 341441/1993 and Compounds 3-6 to 3-18 and 3-23 to 3-38 described in JP-A 165147/1993), azomethine dyes (e.g., Compounds 17 to 47 described in JP-A 341441/1993), indoaniline dyes (e.g., Compounds 11 to 19 described in JP-A 289227/1993, Compound 47 described in JP-A 341441/1993 and Compounds 2-10 to 2-11 described in JP-A 165147/1993), and azo dyes (e.g., Compounds 10 to 16 described in JP-A 341441/1993). Other useful dyes are described in JP-A 56458/1984, 216140/1990, 13295/1995, 11432/1995, U.S. Pat. No. 5,380,635, JP-A 68539/1990, page 13, lower-left column, line 1 to page 14, lower-left column, line 9, and JP-A 24539/1991, page 14, lower-left column to page 16, lower-right column.

Examples of the dye which can be used herein include oxonol dyes having a pyrazolone nucleus or barbituric acid nucleus as described in BP 506,385, 1,177,429, 1,311,884, 1,338,799, 1,385,371, 1,467,214, 1,433,102, 1,553,516, JP-A 85130/1973, 114420/1974, 117123/1977, 161233/1980, 111640/1984, JP-B 22069/1964, 13168/1968, 273527/1987, U.S. Pat. Nos. 3,247,127, 3,469,985 and 4,078,933; other oxonol dyes as described in U.S. Pat. Nos. 2,533,472, 3,379,533, and BP 1,278,621; azo dyes as described in BP 575,691, 680,631, 599,623, 786,907, 907,125, 1,045,609, U.S. Pat. No. 4,255,326, and JP-A 211043/1984; azomethine dyes as described in JP-A 100116/1975, 188247/1979, BP 2,014,598 and 750,031; anthraquinone dyes as described in U.S. Pat. No. 2,865,752; allylidene dyes as described in U.S. Pat. Nos. 2,538,009, 2,688,541, 2,538,008, BP 584,609, 1,210,252, JP-A 40625/1975, 3623/1976, 10927/1976, 118247/1979, JP-B 3286/1973, and 37303/1984; styryl dyes as described in JP-B 3082/1953, 16594/1969, and 28898/1984; triarylmethane dyes as described in BP 446,583, 1,335,422, JP-A 228250/1984; merocyanine dyes as described in BP 1,075,653, 1,153,341, 1,284,730, 1,475,228, and 1,542,807; and cyanine dyes as described in U.S. Pat. Nos. 2,843,486 and 3,294,539. Squarylium dyes and croconium dyes are also useful.

The dye or pigment is added in such an amount that the photothermographic imaging material may have an absorbance of 0.1 to 1.0. Illustratively, the preferred amount of the dye or pigment added is from 1 mg to 3 g as expressed by the coating weight per square meter of the photothermographic imaging material.

It is further preferable in the practice of the invention to use a dye which will decolorize upon heat treatment or a combination of a first compound which will cause decolorization upon heat treatment with a second compound which will be decolorized. Illustrative, non-limiting, examples of decolorizable colored layers are disclosed in JP-A 139136/1977, 132334/1978, 501480/1981, 16060/1982, 68831/1982, 101835/1982, 182436/1984, 36145/1995, 199409/1995, JP-B 33692/1973, 16648/1975, 41734/1990, U.S. Pat. Nos. 4,088,497, 4,283,487, 4,588,96, and 5,187,049. The amounts of these compounds are determined in accordance with the desired absorption although they are preferably used in amounts of 1 $\mu$g to 1 g/m$^2$ of the photosensitive imaging material.

Organic silver salt

The organic silver salt which can be used herein is relatively stable to light, but forms a silver image when heated at 80° C. or higher in the presence of an exposed photocatalyst (as typified by a latent image of photosensitive silver halide) and a reducing agent. The organic silver salt may be of any desired organic compound containing a source capable of reducing silver ion. Preferred are silver salts of organic acids, typically long chain aliphatic carboxylic acids having 10 to 30 carbon atoms, especially 15 to 28 carbon atoms. Also preferred are complexes of organic or inorganic silver salts with ligands having a stability constant in the range of 4.0 to 10.0. A silver-providing substance is preferably used in an amount of about 5 to 70% by weight of an image forming layer. Preferred organic silver salts include silver salts of organic compounds having a carboxyl group. Examples include silver salts of aliphatic carboxylic acids and silver salts of aromatic carboxylic acids though not limited thereto. Preferred examples of the silver salt of aliphatic carboxylic acid include silver behenate, silver arachidate, silver stearate, silver oleate, silver laurate, silver caproate, silver myristate, silver palmitate, silver maleate, silver fumarate, silver tartrate, silver linolate, silver butyrate, silver camphorate and mixtures thereof.

Silver salts of compounds having a mercapto or thion group and derivatives thereof are also useful. Preferred examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(ethylglycolamido)-benzothiazole, silver salts of thioglycolic acids such as silver salts of S-alkylthioglycolic acids wherein the alkyl group has 12 to 22 carbon atoms, silver salts of dithiocarboxylic acids such as a silver salt of dithioacetic acid, silver salts of thioamides, a silver salt of 5-carboxyl-1-methyl-2-phenyl-4-thiopyridine, silver salts of mercaptotriazines, a silver salt of 2-mercaptobenzoxazole as well as silver salts of 1,2,4-mercaptothiazole derivatives such as a silver salt of 3-amino-5-benzylthio-1,2,4-thiazole as described in U.S. Pat. No. 4,123,274 and silver salts of thion compounds such as a silver salt of 3-(3-carboxyethyl)-4-methyl-4-thiazoline-2-thione as described in U.S. Pat. No. 3,301,678. Compounds containing an imino group may also be used. Preferred examples of these compounds include silver salts of benzotriazole and derivatives thereof, for example, silver salts of benzotriazoles such as silver methyl-benzotriazole, silver salts of halogenated benzotriazoles such as silver 5-chlorobenzotriazole as well as silver salts of 1,2,4-triazole and 1-H-tetrazole and silver salts of imidazole and imidazole derivatives as described in U.S. Pat. No. 4,220,709. Also useful are various silver acetylide compounds as described, for example, in U.S. Pat. No. 4,761,361 and 4,775,613.

The organic silver salt which can be used herein may take any desired shape although needle crystals having a minor axis and a major axis are preferred. In the practice of the invention, grains should preferably have a minor axis of 0.01 $\mu$m to 0.20 $\mu$m, more preferably 0.01 $\mu$m to 0.15 $\mu$m and a major axis of 0.10 $\mu$m to 5.0 $\mu$m, more preferably 0.10 $\mu$m to 4.0 $\mu$m. The grain size distribution is desirably monodisperse. The monodisperse distribution means that a standard deviation of the length of minor and major axes divided by the length, respectively, expressed in percent, is preferably up to 100%, more preferably up to 80%, most preferably up to 50%. It can be determined from the measurement of the shape of organic silver salt grains using an image obtained through a transmission electron microscope. Another method for determining a monodisperse distribution is to determine a standard deviation of a volume weighed mean diameter. The standard deviation divided by the volume weighed mean diameter, expressed in percent, which is a coefficient of variation, is preferably up to 100%, more preferably up to 80%, most preferably up to 50%. It may be determined by irradiating laser light, for example, to organic silver salt grains dispersed in liquid and determining the autocorrelation function of the fluctuation of scattering light relative to a time change, and obtaining the grain size (volume weighed mean diameter) therefrom.

The organic silver salt used herein is preferably desalted. The desalting method is not critical. Any well-known method may be used although well-known filtration methods such as centrifugation, suction filtration, ultrafiltration, and flocculation/water washing are preferred.

In the practice of the invention, the organic silver salt is prepared into a solid microparticulate dispersion using a dispersant, in order to provide fine particles of small size and free of flocculation. A solid microparticulate dispersion of the organic silver salt may be prepared by mechanically dispersing the salt in the presence of dispersing aids by well-known comminuting means such as ball mills, vibrating ball mills, planetary ball mills, sand mills, colloidal mills, jet mills, roller mills, and high-pressure homogenizers.

The dispersant used in the preparation of a solid microparticulate dispersion of the organic silver salt may be selected from synthetic anionic polymers such as polyacrylic acid, copolymers of acrylic acid, copolymers of maleic acid, copolymers of maleic acid monoester, and copolymers of acryloylmethylpropanesulfonic acid; semisynthetic anionic polymers such as carboxymethyl starch and carboxymethyl cellulose; anionic polymers such as alginic acid and pectic acid; anionic surfactants as described in JP-A 92716/1977 and WO 88/04794; the compounds described in Japanese Patent Application No. 350753/1995; well-known anionic, nonionic and cationic surfactants; and well-known polymers such as polyvinyl alcohol, polyvinyl pyrrolidone, carboxymethyl cellulose, hydroxypropyl cellulose, and hydroxypropyl methylcellulose, as well as naturally occurring high molecular weight compounds such as gelatin.

In general, the dispersant is mixed with the organic silver salt in powder or wet cake form prior to dispersion. The resulting slurry is fed into a dispersing machine. Alternatively, a mixture of the dispersant with the organic silver salt is subject to heat treatment or solvent treatment to form a dispersant-bearing powder or wet cake of the organic silver salt. It is acceptable to effect pH control with a suitable pH adjusting agent before, during or after dispersion.

Rather than mechanical dispersion, fine particles can be formed by roughly dispersing the organic silver salt in a solvent through pH control and thereafter, changing the pH in the presence of dispersing aids. An organic solvent can be used as the solvent for rough dispersion although the organic solvent is usually removed at the end of formation of fine particles.

The thus prepared dispersion may be stored while continuously stirring for the purpose of preventing fine particles from settling during storage. Alternatively, the dispersion is stored after adding hydrophilic colloid to establish a highly viscous state (for example, in a jelly-like state using gelatin). An antiseptic agent may be added to the dispersion in order to prevent the growth of bacteria during storage.

The organic silver salt is used in any desired amount, preferably about 0.1 to 5 g per square meter of the imaging material, more preferably about 1 to 3 g/m$^2$.

Reducing agent

The imaging material of the invention preferably contains a reducing agent for the organic silver salt. The reducing agent for the organic silver salt may be any of substances, preferably organic substances, that reduce silver ion into metallic silver. Conventional photographic developing agents such as Phenidone®, hydroquinone and catechol are useful although hindered phenols are preferred reducing agents. The reducing agent should preferably be contained in an amount of 5 to 50 mol %, more preferably 10 to 40 mol % per mol of silver on the image forming layer-bearing side. The layer to which the reducing agent is added may be any layer on the image forming layer-bearing side. Where the reducing agent is added to a layer other than the image forming layer, it is preferably used in a slightly larger amount of 10 to 50 mol % per mol of silver. The reducing agent may take the form of a precursor which is modified so as to exert its effective function only at the time of development.

For photothermographic materials using organic silver salts, a wide range of reducing agents are disclosed, for example, in JP-A 6074/1971, 1238/1972, 33621/1972, 46427/1974, 115540/1974, 14334/1975, 36110/1975, 147711/1975, 32632/1976, 1023721/1976, 32324/1976, 51933/1976, 84727/1977, 108654/1980, 146133/1981, 82828/1982, 82829/1982, 3793/1994, U.S. Pat. Nos. 3,667,958, 3,679,424, 3,751,252, 3,751,255, 3,761,270, 3,782,949, 3,839,048, 3,928,686, 5,464,738, German Patent No.

2321328, and EP 692732. Exemplary reducing agents include amidoximes such as phenylamidoxime, 2-thienylamidoxime, and p-phenoxyphenyl-amidoxime; azines such as 4-hydroxy-3,5-dimethoxybenzaldehydeazine; combinations of aliphatic carboxylic acid arylhydrazides with ascorbic acid such as a combination of 2,2-bis(hydroxymethyl)propionyl-β-phenylhydrazine with ascorbic acid; combinations of polyhydroxybenzenes with hydroxylamine, reductone and/or hydrazine, such as combinations of hydroquinone with bis(ethoxyethyl)hydroxyl-amine, piperidinohexosereductone or formyl-4-methylphenyl-hydrazine; hydroxamic acids such as phenylhydroxamic acid, p-hydroxyphenylhydroxamic acid, and β-anilinehydroxamic acid; combinations of azines with sulfonamidophenols such as a combination of phenothiazine with 2,6-dichloro-4-benzene-sulfonamidephenol; α-cyanophenyl acetic acid derivatives such as ethyl-α-cyano-2-methylphenyl acetate and ethyl-α-cyanophenyl acetate; bis-β-naphthols such as 2,2-dihydroxy-1,1-binaphthyl, 6,6-dibromo-2,2-dihydroxy-1,1-binaphthyl, and bis(2-hydroxy-1-naphthyl)methane; combinations of bis-β-naphthols with 1,3-dihydroxybenzene derivatives such as 2,4-dihydroxybenzophenone and 2,4-dihydroxyacetophenone; 5-pyrazolones such as 3-methyl-1-phenyl-5-pyrazolone; reductones such as dimethylaminohexosereductone, anhydrodihydroaminohexosereductone and anhydrodihydropiperidonehexosereductone; sulfonamidephenol reducing agents such as 2,6-dichloro-4-benzenesulfonamidephenol and p-benzene-sulfonamidephenol; 2-phenylindane-1,3-dione, etc.; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl)methane, 2,2-bis(4-hydroxy-3-methylphenyl)propane, 4,4-ethylidene-bis(2-t-butyl-6-methylphenol), 1,1-bis(2-hydroxy-3,5-dimethylphenyl)-3,5,5-trimethylhexane, and 2,2-bis(3,5-dimethyl-4-hydroxyphenyl)-propane; ascorbic acid derivatives such as 1-ascorbyl palmitate and ascorbyl stearate; aldehydes and ketones such as benzil and diacetyl; 3-pyrazolidones and certain indane-1,3-diones; and chromanols (tocopherols). Preferred reducing agents are bisphenols and chromanols.

The reducing agent may be added in any desired form such as solution, powder or solid particle dispersion. The solid particle dispersion of the reducing agent may be prepared by well-known comminuting means such as ball mills, vibrating ball mills, sand mills, colloidal mills, jet mills, and roller mills. Dispersing aids may be used for facilitating dispersion.

Phthalic acid

According to the invention, a phthalic acid compound should be used on the image forming layer-bearing side of the support. The phthalic acid compounds include phthalic acid and its derivatives, more specifically, phthalic acid, 4-methylphthalic acid, 4-nitrophthalic acid, tetrachlorophthalic anhydride, and 2,3-dicarboxynaphthalene, and metal salts thereof, wherein the metals of the metal salts include alkali metals such as Na and K, alkaline earth metals such as Ca and Mg, and transition metals such as Fe and Ni.

The phthalic acid compound may be added in any desired form such as solution, powder or solid particle dispersion. The solid particle dispersion of the phthalic acid compound may be prepared by well-known comminuting means such as ball mills, vibrating ball mills, sand mills, colloidal mills, jet mills, and roller mills. Dispersing aids may be used for facilitating dispersion.

The phthalic acid compound is preferably contained in a layer on the image forming layer-bearing side in an amount of 0.1 to 50 mol %, more preferably 0.5 to 20 mol % per mol of silver. Less amounts of the phthalic acid compound would render image formation difficult whereas too much amounts of the phthalic acid compound would tend to render the color reddish. It is noted that phthalic acid is sometimes used for adjusting pH on the film surface as will be described later and the phthalic acid used for this purpose should be excluded from the above-defined amount of the phthalic acid compound.

The phthalic acid compound may be added at any desired stage although it is preferably added to a coating solution immediately before application. The phthalic acid compound may be added to any desired layer including a subbing layer, image forming layer, intermediate layer, protective layer and overcoat layer.

Toner

A higher optical density is sometimes achieved when an additive known as a "toner" for improving images is contained. The toner is also sometimes advantageous in forming black silver images. The toner is preferably used in an amount of 0.1 to 50 mol %, especially 0.5 to 20 mol % per mol of silver on the image forming layer-bearing side. The toner may take the form of a precursor which is modified so as to exert its effective function only at the time of development.

For imaging materials using organic silver salts, a wide range of toners are disclosed, for example, in JP-A 6077/1971, 10282/1972, 5019/1974, 5020/1974, 91215/1974, 2524/1975, 32927/1975, 67132/1975, 67641/1975, 114217/1975, 3223/1976, 27923/1976, 14788/1977, 99813/1977, 1020/1978, 76020/1978, 156524/1979, 156525/1979, 183642/1986, and 56848/1992, JP-B 10727/1974 and 20333/1979, U.S. Pat. Nos. 3,080,254, 3,446,648, 3,782,941, 4,123,282, 4,510,236, BP 1,380,795, and Belgian Patent No. 841,910. Examples of the toner include phthalimide and N-hydroxyphthalimide; cyclic imides such as succinimide, pyrazolin-5-one, quinazolinone, 3-phenyl-2-pyrazolin-5-one, 1-phenylurazol, quinazoline and 2,4-thiazolizinedione; naphthalimides such as N-hydroxy-1,8-naphthalimide; cobalt complexes such as cobaltic hexamine trifluoroacetate; mercaptans as exemplified by 3-mercapto-1,2,4-triazole, 2,4-dimercaptopyrimidine, 3-mercapto-4,5-diphenyl-1,2,4-triazole, and 2,5-dimercapto-1,3,4-thiadiazole; N-(aminomethyl)aryldicarboxyimides such as (N,N-dimethylaminomethyl)phthalimide and N,N-(dimethylaminomethyl)-naphthalene-2,3-dicarboxyimide; blocked pyrazoles, isothiuronium derivatives and certain photo-bleach agents such as N,N'-hexamethylenebis(1-carbamoyl-3,5-dimethyl-pyrazole), 1,8-(3,6-diazaoctane)bis(isothiuroniumtrifluoroacetate) and 2-tribromomethylsulfonyl-benzothiazole; 3-ethyl-5-{(3-ethyl-2-benzothiazolinylidene)-1-methyl-ethylidene}-2-thio-2,4-oxazolidinedione; phthalazinone, phthalazinone derivatives or metal salts, or derivatives such as 4-(1-naphthyl)phthalazinone, 6-chlorophthalazinone, 5,7-dimethoxyphthalazinone and 2,3-dihydro-1,4-phthalazinedione; phthalazine, phthalazine derivatives or metal salts, or derivatives such as 4-(1-naphthyl)phthlazine, 6-chlorophthalazine, 5,7-dimethoxyphthalazine and 2,3-dihydrophthlazine; quinazolinedione, benzoxazine or naphthoxazine derivatives; rhodium complexes which function not only as a tone regulating agent, but also as a source of halide ion for generating silver halide in situ, for example, ammonium hexachlororhodinate (III), rhodium bromide, rhodium nitrate and potassium hexachlororhodinate (III);

inorganic peroxides and persulfates such as ammonium peroxide disulfide and hydrogen peroxide; benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidine and asymtriazines such as 2,4-dihydroxypyrimidine and 2-hydroxy-4-aminopyrimidine; azauracil and tetraazapentalene derivatives such as 3,6-dimercapto-1,4-diphenyl-1H,4H-2,3a,5,6a-tetraazapentalene, and 1,4-di(o-chlorophenyl)-3,6-dimercapto-1H,4H-2,3a,5,6a-tetraazapentalene.

The toner may be added in any desired form, for example, as a solution, powder and solid particle dispersion. The solid particle dispersion of the toner is prepared by well-known finely dividing means such as ball mills, vibrating ball mills, sand mills, colloid mills, jet mills, and roller mills. Dispersing aids may be used in preparing the solid particle dispersion.

Polymer latex

At least one of image forming layers according to the invention should preferably be an image forming layer using at least 50% by weight based on the entire binder of a polymer latex. Hereinafter, this image forming layer is often designated "inventive image forming layer," and the polymer latex used as the binder is often designated "inventive polymer latex." The "polymer latex" is a dispersion of a microparticulate water-insoluble hydrophobic polymer in a water-soluble dispersing medium. With respect to the dispersed state, a polymer emulsified in a dispersing medium, an emulsion polymerized polymer, a micelle dispersion, and a polymer having a hydrophilic structure in a part of its molecule so that the molecular chain itself is dispersed on a molecular basis are included. With respect to the polymer latex, reference is made to Okuda and Inagaki Ed., "Synthetic Resin Emulsion," Kobunshi Kankokai, 1978; Sugimura, Kataoka, Suzuki and Kasahara Ed., "Application of Synthetic Latex," Kobunshi Kankokai, 1993; and Muroi, "Chemistry of Synthetic Latex," Kobunshi Kankokai, 1970. Dispersed particles should preferably have a mean particle size of about 1 to 50,000 nm, more preferably about 5 to 1,000 nm. No particular limit is imposed on the particle size distribution of dispersed particles, and the dispersion may have either a wide particle size distribution or a monodisperse particle size distribution.

The polymer latex should preferably have a minimum film-forming temperature (MFT) of about −30° C. to 90° C., more preferably about 0° C. to 70° C. A film-forming aid may be added in order to control the minimum film-forming temperature. The film-forming aid is also referred to as a plasticizer and includes organic compounds (typically organic solvents) for lowering the minimum film-forming temperature of the polymer latex. It is described in Muroi, "Chemistry of Synthetic Latex," Kobunshi Kankokai, 1970.

Polymers used in the polymer latex according to the invention include acrylic resins, vinyl acetate resins, polyester resins, polyurethane resins, rubbery resins, vinyl chloride resins, vinylidene chloride resins, polyolefin resins, and copolymers thereof. The polymer may be linear or branched or crosslinked. The polymer may be either a homopolymer or a copolymer having two or more monomers polymerized together. The copolymer may be either a random copolymer or a block copolymer. The polymer preferably has a number average molecule weight Mn of about 5,000 to about 1,000,000, more preferably about 10,000 to about 100,000. Polymers with a too lower molecular weight would generally provide a low film strength after coating whereas polymers with a too higher molecular weight are difficult to form films.

The polymer of the polymer latex used herein should preferably have an equilibrium moisture content at 25° C. and RH 60% of 0.01 to 2% by weight, more preferably 0.03 to 1% by weight. With respect to the definition and measurement of equilibrium moisture content, reference should be made to "Polymer Engineering Series No. 14, Polymer Material Test Methods," Edited by Japanese Polymer Society, Chijin Shokan Publishing K.K., for example.

Illustrative examples of the polymer latex which can be used as the binder in the image forming layer of the imaging material of the invention include latices of methyl methacrylate/ethyl acrylate/methacrylic acid copolymers, latices of methyl methacrylate/2-ethylhexyl acrylate/styrene/acrylic acid copolymers, latices of styrene/butadiene/acrylic acid copolymers, latices of styrene/butadiene/divinyl benzene/methacrylic acid copolymers, latices of methyl methacrylate/vinyl chloride/acrylic acid copolymers, and latices of vinylidene chloride/ethyl acrylate/acrylonitrile/methacrylic acid copolymers. These polymers or polymer latices are commercially available. Exemplary acrylic resins are Sebian A-4635, 46583 and 4601 (Daicell Chemical Industry K.K.) and Nipol LX811, 814, 820, 821 and 857 (Nippon Zeon K.K.). Exemplary polyester resins are FINETEX ES650, 611, 675, and 850 (Dai-Nippon Ink & Chemicals K.K.) and WD-size and WMS (Eastman Chemical Products, Inc.). Exemplary polyurethane resins are HYDRAN AP10, 20, 30 and 40 (Dai-Nippon Ink & Chemicals K.K.). Exemplary rubbery resins are LACSTAR 7310K, 3307B, 4700H and 7132C (Dai-Nippon Ink & Chemical K.K.) and Nipol LX416, 410, 438C and 2507 (Nippon Zeon K.K.). Exemplary vinyl chloride resins are G351 and G576 (Nippon Zeon K.K.). Exemplary vinylidene chloride resins are L502 and L513 (Asahi Chemicals K.K.). Exemplary olefin resins are Chemipearl S120 and SA100 (Mitsui Petro-Chemical K.K.). These polymers may be used alone or in admixture of two or more.

The polymer latex used herein may be either a latex of the conventional uniform structure or a latex of the so-called core/shell type.

The core/shell (C/S) type polymer latex is obtained by changing the monomer compositions of the core and the shell so as to produce a core/shell structure. In this case, either one of the core and the shell is formed of a copolymer containing styrene and butadiene as comonomers (sometimes referred to as SBR resin, hereinafter), examples of which are described below.

Better results are obtained when polymers having different glass transition temperatures (Tg) are used as the core and the shell. When both the core and the shell are formed of SBR resins, Tg can be altered by changing the ratio of styrene to butadiene. More specifically, the relationship of Tg to styrene and butadiene contents is shown below.

| Tg (° C.) | Styrene (wt %) | Butadiene (wt %) | Acrylic acid (wt %) |
|---|---|---|---|
| 15 | 67.0 | 30.0 | 3.0 |
| 25 | 71.4 | 25.6 | 3.0 |
| 35 | 75.5 | 21.5 | 3.0 |
| 45 | 79.4 | 17.6 | 3.0 |
| 55 | 83.0 | 14.0 | 3.0 |

When Tg differs between the core and the shell, the core and the shell preferably have different Tg in the range of −30° C. to 100° C. Latices wherein the core has Tg of 25° C. to 100° C., more preferably 30° C. to 90° C., and the shell has Tg of −30° C. to 60° C., more preferably 0° C. to 30° C. are preferred as well as latices wherein the core has Tg of −30° C. to 60° C., more preferably 0° C. to 30° C., and the shell has Tg of 25° C. to 100° C., more preferably 30° C. to 90° C.

In the C/S polymer latex, the core and the shell preferably has a minimum film-forming temperature (MFT) of about −30° C. to 90° C. Latices wherein the core has MFT of 25° C. to 90° C., more preferably 30° C. to 80° C. and the shell has MFT of −30° C. to 50° C., more preferably 0° C. to 20° C. are preferred as well as latices wherein the core has MFT of −30° C. to 50° C., more preferably 0° C. to 20° C. and the shell has MFT of 25° C. to 90° C., more preferably 30° C. to 80° C.

In the C/S polymer latex, the thickness of the shell is preferably about 2 to 70%, more preferably about 5 to 30% of the radius of polymer particles.

The polymer species used in the core and the shell of the C/S polymer latex are as described above, with the SBR resins being especially preferred. The term "SBR resins" are polymers containing styrene and butadiene as comonomers. Preferably styrene and butadiene combined account for 50 to 99% by weight, especially 60 to 95% by weight of the polymer. Other components include acid monomers such as acrylic acid, methacrylic acid and itaconic acid, and acrylic monomers such as methyl methacrylate and ethyl acrylate as well as acrylonitrile, vinyl chloride and vinylidene chloride.

The polymer may be linear or branched or crosslinked. The polymer may be either a homopolymer or a copolymer having two or more monomers polymerized together. The copolymer may be either a random copolymer or a block copolymer. The polymer preferably has a number average molecule weight Mn of about 5,000 to about 1,000,000, more preferably about 10,000 to about 100,000. Polymers with a too lower molecular weight would generally provide the latex layer with a low dynamic strength whereas polymers with a too higher molecular weight are difficult to form films.

Illustrative examples of the C/S polymer latex are given below. Numerical values represent weight fractions.

Latex 1: Core/shell (1/1) latex having a core (styrene/butadiene/acrylic acid=70/28/2) and a shell (styrene/butadiene/acrylic acid=50/45/5)

Latex 2: Core/shell (2/1) latex having a core (styrene/butadiene/methyl methacrylate/acrylic acid=60/29/10/1) and a shell (styrene/butadiene/acrylic acid=45/50/5)

Latex 3: Core/shell (1/1) latex having a core (styrene/butadiene/acrylic acid=49/50/1) and a shell (styrene/butadiene/acrylic acid=75/50/5)

Latex 4: Core/shell (2/1) latex having a core (styrene/butadiene/ethyl acrylate/acrylic acid=35/35/29/1) and a shell (styrene/butadiene/methyl methacrylate/acrylic acid=50/20/25/5)

Latex 5: Core/shell (1/1) latex having a core (methyl methacrylate/vinyl chloride/acrylic acid=70/28/2) and a shell (ethyl acrylate/2-ethylhexyl acrylate/acrylic acid=70/25/5)

Latex 6: Core/shell (1/1) latex having a core (vinylidene chloride/ethyl acrylate/acrylic acid=70/28/2) and a shell (styrene/butadiene/acrylic acid=50/45/5)

Latex 7: Core/shell (2/1) latex having a core (styrene/butadiene/acrylic acid=70/28/2) and a shell (ethyl acrylate/2-ethylhexyl acrylate/acrylic acid=70/25/5)

Latex 8: Core/shell (1/1) latex having a core (styrene/butadiene/acrylic acid=79/18/3) and a shell (styrene/butadiene/acrylic acid=67/30/3)

/S polymer latices can be synthesized by conventional synthesis processes as described, for example, in T. Ohtsu and M. Kinoshita, "Experiments of Polymer Synthesis," Kagaku Dojin K.K., 1972.

SYNTHESIS EXAMPLE 1

Synthesis of SBR latex of a core/shell structure whose core has Tg of 45° C. and shell has Tg of 15° C.

A glass autoclave TEM-V1000 (Pressure Glass Industry K.K.) was charged with 79.4 grams of styrene, 280 grams of distilled water, 4.44 grams of a surfactant Sundett BL (Sanyo Chemicals K.K.), and 3.0 grams of acrylic acid whereupon the contents were stirred for one hour in a nitrogen stream. The reactor was then closed, 17.6 grams of butadiene was added, and the reactor was heated to 60° C. To the reactor, 20 grams of a 5% aqueous solution of potassium persulfate was added, and stirring was continued for 10 hours.

Thereafter, 67 grams of styrene, 30 grams of butadiene and 3 grams of acrylic acid were added to the reactor where stirring was continued for a further 10 hours, effecting reaction. The reactor was then cooled to room temperature, yielding a SBR latex.

Tg is calculated according to the following equation.

$$1/Tg=\Sigma(Xi/Tgi)$$

The polymer is a copolymer of n types of monomers wherein i is from 1 to n, Xi is a weight fraction of i-th monomer ($\Sigma Xi=1$), and Tgi is the Tg (K) of i-th monomer as expressed by the absolute temperature. $\Sigma$ is the sum of from i=1 to n. It is noted that Tg is the value described in J. Brandrup & E. H. Immergut, Polymer Handbook (3rd Edition), Wiley-Interscience, 1989.

In the image forming layer according to the invention, the polymer latex is used in an amount of at least 50% by weight of the entire binder. Preferably, the polymer latex is used in an amount of at least 70% by weight of the entire binder. In the image forming layer, a hydrophilic polymer is added in an amount of less than 50% by weight of the entire binder if necessary. Such hydrophilic polymers are gelatin, polyvinyl alcohol, methyl cellulose, hydroxypropyl cellulose, carboxymethyl cellulose, and hydroxypropyl methylcellulose. The amount of the hydrophilic polymer added is preferably less than 30% by weight of the entire binder in the image forming layer.

The image forming layer according to the invention is preferably formed by applying an aqueous coating solution followed by drying. By the term "aqueous", it is meant that water accounts for at least 30% by weight of the solvent or dispersing medium of the coating solution. The component other than water of the coating solution may be a water-miscible organic solvent such as methyl alcohol, ethyl alcohol, isopropyl alcohol, methyl cellosolve, ethyl cellosolve, dimethylformamide, and ethyl acetate. Exemplary solvent compositions include 90/10 and 70/30 mixtures of water/methanol, a 90/10 mixture of water/ethanol, a 90/10 mixture of water/isopropanol, a 95/5 mixture of water/dimethylformamide, 80/15/5 and 90/5/5 mixtures of water/methanol/dimethylformamide, all expressed in a weight ratio.

In the image forming layer according to the invention, the total amount of binder is preferably 0.2 to 30 g/m$^2$, more preferably 1 to 15 g/m$^2$. Crosslinking agents for crosslinking, surfactants for ease of application, and other addenda are optionally added to the image forming layer.

Protective layer

A surface protective layer may be provided in the imaging material according to the present invention for the purpose of preventing sticking of an image forming layer.

The surface protective layer (or uppermost layer) is based on a binder which may be any desired polymer, although the layer preferably contains 100 mg/m$^2$ to 5 g/m$^2$ of a polymer having a carboxylic acid residue. The polymers having a carboxylic acid residue include natural polymers (e.g., gelatin and alginic acid), modified natural polymers (e.g., carboxymethyl cellulose and phthalated gelatin), and synthetic polymers (e.g., polymethacrylate, polyacrylate, polyalkyl methacrylate/acrylate copolymers, and polystyrene/polymethacrylate copolymers). The content of the carboxylic acid residue is preferably 10 mmol to 1.4 mol per 100 grams of the polymer. The carboxylic acid residue may form a salt with an alkali metal ion, alkaline earth metal ion or organic cation. The use of such a polymer is effective for preventing the polyvalent ion from forming a hydroxide or oxide and enabling the polyvalent ion to exerts its desired effect.

In the surface protective layer, any desired anti-sticking material may be used. Examples of the anti-sticking material include wax, silica particles, styrene-containing elastomeric block copolymers (e.g., styrene-butadiene-styrene and styrene-isoprene-styrene), cellulose acetate, cellulose acetate butyrate, cellulose propionate and mixtures thereof. Crosslinking agents for crosslinking, surfactants for ease of application, and other addenda are optionally added to the surface protective layer.

In the image forming layer or a protective layer therefor according to the invention, there may be used light absorbing substances and filter dyes as described in U.S. Pat. Nos. 3,253,921, 2,274,782, 2,527,583, and 2,956,879. The dyes may be mordanted as described in U.S. Pat. No. 3,282,699. The filer dyes are used in such amounts that the layer may have an absorbance of 0.1 to 3, especially 0.2 to 1.5 at the exposure wavelength.

In the image forming layer or a protective layer therefor according to the invention, there may be used matte agents, for example, starch, titanium dioxide, zinc oxide, and silica as well as polymer beads including beads of the type described in U.S. Pat. Nos. 2,992,101 and 2,701,245. The image forming or protective layer surface may have any degree of matte insofar as no star dust failures occur although a Bekk smoothness of 200 to 10,000 seconds, especially 300 to 10,000 seconds is preferred.

Polyvalent metal ion

The imaging material of the invention contains a polyvalent metal ion on the image forming layer-bearing side of the support. The content of the polyvalent metal ion is preferably 10 μmol to 1 mol, more preferably 20 μmol to 100 mmol, and most preferably 50 μmol to 100 mmol per square meter of the imaging material. Less contents of the polyvalent metal ion would be ineffective whereas too much contents would increase haze.

The polyvalent metal ion is preferably a metal cation other than alkaline earth metal ions. Specifically, the polyvalent metal is selected from transition metals of Groups 3 to 12 (3A to 7A, 8, 1B, 2B) and elements of Group 13 (3B) in the Periodic Table, for example, aluminum(III), chromium(III), palladium(II), zirconium(II), zinc(II), and manganese(II), with aluminum(III) and chromium(III) being preferred. The polyvalent metal ion may be added by any desired method, preferably by adding an aqueous solution of a salt of a mineral acid or organic acid to the coating solution. Such salts include sulfates such as aluminum sulfate and potassium chromium sulfate, acetates such as chromium acetate, and nitrates such as palladium nitrate.

The layer to which the polyvalent metal ion is added may be any of layers on the image forming layer-bearing side of the support, including a subbing layer, image forming layer, intermediate layer, protective layer, and overcoat layer. It is also possible to add the polyvalent metal ion after preparation of the imaging material and prior to image formation, by applying an aqueous solution of the polyvalent metal ion to the element or by dipping the element in an aqueous solution of the polyvalent metal ion.

Silver halide

The photothermographic imaging material according to the preferred embodiment of the imaging material of the invention preferably contains a photosensitive silver halide. A method for forming the photosensitive silver halide is well known in the art. Any of the methods disclosed in Research Disclosure No. 17029 (June 1978) and U.S. Pat. No. 3,700,458, for example, may be used. Illustrative methods which can be used herein are a method of preforming an organic silver salt and adding a halogen-containing compound to the organic silver salt to convert a part of silver of the organic silver salt into photosensitive silver halide and a method of adding a silver-providing compound and a halogen-providing compound to a solution of gelatin or another polymer to form photosensitive silver halide grains and mixing the grains with an organic silver salt. The latter method is preferred in the practice of the invention.

The photosensitive silver halide should preferably have a smaller grain size for the purpose of minimizing white turbidity after image formation. Specifically, the grain size is preferably up to 0.20 μm, more preferably 0.01 μm to 0.15 μm, most preferably 0.02 μm to 0.12 μm. The term grain size designates the length of an edge of a silver halide grain where silver halide grains are regular grains of cubic or octahedral shape. Where silver halide grains are tabular, the grain size is the diameter of an equivalent circle having the same area as the projected area of a major surface of a tabular grain. Where silver halide grains are not regular, for example, in the case of spherical or rod-shaped grains, the grain size is the diameter of an equivalent sphere having the same volume as a grain.

The shape of silver halide grains may be cubic, octahedral, tabular, spherical, rod-like and potato-like, with cubic and tabular grains being preferred in the practice of the invention. Where tabular silver halide grains are used, they should preferably have an average aspect ratio of from 100:1 to 2:1, more preferably from 50:1 to 3:1. Silver halide grains having rounded corners are also preferably used. No particular limit is imposed on the face indices (Miller indices) of an outer surface of silver halide grains. Preferably silver halide grains have a high proportion of {100} face featuring high spectral sensitization efficiency upon adsorption of a spectral sensitizing dye. The proportion of {100} face is preferably at least 50%, more preferably at least 65%, most preferably at least 80%. Note that the proportion of Miller index {100} face can be determined by the method described in T. Tani, J. Imaging Sci., 29, 165 (1985), utilizing the adsorption dependency of {111} face and {100} face upon adsorption of a sensitizing dye.

The halogen composition of photosensitive silver halide is not critical and may be any of silver chloride, silver chlorobromide, silver bromide, silver iodobromide, silver iodochlorobromide, and silver iodide. Silver bromide or silver iodobromide is preferred in the practice of the invention. Most preferred is silver iodobromide preferably having a silver iodide content of 0.1 to 40 mol %, especially 0.1 to 20 mol %. The halogen composition in grains may have a uniform distribution or a non-uniform distribution wherein the halogen concentration changes in a stepped or continuous manner. Preferred are silver iodobromide grains having a higher silver iodide content in the interior. Silver halide grains of the core/shell structure are also useful. Such core/shell grains preferably have a multilayer structure of 2 to 5 layers, more preferably 2 to 4 layers.

Preferably the photosensitive silver halide grains used herein contain at least one complex of a metal selected from the group consisting of rhodium, rhenium, ruthenium, osmium iridium, cobalt, mercury and iron. The metal complexes may be used alone or in admixture of two or more complexes of a common metal or different metals. The metal complex is preferably contained in an amount of $1\times10^{-9}$ to $1\times10^{-3}$ mol, more preferably $1\times10^{-8}$ to $1\times10^{-4}$ mol per mol of silver. Illustrative metal complex structures are those described in JP-A 225449/1995. The cobalt and iron compounds are preferably hexacyano metal complexes while illustrative, non-limiting examples include a ferricyanate ion, ferrocyanate ion, and hexacyanocobaltate ion. The distribution of the metal complex in silver halide grains is not critical. That is, the metal complex may be contained in silver halide grains to form a uniform phase or at a high concentration in either the core or the shell.

Photosensitive silver halide grains may be desalted by any of well-known water washing methods such as noodle and flocculation methods although silver halide grains may be either desalted or not according to the invention.

The photosensitive silver halide grains used herein should preferably be chemically sensitized. Preferred chemical sensitization methods are sulfur, selenium, and tellurium sensitization methods which are well known in the art. Also useful are a noble metal sensitization method using compounds of gold, platinum, palladium, and iridium and a reduction sensitization method. In the sulfur, selenium, and tellurium sensitization methods, any of compounds well known for the purpose may be used. For example, the compounds described in JP-A 128768/1995 are useful. Exemplary tellurium sensitizing agents include diacyltellurides, bis(oxycarbonyl)tellurides, bis(carbamoyl) tellurides, bis(oxycarbonyl)ditellurides, bis(carbamoyl) ditellurides, compounds having a P═Te bond, tellurocarboxylic salts, Te-organyltellurocarboxylic esters, di(poly) tellurides, tellurides, telluroles, telluroacetals, tellurosulfonates, compounds having a P—Te bond, Te-containing heterocycles, tellurocarbonyl compounds, inorganic tellurium compounds, and colloidal tellurium. The preferred compounds used in the noble metal sensitization method include chloroauric acid, potassium chloroaurate, potassium aurithiocyanate, gold sulfide, and gold selenide as well as the compounds described in U.S. Pat. No. 2,448,060 and BP 618,061. Illustrative examples of the compound used in the reduction sensitization method include ascorbic acid, thiourea dioxide, stannous chloride, aminoiminomethanesulfinic acid, hydrazine derivatives, borane compounds, silane compounds, and polyamine compounds. Reduction sensitization may also be accomplished by ripening the emulsion while maintaining it at pH 7 or higher or at pAg 8.3 or lower. Reduction sensitization may also be accomplished by introducing a single addition portion of silver ion during grain formation.

According to the invention, the photosensitive silver halide is preferably used in an amount of 0.01 to 0.5 mol, more preferably 0.02 to 0.3 mol, most preferably 0.03 to 0.25 mol per mol of the organic silver salt. With respect to a method and conditions of admixing the separately prepared photosensitive silver halide and organic silver salt, there may be used a method of admixing the separately prepared photosensitive silver halide and organic silver salt in a high speed agitator, ball mill, sand mill, colloidal mill, vibrating mill or homogenizer or a method of preparing an organic silver salt by adding the already prepared photosensitive silver halide at any timing during preparation of an organic silver salt. Any desired mixing method may be used insofar as the benefits of the invention are fully achievable.

One of the preferred methods for preparing the silver halide according to the invention is a so-called halidation method of partially halogenating the silver of an organic silver salt with an organic or inorganic halide. Any of organic halides which can react with organic silver salts to form silver halides may be used. Exemplary organic halides are N-halogenoimides (e.g., N-bromosuccinimide), halogenated quaternary nitrogen compounds (e.g., tetrabutylammonium bromide), and aggregates of a halogenated quaternary nitrogen salt and a molecular halogen (e.g., pyridinium bromide perbromide). Any of inorganic halides which can react with organic silver salts to form silver halides may be used. Exemplary inorganic halides are alkali metal and ammonium halides (e.g., sodium chloride, lithium bromide, potassium iodide, and ammonium bromide), alkaline earth metal halides (e.g., calcium bromide and magnesium chloride), transition metal halides (e.g., ferric chloride and cupric bromide), metal complexes having a halogen ligand (e.g., sodium iridate bromide and ammonium rhodate chloride), and molecular halogens (e.g., bromine, chlorine and iodine). A mixture of organic and inorganic halides may also be used.

The amount of the halide added for the halidation purpose is preferably 1 mmol to 500 mmol, especially 10 mmol to 250 mmol of halogen atom per mol of the organic silver salt.

Sensitizing dye

A sensitizing dye may be used in the practice of the invention. There may be used any of sensitizing dyes which can spectrally sensitize silver halide grains in a desired wavelength region when adsorbed to the silver halide grains. The sensitizing dyes used herein include cyanine dyes, merocyanine dyes, complex cyanine dyes, complex merocyanine dyes, holopolar cyanine dyes, styryl dyes, hemicyanine dyes, oxonol dyes, and hemioxonol dyes. Useful sensitizing dyes which can be used herein are described in Research Disclosure, Item 17643 IV-A (December 1978, page 23), ibid., Item 1831 X (August 1979, page 437) and the references cited therein. It is advantageous to select a sensitizing dye having appropriate spectral sensitivity to the spectral properties of a particular light source of various laser imagers, scanners, image setters and printing plate-forming cameras.

Exemplary dyes for spectral sensitization to red light include compounds I-1 to I-38 described in JP-A 18726/1979, compounds I-1 to I-35 described in JP-A 75322/1994, compounds I-1 to I-34 described in JP-A 287338/1995, dyes 1 to 20 described in JP-B 39818/1980, compounds I-1 to I-37 described in JP-A 284343/1987, and compounds I-1 to I-34 described in JP-A 287338/1995 for red light sources such as He—Ne lasers, red semiconductor lasers and LED.

For semiconductor laser light sources in the wavelength range of 750 to 1,400 nm, spectral sensitization may be advantageously done with various known dyes including cyanine, merocyanine, styryl, hemicyanine, oxonol, hemioxonol, and xanthene dyes. Useful cyanine dyes are cyanine dyes having a basic nucleus such as a thiazoline, oxazoline, pyrroline, pyridine, oxazole, thiazole, selenazole and imidazole nucleus. Preferred examples of the useful merocyanine dye contain an acidic nucleus such as a thiohydantoin, rhodanine, oxazolidinedione, thiazolinedione, barbituric acid, thiazolinone, malononitrile, and pyrazolone nucleus in addition to the above-mentioned basic nucleus. Among the above-mentioned cyanine and merocyanine dyes, those having an imino or carboxyl group are especially effective. A suitable choice may be made of well-known dyes as described, for example, in U.S. Pat. Nos. 3,761,279, 3,719,495, and 3,877,943, BP 1,466,201, 1,469,117, and 1,422,057, JP-B 10391/1991 and 52387/1994, JP-A 341432/1993, 194781/1994, and 301141/1994.

Especially preferred dye structures are cyanine dyes having a thioether borid-containing substituent group, examples of which are the cyanine dyes described in JP-A 58239/1987, 138638/1991, 138642/1991, 255840/1992, 72659/1993, 72661/1993, 222491/1994, 230506/1990, 258757/1994, 317868/1994, and 324425/1994, Publication of International Patent Application No. 500926/1995, and U.S. Pat. No. 5,541,054; dyes having a carboxylic group, examples of which are the dyes described in JP-A 163440/1991, 301141/1994 and U.S. Pat. No. 5,441,899; and merocyanine dyes, polynuclear merocyanine dyes, and polynuclear cyanine dyes, examples of which are the dyes described in JP-A 6329/1972, 105524/1974, 127719/1976, 80829/1977, 61517/1979, 214846/1984, 6750/1985, 159841/1988, 35109/1994, 59381/1994, 146537/1995, Publication of International Patent Application No. 50111/1993, BP 1,467,638, and U.S. Pat. No. 5,281,515.

Also useful in the practice of the invention are dyes capable of forming the J-band as disclosed in U.S. Pat. Nos. 5,510,236, 3,871,887 (Example 5), JP-A 96131/1990 and 48753/1984.

Preferred sensitizing dyes used herein are those of the following general formula (1).

(1)

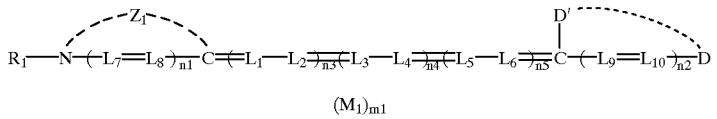

In formula (1), $Z_1$ is a group of atoms necessary to form a 5- or 6-membered nitrogenous heterocyclic ring. Each of D and D' is a group of atoms necessary to form a non-cyclic or cyclic acidic nucleus. $R_1$ is an alkyl group. Each of $L_1$, $L_2$, $L_3$, $L_4$, $L_5$, $L_6$, $L_7$, $L_8$, $L_9$ and $L_{10}$ is a methine group, which may form a ring with another methine group or a ring with an auxochrome. $M_1$ is an electric charge neutralizing counter ion. Letter m1 is a number inclusive of 0 necessary to neutralize an electric charge within the molecule.

Typical examples of the methine dye represented by formula (1) are given below although the dye is not limited thereto. Note that $R_3$ appearing in D-12 is hydrogen or a substituent (e.g., methyl) as exemplified for L.

D-1

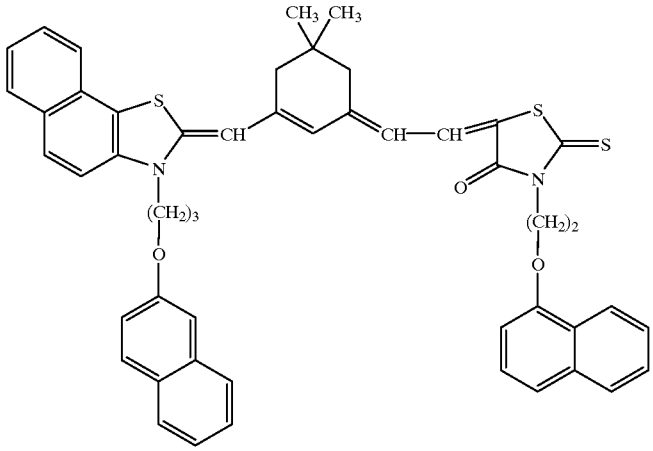

D-2

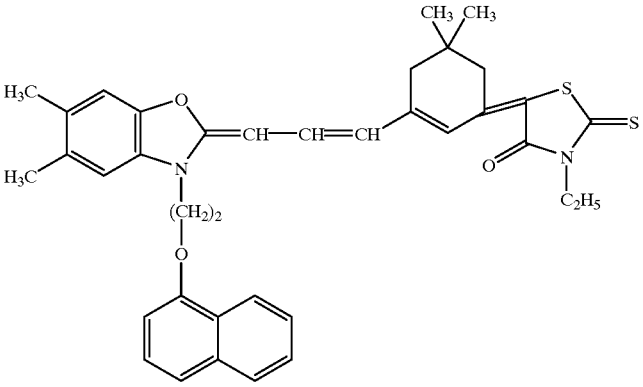

D-3

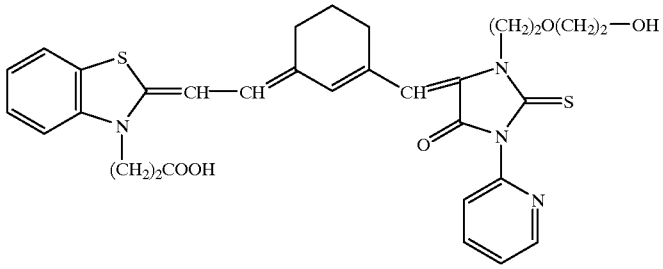

-continued
D-4
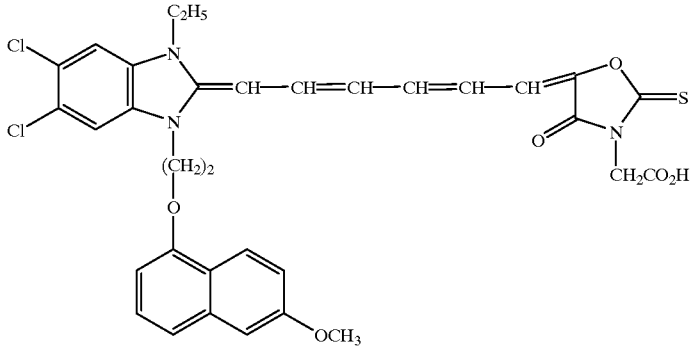
D-5
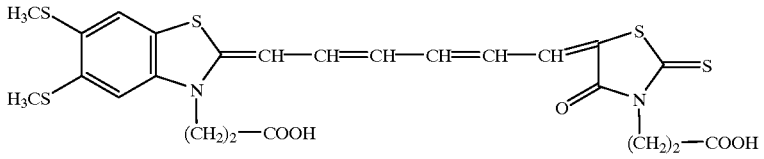
D-6
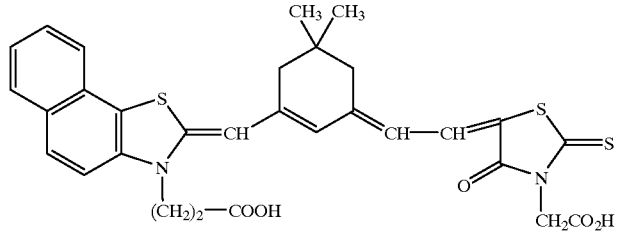
D-7
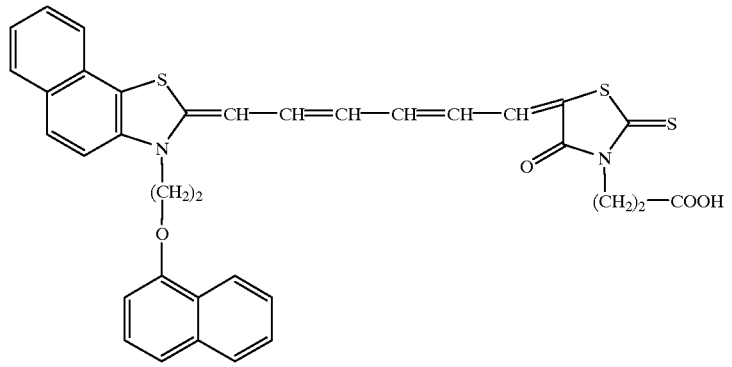
D-8
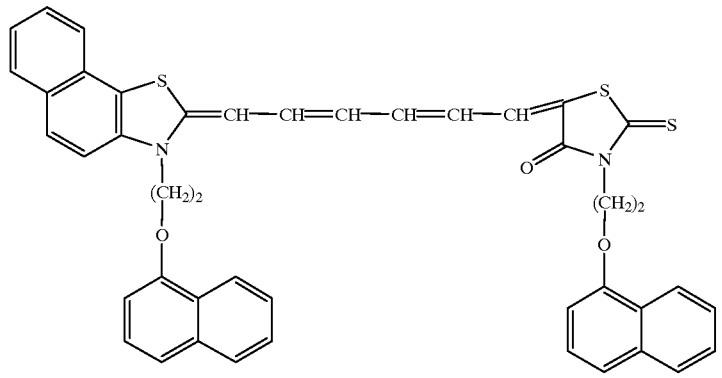

-continued
D-9
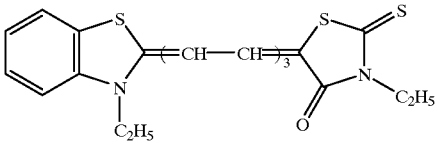
D-10
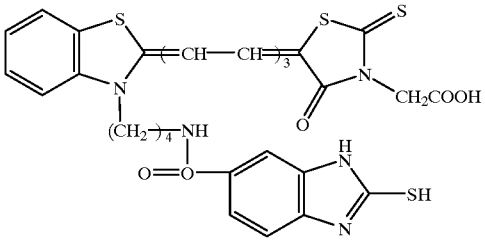
D-11
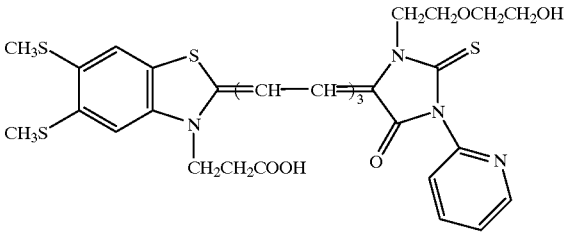
D-12
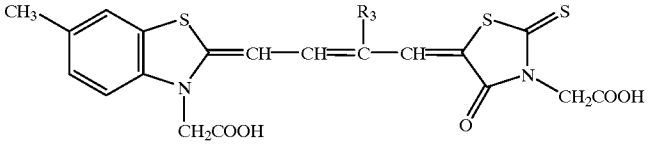
D-13
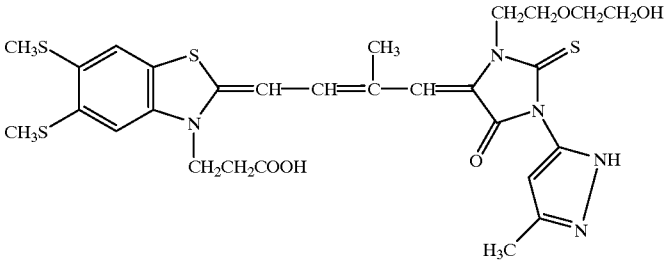
D-14
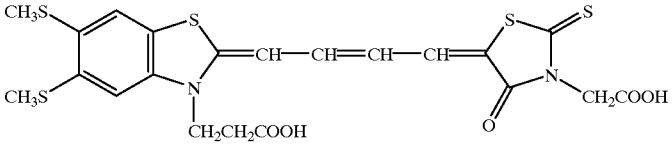
D-15
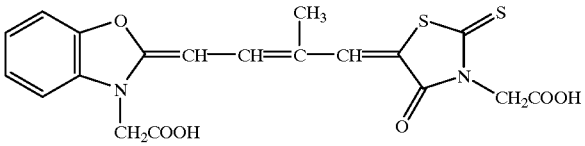
D-16
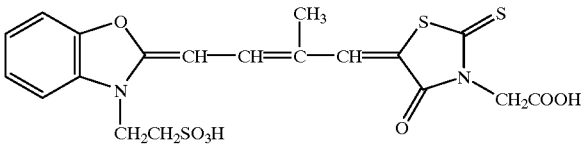

-continued
D-17
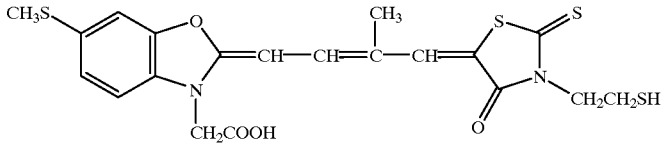
D-18
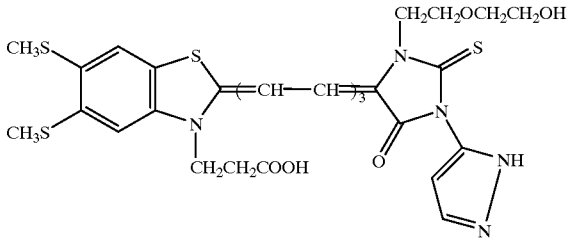
D-19
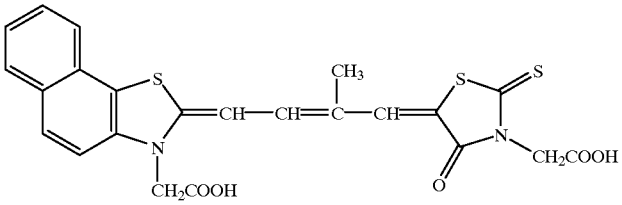
D-20
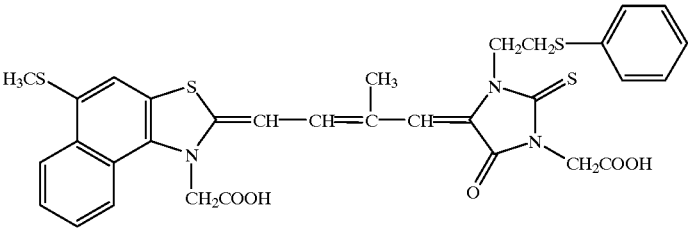
D-21
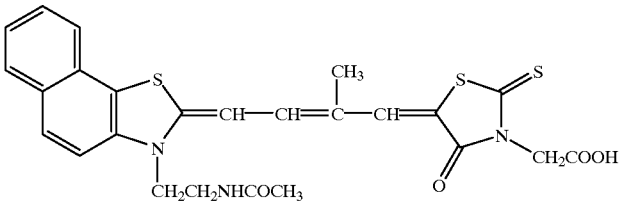
D-22
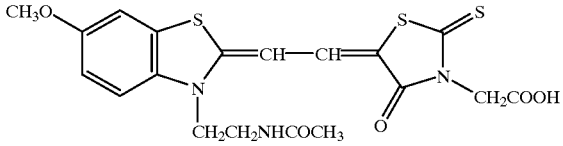
D-23
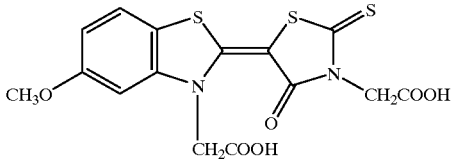

-continued

D-24

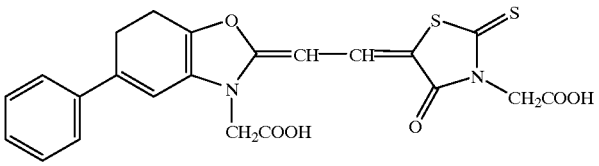

D-25

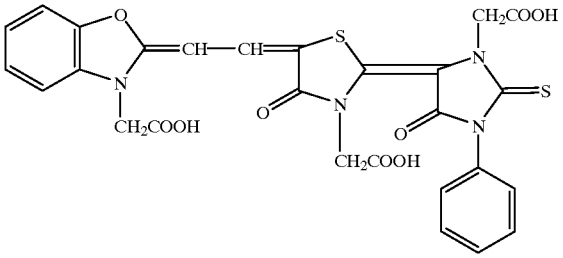

D-26

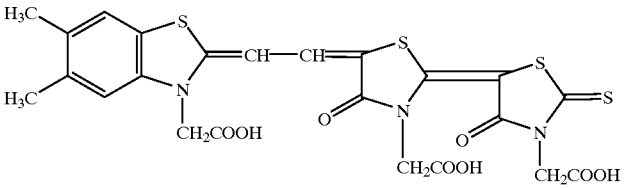

D-27

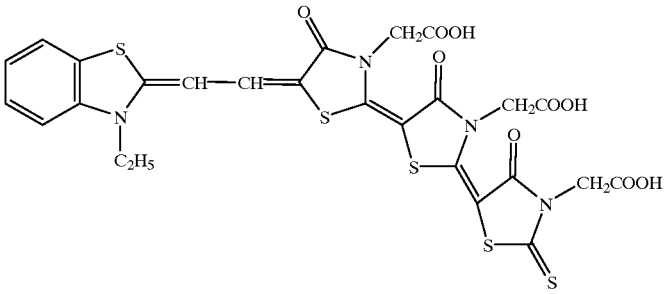

D-28

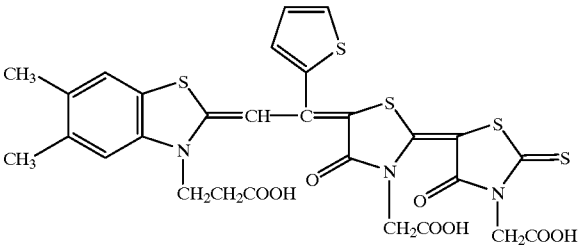

These sensitizing dyes may be used alone or in admixture of two or more. A combination of sensitizing dyes is often used for the purpose of supersensitization. In addition to the sensitizing dye, the emulsion may contain a dye which itself has no spectral sensitization function or a compound which does not substantially absorb visible light, but is capable of supersensitization. Useful sensitizing dyes, combinations of dyes showing supersensitization, and compounds showing supersensitization are described in Research Disclosure, Vol. 176, 17643 (December 1978), page 23, IV J and JP-B 25500/1974 and 4933/1968, JP-A 19032/1984 and 192242/1984.

The sensitizing dye may be added to a silver halide emulsion by directly dispersing the dye in the emulsion or by dissolving the dye in a solvent and adding the solution to the emulsion. The solvent used herein includes water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, N,N-dimethylformamide and mixtures thereof.

Also useful are a method of dissolving a dye in a volatile organic solvent, dispersing the solution in water or hydrophilic colloid and adding the dispersion to an emulsion as disclosed in U.S. Pat. No. 3,469,987, a method of dissolving a dye in an acid and adding the solution to an emulsion or forming an aqueous solution of a dye with the aid of an acid or base and adding it to an emulsion as disclosed in JP-B 23389/1969, 27555/1969 and 22091/1982, a method of forming an aqueous solution or colloidal dispersion of a dye with the aid of a surfactant and adding it to an emulsion as disclosed in U.S. Pat. Nos. 3,822,135 and 4,006,025, a method of directly dispersing a dye in hydrophilic colloid and adding the dispersion to an emulsion as disclosed in JP-A 102733/1978 and 105141/1983, and a method of dissolving a dye using a compound capable of red shift and adding the solution to an emulsion as disclosed in JP-A 74624/1976. It is also acceptable to apply ultrasonic waves to form a solution.

The time when the sensitizing dye is added to the silver halide emulsion according to the invention is at any step of an emulsion preparing process which has been ascertained effective. The sensitizing dye may be added to the emulsion at any stage or step before the emulsion is coated, for example, at a stage prior to the silver halide grain forming step and/or desalting step, during the desalting step and/or a stage from desalting to the start of chemical ripening as disclosed in U.S. Pat. Nos. 2,735,766, 3,628,960, 4,183,756, and 4,225,666, JP-A 184142/1983 and 196749/1985, and a stage immediately before or during chemical ripening and a stage from chemical ripening to emulsion coating as disclosed in JP-A 113920/1983. Also as disclosed in U.S. Pat. No. 4,225,666 and JP-A 7629/1983, an identical compound may be added alone or in combination with a compound of different structure in divided portions, for example, in divided portions during a grain forming step and during a chemical ripening step or after the completion of chemical ripening, or before or during chemical ripening and after the completion thereof. The type of compound or the combination of compounds to be added in divided portions may be changed.

The amount of the sensitizing dye used may be an appropriate amount complying with sensitivity and fog although the preferred amount is about $10^{-6}$ to 1 mol, more preferably $10^{-4}$ to $10^{-1}$ mol per mol of the silver halide in the photosensitive layer.

Antifoggant

With antifoggants, stabilizers and stabilizer precursors, the silver halide emulsion and/or organic silver salt according to the invention can be further protected against formation of additional fog and stabilized against lowering of sensitivity during shelf storage. Suitable antifoggants, stabilizers and stabilizer precursors which can be used alone or in combination include thiazonium salts as described in U.S. Pat. Nos. 2,131,038 and 2,694,716, azaindenes as described in U.S. Pat. Nos. 2,886,437 and 2,444,605, mercury salts as described in U.S. Pat. No. 2,728,663, urazoles as described in U.S. Pat. No. 3,287,135, sulfocatechols as described in U.S. Pat. No. 3,235,652, oximes, nitrons and nitroindazoles as described in BP 623,448, polyvalent metal salts as described in U.S. Pat. No. 2,839,405, thiuronium salts as described in U.S. Pat. No. 3,220,839, palladium, platinum and gold salts as described in U.S. Pat. Nos. 2,566,263 and 2,597,915, halogen-substituted organic compounds as described in U.S. Pat. Nos. 4,108,665 and 4,442,202, triazines as described in U.S. Pat. Nos. 4,128,557, 4,137,079, 4,138,365 and 4,459,350, and phosphorus compounds as described in U.S. Pat. No. 4,411,985.

It is sometimes advantageous to add a mercury (II) salt to an emulsion layer as an antifoggant though not necessary in the practice of the invention. Mercury (II) salts preferred to this end are mercury acetate and mercury bromide. The mercury (II) salt is preferably added in an amount of 1 nmol to 1 mmol, more preferably 10 nmol to 100 μmol per mol of silver coated.

Still further, the photothermographic imaging material of the invention may contain a benzoic acid type compound for the purposes of increasing sensitivity and restraining fog. Any of benzoic acid type compounds may be used although examples of the preferred structure are described in U.S. Pat. Nos. 4,784,939 and 4,152,160, Japanese Patent Application Nos. 98051/1996, 151241/1996, and 151242/1996. The benzoic acid type compound may be added to any site in the imaging material, preferably to a layer on the same side as the photosensitive layer serving as the image forming layer, and more preferably an organic silver salt-containing layer. The benzoic acid type compound may be added at any step in the preparation of a coating solution. Where it is contained in an organic silver salt-containing layer, it may be added at any step from the preparation of the organic silver salt to the preparation of a coating solution, preferably after the preparation of the organic silver salt and immediately before coating. The benzoic acid type compound may be added in any desired form including powder, solution and fine particle dispersion. Alternatively, it may be added in a solution form after mixing it with other additives such as a sensitizing dye, reducing agent and toner. The benzoic acid type compound may be added in any desired amount, preferably 1 μmol to 2 mol, more preferably 1 mmol to 0.5 mol per mol of silver.

In the imaging material of the invention, mercapto, disulfide and thion compounds may be added for the purposes of retarding or accelerating development to control development, improving spectral sensitization efficiency, and improving storage stability before and after development.

Where mercapto compounds are used herein, any structure is acceptable. Preferred are structures represented by Ar—S—M and Ar—S—S—Ar wherein M is a hydrogen atom or alkali metal atom, and Ar is an aromatic ring or fused aromatic ring having at least one nitrogen, sulfur, oxygen, selenium or tellurium atom. Preferred hetero-aromatic rings are benzimidazole, naphthimidazole, benzothiazole, naphthothiazole, benzoxazole, naphthoxazole, benzoselenazole, benzotellurazole, imidazole, oxazole, pyrrazole, triazole, thiadiazole, tetrazole, triazine, pyrimidine, pyridazine, pyrazine, pyridine, purine, quinoline and quinazolinone rings. These hetero-aromatic rings may have a substituent selected from the group consisting of halogen (e.g., Br and C1), hydroxy, amino, carboxy, alkyl groups (having at least 1 carbon atom, preferably 1 to 4 carbon atoms), and alkoxy groups (having at least 1 carbon atom, preferably 1 to 4 carbon atoms). Illustrative, non-limiting examples of the mercapto-substituted hetero-aromatic compound include 2-mercaptobenzimidazole, 2-mercaptobenzoxazole, 2-mercapto-benzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercapto-pyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydro-chloride, 3-mercapto-5-phenyl-1,2,4-triazole, and 2-mercapto-4-phenyloxazole.

These mercapto compounds are preferably added to the emulsion layer (serving as the image forming layer) in amounts of 0.001 to 1.0 mol, more preferably 0.01 to 0.3 mol per mol of silver.

In the image forming layer, polyhydric alcohols (e.g., glycerin and diols as described in U.S. Pat. No. 2,960,404), fatty acids and esters thereof as described in U.S. Pat. Nos. 2,588,765 and 3,121,060, and silicone resins as described in BP 955,061 may be added as a plasticizer and lubricant.

Contrast enhancer

In the imaging material of the invention, contrast enhancers may be used for forming ultrahigh contrast images. Included are hydrazine derivatives as described in U.S. Pat. Nos. 5,464,738, 5,496,695, 5,512,411, 5,536,622, Japanese Patent Application Nos. 228627/1995, 215822/1996, 130842/1996, 148113/1996, 156378/1996, 148111/1996, and 148116/1996; compounds having a quaternary nitrogen atom as described in Japanese Patent Application No. 83566/1996, and acrylonitrile compounds as described in U.S. Pat. No. 5,545,515. Illustrative examples are compounds 1 to 10 in U.S. Pat. No. 5,464,738, compounds H-1 to H-28 in U.S. Pat. No. 5,496,695, compounds I-1 to I-86 in Japanese Patent Application No. 215822/1996, compounds H-1 to H-62 in 130842/1996, compounds I-1 to I-21 in 148113/1996, compounds 1 to 50 in 148111/1996, compounds 1 to 40 in 148116/1996, and compounds P-1 to P-26 and T-1 to T-18 in 83566/1996, and compounds CN-1 to CN-13 in U.S. Pat. No. 5,545,515.

A contrast enhancement accelerator may be used along with the contrast enhancer for the purpose of forming ultrahigh contrast images. Exemplary are the amine compounds described in U.S. Pat. No. 5,545,505, specifically AM-1 to AM-5; hydroxamic acid type compounds described in U.S. Pat. No. 5,545,507, specifically HA-1 to HA-11, acrylonitriles described in U.S. Pat. No. 5,545,507, specifically CN-1 to CN-13, hydrazine compounds described in U.S. Pat. No. 5,558,983, specifically CA-1 to CA-6, onium salts described in Japanese Patent Application No. 132836/1996, specifically A-1 to A-42, B-1 to B-27, and C-1 to C-14.

With respect to the synthesis method, addition method and addition amount of these contrast enhancers and contrast enhancement accelerators, reference should be made to the above-referred patents.

The thermographic photographic emulsion used in the photothermographic imaging material according to the one preferred embodiment of the invention is contained in one or more layers on a support. In the event of single layer construction, it should contain an organic silver salt, silver halide, developing agent, and binder, and other optional additives such as a toner, coating aid and other auxiliary agents. In the event of two-layer construction, a first emulsion layer which is generally a layer disposed adjacent to the support should contain an organic silver salt and silver halide and a second emulsion layer or both the layers contain other components. Also envisioned herein is a two-layer construction consisting of a single emulsion layer containing all the components and a protective topcoat. In the case of multi-color sensitive photothermographic material, a combination of such two layers may be employed for each color. Also a single layer may contain all necessary components as described in U.S. Pat. No. 4,708,928. In the case of multi-dye, multi-color sensitive photothermographic material, emulsion (or photosensitive) layers are distinctly supported by providing a functional or non-functional barrier layer therebetween as described in U.S. Pat. No. 4,460,681.

In one preferred embodiment, the imaging material of the invention is a one-side imaging material having at least one image forming layer such as a photosensitive layer containing a silver halide emulsion on one side and a back (or backing) layer on the other side of the support.

In the practice of the invention, a matte agent may be added to the imaging material for improving feed efficiency. The matte agents used herein are generally microparticulate water-insoluble organic or inorganic compounds. There may be used any desired one of matte agents, for example, well-known matte agents including organic matte agents as described in U.S. Pat. Nos. 1,939,213, 2,701,245, 2,322,037, 3,262,782, 3,539,344, and 3,767,448 and inorganic matte agents as described in U.S. Pat. Nos. 1,260,772, 2,192,241, 3,257,206, 3,370,951, 3,523,022, and 3,769,020. Illustrative examples of the organic compound which can be used as the matte agent are given below; exemplary water-dispersible vinyl polymers include polymethyl acrylate, polymethyl methacrylate, polyacrylonitrile, acrylonitrile-a-methylstyrene copolymers, polystyrene,, styrene-divinylbenzene copolymers, polyvinyl acetate, polyethylene carbonate, and polytetrafluoroethylene; exemplary cellulose derivatives include methyl cellulose, cellulose acetate, and cellulose acetate propionate; exemplary starch derivatives include carboxystarch, carboxynitrophenyl starch, urea-formaldehydestarch reaction products, gelatin hardened with well-known curing agents, and hardened gelatin which has been coaceruvation hardened into microcapsulated hollow particles. Preferred examples of the inorganic compound which can be used as the matte agent include silicon dioxide, titanium dioxide, magnesium dioxide, aluminum oxide, barium sulfate, calcium carbonate, silver chloride and silver bromide desensitized by a well-known method, glass, and diatomaceous earth. The aforementioned matte agents may be used as a mixture of substances of different types if necessary. The size and shape of the matte agent are not critical. The matte agent of any particle size may be used although matte agents having a particle size of 0.1 $\mu$m to 30 $\mu$m are preferably used in the practice of the invention. The particle size distribution of the matte agent may be either narrow or wide. Nevertheless, since the haze and surface luster of photosensitive material are largely affected by the matte agent, it is preferred to adjust the particle size, shape and particle size distribution of a matte agent as desired during preparation of the matte agent or by mixing plural matte agents.

In the practice of the invention, the back layer should preferably have a degree of matte as expressed by a Bekk smoothness of 10 to 250 seconds, more preferably 50 to 180 seconds.

In the imaging material of the invention, the matte agent is preferably contained in an outermost surface layer, a layer functioning as an outermost surface layer, a layer close to the outer surface or a layer functioning as a so-called protective layer.

In the practice of the invention, the binder used in the back layer is preferably transparent or translucent and generally colorless. Exemplary binders are naturally occurring polymers, synthetic resins, polymers and copolymers, and other film-forming media, for example, gelatin, gum arabic, poly(vinyl alcohol), hydroxyethyl cellulose, cellulose acetate, cellulose acetate butyrate, poly(vinyl pyrrolidone), casein, starch, poly(acrylic acid), poly(methyl methacrylate), polyvinyl chloride, poly(methacrylic acid), copoly(styrene-maleic anhydride), copoly(styrene-acrylonitrile), copoly(styrene-butadiene), polyvinyl acetals (e.g., polyvinyl formal and polyvinyl butyral), polyesters, polyurethanes, phenoxy resins, poly(vinylidene chloride), polyepoxides, polycarbonates, poly(vinyl acetate), cellulose esters, and polyamides. The binder may be dispersed in water, organic solvent or emulsion to form a dispersion which is coated to form a layer.

The back layer of the photothermographic imaging material preferably exhibits a maximum absorbance of at least 0.2, more preferably 0.3 to 2.0, and most preferably 0.5 to 2.0 in the exposure wavelength range and a decline of its absorbance to 0.1 or lower under heat developing/image forming conditions.

The dyes which are discolorized upon processing include those described in JP-A 139136/1977, 132334/1978, 501480/1981, 16060/1982, 68831/1982, 101835/1982, 182436/1984, 36145/1995, 199409/1995, JP-B 33692/1973, 16648/1975, 41734/1990, U.S. Pat. Nos. 4,088,497, 4,283, 487, 4,548,896 and 5,187,049. For a thermally discolorizable layer, combinations of a discolorizable dye and a bleaching agent as described in Japanese Patent Application No. 304012/1996 are preferably used.

A backside resistive heating layer as described in U.S. Pat. Nos. 4,460,681 and 4,374,921 may be used in a photothermographic imaging system according to the present invention.

According to the invention, a hardener may be used in various layers including a image forming layer, protective layer, and back layer. Examples of the hardener include polyisocyanates as described in U.S. Pat. No. 4,281,060 and JP-A 208193/1994, epoxy compounds as described in U.S. Pat. No. 4,791,042, and vinyl sulfones as described in JP-A 89048/1987.

The invention favors to provide a water-resistant protective layer which is formed using a hydrophilic polymer or an aqueous emulsion. The water-resistant protective layer can also serve as the above-described surface protective layer which is provided for the purpose of preventing sticking of the image forming layer. It is also acceptable to form two or more protective layers, at least one of which is a water-resistant protective layer.

The water-resistant protective layer used herein is a protective layer which has a dissolution factor of less than 50% when immersed in warm water at 35° C. for 2 hours and/or a contact angle of at least 60° when a water droplet is dropped thereon. A protective layer having a dissolution factor of more than 50% or a contact angle of less than 60° may fail to prevent penetration of water into the image forming layer or photosensitive layer or occurrence of briefing, tending to invite a drop of sensitivity and an increase of fog density. Note that the lower limit of dissolution factor is 0% and the upper limit of contact angle is 180°.

The term "dissolution factor" represents a reduction in thickness of the protective layer during warm water immersion, more specifically, a reduction in thickness of the protective layer by warm water immersion divided by the original thickness of the protective layer prior to warm water immersion, expressed in percent.

The hydrophilic polymers used herein are those exhibiting a solubility of at least 1 gram, preferably at least 5 grams in 100 grams of water (the upper limit of solubility is infinite) and having a water-resistant substituent on a side chain or a reactive group other than a hydroxyl group. Illustrative, non-limiting examples of the trunk polymer constituting the backbone include polyvinyl alcohol, polyethylene oxide, casein, starches, celluloses, gelatins, gum arabic, polyvinyl pyrrolidone, alkali salts of acrylate or methacrylate copolymers, alkali salts of styrene/maleic anhydride copolymers, and acrylamide copolymers. The water-resistant substituents are alkyl groups and aryl groups such as phenyl, and the reactive groups other than a hydroxyl group are carboxyl and epoxy groups, for example.

The hydrophilic polymer exhibits solubility in water when a coating solution thereof is prepared, but undergoes crosslinking upon drying after coating formation, eventually exhibiting water resistance. Exemplary hydrophilic polymers are inert gelatin, polyethylene, polyvinyl alcohol, and methyl cellulose.

The aqueous emulsion used herein is a dispersion in water of particles of a water-insoluble resin covered with a stable hydrophilic layer.

In the practice of the invention, the water-resistant protective layer is formed in various ways. It may be formed by adding 1,2-bis(vinylsulfonylacetamide)ethane to an aqueous solution of inert gelatin, and applying the solution, followed by drying as in Examples to be described later. Other useful methods are described below.

1) To a polyolefin, chlorinated polyolefin, or modified polyolefin such as an unsaturated carboxylic acid and/or acid anhydride-modified polyolefin, are added a reactive surfactant, basic substance, reactive monomer and non-reactive surfactant. The mixture is dispersed in water. With a reaction initiator added, polymerization is effected, yielding an emulsion in which a stable hydrophilic layer is formed around the dispersed resin. The emulsion is then applied and dried, obtaining a water-resistant protective layer.
2) A vinyl ester and an unsaturated compound having an epoxy group in a side chain are copolymerized in the presence of a radical polymerization initiator. The resulting copolymer is then saponified in an alcohol in the presence of an alkali catalyst, obtaining a resin. In water, this resin is mixed with a compound capable of reacting with an epoxy group. The mixture is then applied and dried, obtaining a water-resistant protective layer.
3) A vinyl ester and an unsaturated compound having an fluorinated group in a side chain are copolymerized in the presence of a radical polymerization initiator. The resulting copolymer is then saponified in an alcohol in the presence of an alkali catalyst, obtaining a resin. A solution of this resin in water is then applied and dried, obtaining a water-resistant protective layer.
4) An aqueous solution of a water-soluble polysaccharide polymer is prepared and applied to form a coating. The half-solidified coating is contacted with a solution of a water-soluble metal salt for effecting ion exchange, thereby forming a water-resistant protective layer.

Several methods for forming the water-resistant protective layer are described above although the invention is not limited thereto.

In the water-resistant protective layer, the content of the hydrophilic polymer is preferably 20 to 100% by weight of the entire protective layer. When the water-resistant protective layer is formed using the aqueous emulsion, the preferred content of the resin resulting from the aqueous emulsion also falls in the same range.

Various compounds can be contained in the water-resistant protective layer. Included are aldehydes capable of reacting with hydroxyl groups, esters, isocyanates and inorganic compounds, alcohols capable of reacting with epoxy groups, phenols, mercaptans, carbazoles, pyrazoles, compounds having cyano, isocyanate, ketone and other groups, cyanuric acid, phosgene, alkylamines, alkylamine hydrochloride, sulfonic acid salts, organic acids, pigments (e.g., kaolin, clay, talc, calcium carbonate, fired clay, titanium oxide, diatomaceous earth, silica, aluminum silicate, magnesium silicate, and aluminum oxide), and UV absorbers. Alternatively or additionally, the water-resistant protective layer may contain any of the compounds which can be contained in the aforementioned protective layer.

The water-resistant protective layer preferably has a thickness of 0.1 to 20 $\mu$m, more preferably 0.3 to 10 $\mu$m.

A surfactant may be used for the purposes of improving coating and electric charging properties. The surfactants used herein may be nonionic, anionic, cationic and fluorinated ones. Examples include fluorinated polymer surfactants as described in JP-A 170950/1987 and U.S. Pat. No. 5,380,644, fluorinated surfactants as described in JP-A 244945/1985 and 188135/1988, polysiloxane surfactants as described in U.S. Pat. No. 3,885,965, and polyalkylene oxide and anionic surfactants as described in JP-A 301140/1994.

Examples of the solvent used herein are described in "New Solvent Pocket Book," Ohm K.K., 1994, though not limited thereto. The solvent used herein should preferably have a boiling point of 40 to 180° C. Exemplary solvents include hexane, cyclohexane, toluene, methanol, ethanol, isopropanol, acetone, methyl ethyl ketone, ethyl acetate, 1,1,1-trichloroethane, tetrahydrofuran, triethylamine, thiophene, trifluoroethanol, perfluoropentane, xylene, n-butanol, phenol, methyl isobutyl ketone, cyclohexanone, butyl acetate, diethyl carbonate, chlorobenzene, dibutyl ether, anisole, ethylene glycol diethyl ether, N,N-dimethylformamide, morpholine, propanesultone, perfluorotributylamine, and water.

Support

According to the invention, the thermographic photographic emulsion may be coated on a variety of supports. Typical supports include polyester film, subbed polyester film, poly(ethylene terephthalate) film, polyethylene naphthalate film, cellulose nitrate film, cellulose ester film, poly (vinyl acetal) film, polycarbonate film and related or resinous materials, as well as glass, paper, metals, etc. Often used are flexible substrates, typically paper supports, specifically baryta paper and paper supports coated with partially acetylated α-olefin polymers, especially polymers of α-olefins having 2 to 10 carbon atoms such as polyethylene, polypropylene, and ethylene-butene copolymers. The supports are either transparent or opaque, preferably transparent.

The imaging material of the invention may have an antistatic or electroconductive layer, for example, a layer containing soluble salts (e.g., chlorides and nitrates), an evaporated metal layer, or a layer containing ionic polymers as described in U.S. Pat. Nos. 2,861,056 and 3,206,312 or insoluble inorganic salts as described in U.S. Pat. No. 3,428,451.

The imaging material of the invention is preferably in the form of a photothermographic imaging material or thermographic imaging material comprising an image forming layer containing an organic silver salt on one surface of a support. It preferably has a pH of 4.5 to 1.0 at the film surface on the image forming layer-bearing side as measured by the method to be described later.

Restricting the film surface pH to the above range achieves advantages regarding the tone of images, photographic properties before and after storage, and storage stability of images. In contrast, above film surface pH 4.5, the image tone may become worse and especially, photographic properties after storage and image storage stability may become deteriorated. Below film surface pH 1.0, use of undesirable chemicals may be needed, no improvements in the desired properties be achieved, and a corrosion problem arise.

The film surface pH is measured by adding dropwise 300 μl of distilled water or deionized water to a test material of 2 $cm^3$, leaving the water in contact with the material at 25° C. for 2 minutes, and then measuring the pH of the liquid using a commercially available pH meter. The more preferred range of film surface pH is from 4.3 to 3.0.

The film surface pH can be adjusted by adding an acid or alkali during preparation of the imaging material. The acid used herein may be either organic or inorganic, with examples including sulfuric acid, hydrochloric acid, nitric acid, phosphoric acid, sulfurous acid, carbonic acid, boric acid, perchloric acid, citric acid, acetic acid, propionic acid, para-toluenesulfonic acid, phthalic acid, tetrachlorophthalic acid, benzoic acid, polymethacrylate, polyacrylate, and polystyrene sulfonic acid. The alkali used herein may also be either organic or inorganic, with examples including sodium hydroxide, potassium hydroxide, lithium hydroxide, calcium hydroxide, magnesium hydroxide, aluminum hydroxide, ammonia, tetrabutylammonium hydroxide, triethylamine, N,N-diethylaniline, and 1,8-diazabicyclo-[5.4.0]undecene. Also useful are salts of a weak acid with a strong base and salts of a strong acid with a weak base, for example, sodium acetate, sodium hydrogen carbonate, potassium dihydrogen phosphate, and ammonium sulfate.

The acid or alkali may be added by any desired method. Preferably it is added to a coating solution for the image forming layer or the surface protective layer immediately before application in the manufacture of the imaging material. It may be added in the form of an aqueous solution, organic solvent solution or dispersion. The amount of acid or alkali added is not critical insofar as the desired film surface pH is achievable. Preferably the amount of acid or alkali added is 1 $mg/m^2$ to 10 $g/m^2$.

A method for producing color images using the photothermographic imaging material of the invention is as described in JP-A 13295/1995, page 10, left column, line 43 to page 11, left column, line 40. Stabilizers for color dye images are exemplified in BP 1,326,889, U.S. Pat. Nos. 3,432,300, 3,698,909, 3,574,627, 3,573,050, 3,764,337, and 4,042,394.

In a further preferred embodiment, the imaging material of the invention has a surface resistivity of $10^7$ to $10^{12}$ Ω at 25° C. and RH 10% on at least one surface thereof. Restricting the surface resistivity within this range can solve the problem of dust deposition on the surface of the imaging material in a low humidity atmosphere that will often occur in the manufacture of the imaging material utilizing aqueous application and hence, avoid the occurrence of image defects by dust deposition. The preferred surface resistivity is $10^7$ to $10^{12}$ Ω at 25° C. over a humidity range of RH 10% to 60%. It suffices that such a surface resistivity is accomplished on at least one of the surface of the imaging material on the image forming layer side (photosensitive layer side) and the surface thereof on the back layer side (in the case of double side imaging material, on at least one of the image forming layer sides). In contrast, a surface resistivity above $10^{12}$ Ω may allow for dust deposition on the surface of the imaging material in a low humidity atmosphere (of lower than RH 40%, especially lower than RH 20%). Also, although measurements vary little depending on humidity conditions as long as the surface resistivity is lower than $10^{12}$ Ω, measurements largely vary, even by a factor of about 10 to 100, depending on humidity conditions when the surface resistivity is higher than $10^{12}$ Ω. Also a surface resistivity higher than $10^{12}$ Ω tends to increase in a low humidity atmosphere. For these reasons, the tendency of inviting dust deposition becomes more. It is not practical for the construction of the imaging material to set a surface resistivity below $10^7$ Ω.

While the imaging material of the invention preferably has a surface resistivity of $10^7$ to $10^{12}$ Ω on at least one surface thereof, the more preferred surface resistivity is from $10^8$ to $10^{11}$ Ω. The term "surface resistivity" is an electrical resistivity when electric current flows on a material surface as described in Japanese Polymer Society Ed., "Electrostatic Handbook," Chijin Shokan K.K, page 95.

The means for controlling the imaging material of the invention so as to have a surface resistivity of $10^7$ to $10^{12}$ Ω is not critical. Exemplary methods include addition of inorganic salts, hydrophilic polymers or surfactants to the imaging material and the use of supports having metal thin film evaporated thereon. It is especially preferred to provide a metal oxide-containing layer (to be referred to as "conductive layer," hereinafter) as described in JP-A 20033/1986 and 82504/1981.

When the conductive layer is formed in the imaging material of the invention, any of the subbing layer, intermediate layer, back layer and back side outermost layer can be the conductive layer. In this embodiment, the above-described surface resistivity is available on the conductive layer side surface of the imaging material. The conductive layer preferably has a thickness of 0.01 to 1 μm, more preferably 0.03 to 0.8 μm.

In the practice of the invention, the thermographic photographic emulsion can be coated by various coating procedures including dip coating, air knife coating, flow coating, and extrusion coating using hoppers of the type described in U.S. Pat. No. 2,681,294. If desired, two or more layers may be concurrently coated by the methods described in U.S. Pat. No. 2,761,791 and BP 837,095.

In the imaging material of the invention, there may be contained additional layers, for example, a dye accepting layer for accepting a mobile dye image, an opacifying layer when reflection printing is desired, a protective topcoat layer, and a primer layer well known in the photothermographic art. The imaging material of the invention is preferably such that only a single sheet of the material can form an image. That is, it is preferred that a functional layer necessary to form an image such as an image receiving layer does not constitute a separate member.

The imaging material of the invention may be developed by any desired method although it is generally developed by heating after imagewise exposure. The preferred developing temperature is about 80 to 250° C., more preferably 100 to 140° C. and the preferred developing time is about 1 to 180 seconds, more preferably about 10 to 90 seconds.

Any desired technique may be used for the exposure of the photothermographic imaging material of the invention. The preferred light source for exposure is a laser, for example, a gas laser, YAG laser, dye laser, and semiconductor laser. A semiconductor laser combined with a second harmonic generating device is also useful.

Upon exposure, the photothermographic imaging material of the invention tends to generate interference fringes due to low haze. Known techniques for preventing generation of interference fringes are a technique of obliquely directing laser light to an imaging material as disclosed in JP-A 30 113548/1993 and the utilization of a multi-mode laser as disclosed in WO 95/31754. These techniques are preferably used herein.

Upon exposure of the photothermographic imaging material of the invention, exposure is preferably made by overlapping laser light so that no scanning lines are visible, as disclosed in SPIE, Vol. 169, Laser Printing 116–128 (1979), JP-A 51043/1992, and WO 95/31754.

EXAMPLE

Examples of the present invention are given below by way of illustration and not by way of limitation.

Example 1

Silver halide grains

In 700 ml of water were dissolved 22 grams of phthalated gelatin and 30 mg of potassium bromide. The solution was adjusted to pH 5.0 at a temperature of 35° C. To the solution, 159 ml of an aqueous solution containing 18.6 grams of silver nitrate and 0.9 gram of ammonium nitrate and an aqueous solution containing potassium bromide and potassium iodide in a molar ratio of 92:8 were added over 10 minutes by the controlled double jet method while maintaining the solution at pAg 7.7. Then, 476 ml of an aqueous solution containing 55.4 grams of silver nitrate and 2 grams of ammonium nitrate and an aqueous solution containing 10 μmol/liter of dipotassium hexachloroiridate and 1 mol/liter of potassium bromide were added over 30 minutes by the controlled double jet method while maintaining the solution at pAg 7.7. After 1 gram of 4-hydroxy-6-methyl-1,3,3a,7-tetraazaindene was added, the pH of the solution was lowered to cause flocculation and sedimentation for desalting. The solution was adjusted to pH 5.9 and pAg 8.2 by adding 0.1 gram of phenoxyethanol. There were obtained cubic grains of silver iodobromide having an iodide content of 8 mol % in the core and 2 mol % on the average, a mean grain size of 0.05 μm, a coefficient of variation of the projected area of 8%, and a (100) face proportion of 88%.

The thus obtained silver halide grains were heated at 60° C., to which 85 μmol of sodium thiosulfate, 11 μmol of 2,3,4,5,6-pentafluorophenyldiphenylphosphine selenide, 15 μmol of Tellurium compound, 1 μmol of chloroauric acid, and 270 μmol of thiocyanic acid were added per mol of silver. The emulsion was ripened for 120 minutes and then quenched to 40° C. Then, 100 μmol of Dye and 500 μmol of 2-mercapto-5-methylbenzimidazole were added to the emulsion, which was quenched to 30° C., completing the preparation of a silver halide emulsion.

Organic acid silver emulsion

While a mixture of 4 grams of stearic acid, 6 gram of arachidic acid, 36 grams of behenic acid, and 850 ml of distilled water was vigorously stirred at 90° C., 187 ml of 1N NaOH aqueous solution was added. Reaction was carried out for 120 minutes. After 65 ml of 1N nitric acid was added, the solution was cooled to 50° C. With more vigorous stirring, 125 ml of an aqueous solution containing 21 grams of silver nitrate was added over 100 seconds and stirring was continued for 20 minutes. Thereafter, the solids were separated by suction filtration and washed with water until the water filtrate reached a conductivity of 30 μS/cm. To the thus obtained solids, 100 grams of a 10 wt % aqueous solution of hydroxypropyl methylcellulose was added. Water was further added to a total weight of 270 grams. This was roughly dispersed in an automated mortar, obtaining a crude organic acid silver dispersion. This crude organic acid silver dispersion was dispersed in a nanomizer (manufactured by Nanomizer K.K.) under an impact pressure of 1,000 kg/cm$^3$, obtaining an organic acid silver dispersion. The thus obtained organic acid silver dispersion contained needle grains of organic acid silver having a mean minor diameter of 0.04 μm, a mean major diameter of 0.8 μm and a coefficient of variation of 30%.

Reducing agent dispersion

A slurry was obtained by adding 850 grams of water to 100 grams of 1,1-bis(2-hydroxy-3,5-dimethylphenyl)-3,5,5-trimethylhexane and 50 grams of hydroxypropyl cellulose and thoroughly mixing them. This slurry was introduced into a vessel together with 840 grams of zirconia beads having an average diameter of 0.5 mm. A dispersing machine (¼G Sand Grinder Mill by Imex K.K.) was operated for 5 hours for dispersion, obtaining a reducing agent dispersion.

Organic polyhalogenated compound dispersion

A slurry was obtained by adding 940 grams of water to 50 grams of tribromomethylphenylsulfone and 10 grams of hydroxypropyl methylcellulose and thoroughly mixing them. This slurry was introduced into a vessel together with 840 grams of zirconia beads having an average diameter of 0.5 mm. A dispersing machine (¼G Sand Grinder Mill by Imex K.K.) was operated for 5 hours for dispersion, obtaining an organic polyhalogenated compound dispersion.

Emulsion layer coating solution

An emulsion layer coating solution was prepared by thoroughly mixing 100 grams of the organic acid silver dispersion, 20 grams of the reducing agent dispersion, 15 grams of the organic polyhalogenated compound dispersion, 20 grams of LACSTAR 3307B SBR latex, 20 grams of the silver halide emulsion, and 100 grams of water. It is noted that LACSTAR 3307B is a styrene-butadiene rubber (SBR) latex commercially available from Dai-Nippon Ink & Chemicals K.K. wherein the polymer has an equilibrium moisture content of 0.6 wt % at 25° C. and RH 60% and the dispersed particles have a mean particle diameter of about 0.1 to 0.15 μm.

Emulsion surface protective layer coating solution

A coating solution for the surface protective layer was prepared by adding 270 mg of a potassium salt of N-perfluorooctylsulfonyl-N-propylalanine, 100 mg of sodium dodecylbenzenesulfonate, 9 grams of microparticulate poly(methyl methacrylate) having a mean particle size of 2.5 μm, 350 mg of phthalazine, 600 mg of 4-methylphthalic acid, an amount of sulfuric acid to provide film surface pH 4.0, and a salt of a polyvalent metal ion in the amount shown in Table 1 to 100 grams of inert gelatin, and further adding water to a total volume of 160 ml.

Back layer coating solution

A base solution was prepared by dispersing 10 grams of a salt of N,N,N",N"-tetraethylguanidine and 4-carboxysulfonyl-phenylsulfone in a molar ratio of 1:2 as a solid base in 10 grams of polyvinyl alcohol and 88 grams of water in a dispersing machine (1/16G Sand Grinder Mill by Imex K.K.).

An organic solvent phase was prepared by mixing and dissolving 2.1 grams of a basic dye precursor, 7.9 grams of an acidic substance, 0.1 gram of a dyestuff, and 10 grams of ethyl acetate. This organic solvent phase was mixed with an aqueous solution phase consisting of 10 grams of polyvinyl alcohol and 80 grams of water, emulsified and dispersed at room temperature, obtaining a dyestuff solution having a mean particle size of 2.5 μm.

A back surface coating solution was prepared by mixing 39 grams of the base solution, 26 grams of the dyestuff solution, and 36 grams of a 10 wt % aqueous solution of polyvinyl alcohol.

Back surface protective layer coating solution

A back surface protective layer coating solution was prepared by dissolving 20 grams of gelatin, 0.6 gram of polymethyl methacrylate having a mean particle size of 7 μm, 0.4 gram of sodium dodecylbenzenesulfonate, and 1 gram of X-22-2809 silicone compound (by Shin-Etsu Silicone K.K.) in 480 grams of water.

Photothermographic imaging material (photosensitive material)

Onto the back surface of a 175-μm thick polyethylene terephthalate support undercoated with SBR and gelatin, the back layer coating solution in an amount to provide an optical density of 0.7 at 647 nm and the back surface protective layer coating solution in an amount of 50 g/m$^2$ were concurrently applied in an overlapping manner. Then the emulsion layer coating solution in a silver coverage of 2 g/m$^2$ and the emulsion surface protective layer coating solution in a gelatin coverage of 1.5 g/m$^2$ were coated onto the opposite surface of the support. The thus obtained photosensitive material had a surface smoothness corresponding to a Bekk smoothness of 1,000 seconds on the emulsion side and 80 seconds on the back surface as measured by the Oken type smoothness measurement described in J. TAPPI, Paper Pulp Test No. 5.

Some of the compounds used above have the structures shown below.

Tellurium compound

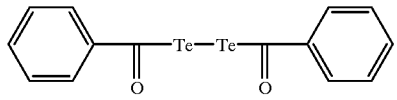

Dyestuff

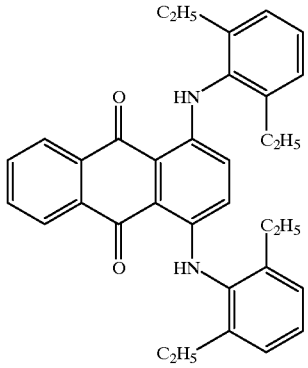

Dye

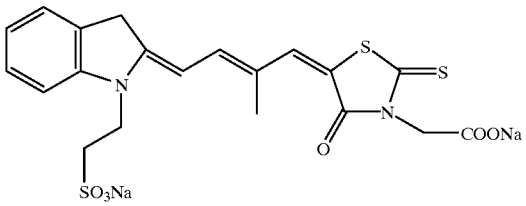

Basic dye precursor

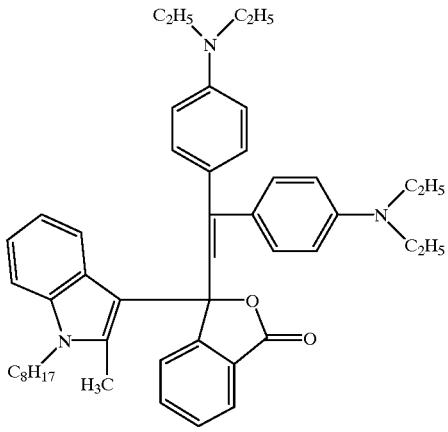

-continued

Acidic substance

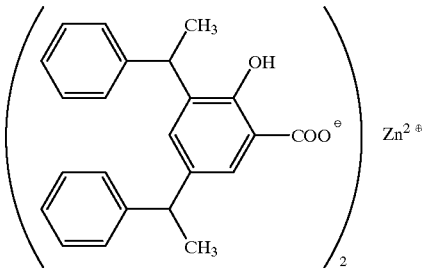

The coated samples were examined by the following tests.

Photographic test

The photosensitive material was exposed to light at an angle of 30° relative to a normal to the material surface by means of a 647-nm Kr laser sensitometer (maximum power 500 mW) and developed by heating at 125° C. for 15 seconds. The resulting image was measured for Dmin (fog) and sensitivity by means of a densitometer. The sensitivity is the reciprocal of a ratio of the exposure providing a density of Dmin+1.0, and is expressed in a relative value based on a sensitivity of 100 for photosensitive material No. 1-1 before forced aging.

Through visual observation, the image tone of a region providing a density of 1 was rated according to the following criteria.

◎: blue black

○: slightly warm tone, but inoffensive

Δ: warm tone, but practically acceptable

X: markedly warm tone, unacceptable

Forced aging stability test

Each photosensitive material was cut into sections of 30.5 cm×25.4 cm with round corners having an inner radius of 0.5 cm. Film sections were kept in an atmosphere of 25° C. and RH 50% for one day. Ten sheets of each sample were placed in a moisture-proof bag, which was sealed and placed in a decorative box of 35.1 cm×26.9 cm×3.0 cm. In this condition, the sheets were aged for 5 days at 50° C. (forced aging test). The aged sheets were processed as in the photographic test and measured for Dmin.

The results are shown in Table 1.

TABLE 1

| Photo-sensitive material | Polyvalent metal salt Type | Amount (mmol/m$^2$) | Sensitivity | Fog | Image tone | Fog after forced aging |
|---|---|---|---|---|---|---|
| 1-1 | none | — | 100 | 0.40 | X | 0.80 |
| 1-2 | Aluminum sulfate | 0.02 | 100 | 0.14 | ○ | 0.16 |
| 1-3 | Aluminum sulfate | 0.2 | 150 | 0.10 | ◎ | 0.11 |
| 1-4 | Aluminum sulfate | 1.0 | 140 | 0.10 | ◎ | 0.12 |
| 1-5 | Aluminum sulfate | 0.2 | 160 | 0.11 | ◎ | 0.12 |
| 1-6 | Chromium potassium sulfate | 0.2 | 120 | 0.12 | ◎ | 0.12 |
| 1-7 | Chromium acetate | 0.2 | 150 | 0.10 | ◎ | 0.11 |
| 1-8 | Chromium acetate | 0.2 | 140 | 0.10 | ◎ | 0.11 |
| 1-9 | Palladium nitrate | 0.2 | 100 | 0.10 | ◎ | 0.11 |

It is evident from Table 1 that photosensitive materials within the scope of the invention are improved in sensitivity, Dmin, tone, and forced aging stability.

The above developed photosensitive materials were kept for 3 days under conditions of 10,000 lx, 40° C. and RH 60% and examined for image stability under light irradiation. Photosensitive material No. 1-1 increased the density of Dmin areas up to 0.70 whereas photosensitive material Nos. 1-2 to 1-9 kept the density of Dmin areas below 0.15, indicating improved image stability under light irradiation.

Example 2

Photosensitive materials were prepared by the same procedure as photosensitive material No. 1-3 of Example 1 except that the gelatin in the emulsion surface protective layer was replaced by polymethacrylate, a polymethacrylate/polybutyl acrylate copolymer, and carboxymethyl cellulose. They were examined as in Example 1, finding satisfactory results equivalent to photosensitive material No. 1-3 except for the sensitivity which was 5%, 8% and 10% lower than that of photosensitive material No. 1-3.

Comparative Example 1

When 4-methylphthalic acid was omitted in photosensitive material No. 1-3 of Example 1, no image was obtained at all.

Example 3

In photosensitive material No. 1-3 of Example 1, 4-methylphthalic acid was replaced by an equimolar amount of phthalic acid. The results were satisfactory and equivalent to photosensitive material No. 1-3 except for the sensitivity which was 5% lower than that of photosensitive material No. 1-3.

Example 4

In photosensitive material No. 1-3 of Example 1, aluminum sulfate was not added to the emulsion surface protective layer, but the same amount of aluminum sulfate was added to the image forming layer. The results were satisfactory and equivalent to photosensitive material No. 1-3 except for the sensitivity which was 7% lower than that of photosensitive material No. 1-3 and the fog after forced aging which was 0.10.

Example 5

Photosensitive material Nos. 2-1 and 2-2 were prepared by the same procedure as photosensitive material Nos. 1-1 and 1-3 of Example 1 except that N-(2-methoxyphenyl)-N'-formylhydrazine was added to the emulsion layer coating solution in such an amount as to give a coverage of 1 mg/m$^2$.

A 1 cm×1 cm square surface area of the photosensitive material sample was exposed to light from a 647-nm Kr laser sensitometer (maximum power 500 mW) at an incident angle of 30°. Provided that X is an exposure giving a density of 2.5 and Y is an exposure giving a density of 0.5, rectangular zones having a short side of 100 $\mu$m and a long side of 1 cm arranged such that they adjoined each other along the long side were alternately exposed to the exposures X and Y. The developing temperature was 115° C. Except for the above, the photosensitive material samples were processed as in the photographic test of Example 1. The samples were then kept for one month under a light-shielded condition at 40° C. whereupon the images were visually examined according to the following criteria.

◎: substantially no change

○: slightly enlarged image areas, but inoffensive

Δ: 5 μm or more enlarged image areas, but practically acceptable

X: 20 μm or more enlarged image areas, unacceptable

Photosensitive material No. 2-1 outside the scope of the invention was rated "X" whereas photosensitive material No. 2-2 within the scope of the invention was rated "◎". It is thus evident that within the scope of the invention, photosensitive materials are improved in image storage stability.

Moreover, photosensitive material No. 2-2 was examined for photographic properties and forced aging stability according to Example 1, finding satisfactory results. Its high γ proved sufficiently high contrast.

Example 6

In Example 1, the silver halide was not added to the emulsion layer coating solution, the reducing agent dispersion was replaced by an aqueous solution containing an equimolar amount of methyl 3,4-dihydroxybenzoate, the salt of polyvalent metal ion was not added to the image forming layer protecting layer, and the base solution and the dyestuff solution were not added to the back surface coating solution. There was obtained a thermographic imaging material. The salt of polyvalent metal ion was added to the layer on the image forming layer side as shown in Table 2. The heat-sensitive material was measured for density after it was heated at 95° C. for 4 seconds and after it was kept under the conditions of the forced aging stability test in Example 1 and then heated at 95° C. for 4 seconds. The results are shown in Table 2.

The image tone of the material which was heated so as to provide a density of 1 was visually evaluated according to the same criteria as in Example 1. The results are showrn in Table 2.

TABLE 2

| Photo-sensitive material | Polyvalent metal salt Type | Amount (mmol/m$^2$) | Density | Image tone | Density after forced aging |
|---|---|---|---|---|---|
| 3-1 | none | — | 2.8 | X | 2.1 |
| 3-2 | Aluminum sulfate | 0.2 | 3.2 | ○ | 3.1 |
| 3-3 | Aluminum acetate | 0.2 | 3.4 | ◎ | 3.4 |
| 3-4 | Chromium potassium sulfate | 0.2 | 3.4 | ◎ | 3.5 |
| 3-5 | Chromium acetate | 0.2 | 3.3 | ◎ | 3.3 |

It is evident from Table 2 that heat-sensitive materials within the scope of the invention produce blue black tone images with a high density and are improved in aging stability.

Example 7

A photosensitive material was prepared as photosensitive material No. 1-6 of Example 1 except that the support was replaced by the following undercoated support.

Undercoating solution A

It was prepared by mixing 208 cc of LACSTAR 3307B SBR latex (Dai-Nippon Ink & Chemicals K.K.), 5 cc of Sundett BL surfactant (Sanyo Chemicals K.K.), and 1.8 grams of microparticulate polymethyl methacrylate having a mean particle size of 2.5 μm and adding distilled water to a total volume of 1,000 cc.

Undercoating solution B

It was prepared by mixing 130 cc of LACSTAR 3307B SBR latex and 2 grams of sodium 2,4-dichloro-6-hydroxy-1,3,5-triazine and adding distilled water to a total volume of 1,000 cc.

Undercoating solution C

It was prepared by adding to 10 grams of gelatin the dispersion of conductive metal oxide fine powder (tin oxide-antimony oxide composite, 40% by weight) in water described in Example 1 of JP-A 20033/1986 in such an amount that the photosensitive material might have a surface resistivity (logarithmic value) of 10 or 12 under a humidity of RH 10%, adding 10 cc of Sundett BL surfactant and 1.8 grams of microparticulate polymethyl methacrylate having a mean particle size of 2.5 μm and adding distilled water to a total volume of 1,000 cc.

Undercoated sample

Undercoating solution A was applied to one surface (photosensitive side) of a biaxially oriented polyethylene terephthalate support of 175 μm thick by means of a bar coater and dried at 180° C. for 5 minutes, forming a front undercoat with a dry thickness of 0.5 μm.

Next, undercoating solution B was applied to the opposite (back) surface of the support by means of a bar coater and dried at 180° C. for 5 minutes, forming a back undercoat with a dry thickness of 0.5 μm. Undercoating solution C was applied thereto by means of a bar coater and dried at 180° C. for 5 minutes, forming an overlying back undercoat with a dry thickness of 0.1 μm.

The photosensitive material having a surface resistivity (logarithmic value) of 10 is designated No. 7-1 and the photosensitive material having a surface resistivity of 12 is designated No. 7-2. As compared with photosensitive material No. 1-6, photosensitive material Nos. 7-1 and 7-2 were prevented from dust deposition thereon in a low humidity atmosphere.

It is noted that the surface resistivity was measured as follows.

Measurement of surface resistivity

The surface resistivity of a photosensitive material sample was measured by conditioning a 5 cm×10 cm section thereof in an atmosphere of 25° C. and RH 10% for 24 hours, placing parallel stainless steel electrodes of 10 cm long spaced a gap of 0.14 cm in pressure contact with the surface of the sample section on the conductive layer-bearing side, and measuring a current flow i (A) under an applied voltage of 100 V after 1 minute by means of an electrometer TR8651 by Takeda Riken K.K. The surface resistivity SR (Ω) was calculated according to the equation.

$$SR=100\times10/(0.14\times i)$$

Example 8

Photosensitive material No. 8-1 was prepared as photosensitive material No. 1-6 of Example 1 except that LACSTAR 3307B binder was replaced by an equivalent amount of the core/shell type polymer latex prepared in Synthesis Example 1. This sample produced an image having no haze in the Dmin area and exhibited improved surface quality.

Example 9

Photosensitive material No. 9-1 was prepared as photosensitive material No. 1-6 of Example 1 except that in the emulsion surface protective layer coating solution, the phthalazine was replaced by 700 mg of phthalazone, and 3 grams of 1,2-bis(vinylsulfonylacetamide)ethane was added. This coated sample showed excellent aging stability (more stable Dmin, Dmax and sensitivity) and excellent tone stability of image areas under light irradiation (sunlight for 1 month) and dark warm storage (40° C. for 1 month).

Example 10

Silver halide grains A

In 800 ml of water were dissolved 22 grams of phthalated gelatin and 30 mg of potassium bromide. The solution was adjusted to pH 5.0 at a temperature of 40° C. To the solution, 159 ml of an aqueous solution containing 18.6 grams of silver nitrate and an aqueous solution of potassium bromide were added over 10 minutes by the controlled double jet method while maintaining the solution at pAg 7.7. Then, 476 ml of an aqueous solution containing 55.4 grams of silver nitrate and an aqueous solution containing 8 μmol/liter of dipotassium hexachloroiridate and 1 mol/liter of potassium bromide were added over 30 minutes by the controlled double jet method while maintaining the solution at pAg 7.7. The pH of the solution was lowered to cause flocculation and sedimentation for desalting. The solution was adjusted to pH 5.9 and pAg 8.0 by adding 0.2 gram of phenoxyethanol. There were obtained cubic grains A having a mean grain size of 0.07 μm, a coefficient of variation of the projected area diameter of 8%, and a (100) face proportion of 86%.

The thus obtained silver halide grains A were heated at 60° C., to which 85 μmol of sodium thiosulfate, 11 μmol of 2,3,4,5,6-pentafluorophenyldiphenylphosphine selenide, 2 μmol of Tellurium Compound 1, 3.3 μmol of chloroauric acid, and 230 μmol of thiocyanic acid were added per mol of silver. After the emulsion was ripened for 120 minutes, the temperature was changed to 50° C. With stirring, $5\times10^{-4}$ mol of Sensitizing Dye A and $2\times10^{-4}$ mol of Sensitizing Dye B were then added per mol of the silver halide. Further, potassium iodide was added in an amount of 3.5 mol % based on the silver, and stirring was continued for 30 minutes. The emulsion was quenched to 30° C., completing the preparation of silver halide grains A.

Sensitizing Dye A

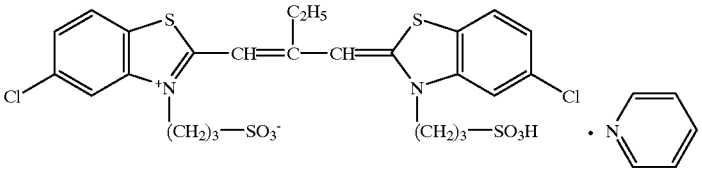

Sensitizing Dye B

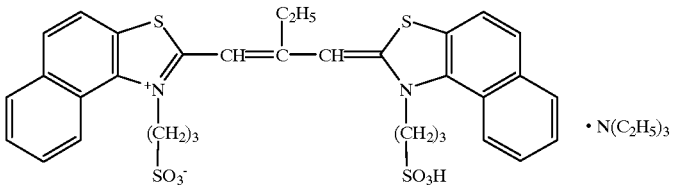

Tellurium Compound 1

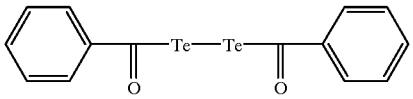

Organic acid silver microcrystalline dispersion

A mixture of 40 grams of behenic acid, 7.5 grams of stearic acid, and 500 ml of water was stirred at 90° C. for 20 minutes. Then, 187 ml of 1N NaOH aqueous solution was added over 40 minutes, 61 ml of 1N nitric acid was added, and the solution was cooled to 50° C. With stirring, 124 ml of an aqueous solution of 1N silver nitrate was added over 2 minutes and stirring was continued for 30 minutes. Thereafter, the solids were separated by suction filtration and washed with water until the water filtrate reached a conductivity of 30 μS/cm. The thus obtained solids were handled as a wet cake without drying. To 34.8 grams as dry solids of the wet cake were added 12 grams of polyvinyl alcohol and 150 ml of water. They were thoroughly mixed to form a slurry. A vessel was charged with the slurry together with 840 grams of zirconia beads having a mean diameter of 0.5 mm. A dispersing machine (¼G Sand Grinder Mill by Imex K.K.) was operated for 5 hours for dispersion, completing the preparation of a microcrystalline dispersion of organic acid silver grains having a volume weighed mean grain diameter of 1.5 μm as measured by Master Sizer X (Malvern Instruments Ltd.).

Solid particle dispersions of chemical addenda

Solid particle dispersions of tetrachlorophthalic acid, 4-methylphthalic acid, 1,1-bis(2-hydroxy-3,5-dimethylphenyl)-3,5,5-trimethylhexane, phthalazine, and tribromomethylphenylsulfone were prepared.

To tetrachlorophthalic acid were added 0.81 gram of hydroxypropyl methylcellulose and 94.2 ml of water. They were thoroughly agitated to form a slurry, which was allowed to stand for 10 hours. A vessel was charged with the slurry together with 100 ml of zirconia beads having a mean diameter of 0.5 mm. A dispersing machine as above was operated for 5 hours for dispersion, obtaining a solid particle dispersion of tetrachlorophthalic acid in which particles with a diameter of up to 1.0 μm accounted for 70% by weight. Solid particle dispersions of the remaining chemical addenda were similarly prepared by properly changing the amount of dispersant and the dispersion time to achieve a desired mean particle size.

Non-photosensitive layer coating solution

Binder: LACSTAR 3307B SBR latex 215 g

Addendum: UV absorber see Table 3

Emulsion layer coating solution

An emulsion layer coating solution was prepared by adding the silver halide grains A (equivalent to 10 mol % of silver halide based on the organic acid silver) and the following binder and components to the organic silver microcrystalline dispersion A (equivalent to 1 mol of silver).

Binder: LACSTAR 3307B SBR latex 430 g

Addenda:

1,1-bis(2-hydroxy-3,5-dimethylphenyl)-3,5,5-trimethylhexane 98 g

Oxidizing agent II-2 47 g

UV absorber see Table 3

Intermediate layer coating solution

Binder: LACSTAR 3307B SBR latex 215 g

Addenda:

Tetrachlorophthalic acid 10 g

Phthalazine 18.4 g 4-methylphthalic acid 14 g

UV absorber see Table 3

Chromium potassium sulfate 12-hydrate 12.7 g

It is noted that LACSTAR 3307B is a styrene-butadiene rubber (SBR) latex commercially available from Dai-Nippon Ink & Chemicals K.K. wherein the polymer has an equilibrium moisture content of 0.6 wt % at 25° C. and RH 60% and the dispersed particles have a mean particle diameter of about 0.1 to 0.15 μm.

Emulsion surface protective layer coating solution

A surface protective layer coating solution was prepared by adding 0.26 gram of Surfactant A, 0.09 gram of Surfactant B, 0.9 gram of silica microparticulates having a mean particle size of 2.5 μm, 0.3 gram of 1,2-bis(vinylsulfonylacetamide)ethane and 64 grams of water to 10 grams of inert gelatin and further adding a UV absorber as shown in Table 3.

Surfactant A

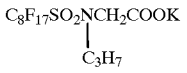

Surfactant B

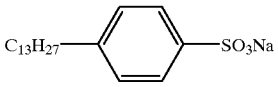

Decolorizable dye dispersion A

To 35 grams of ethyl acetate were added 2.5 grams of Compound 1 and 7.5 grams of Compound 2. The mixture was agitated for dissolution. The solution was combined with 50 grams of a 10 wt % polyvinyl alcohol solution and agitated for 5 minutes by means of a homogenizer. Thereafter, the ethyl acetate was volatilized off for solvent removal purpose. Dilution with water yielded a decolorizable dye dispersion.

Compound 1

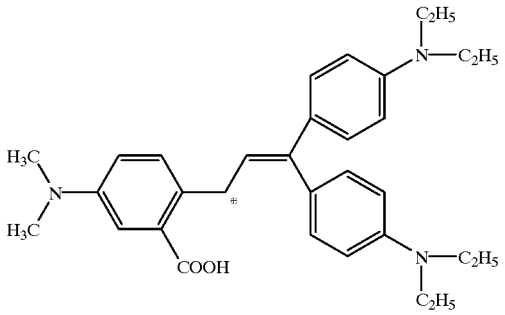

Compound 2

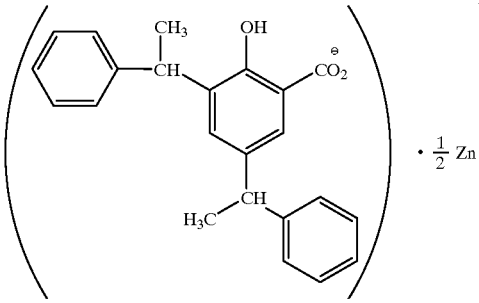

Back surface coating solution

A back surface coating solution was prepared by adding 50 grams of the decolorizable dye dispersion A, 20 grams of Compound 3, 250 grams of water, and 1.8 grams of Sildex H121 spherical silica having a mean size of 12 μm (Dokai Chemical K.K.) to 30 grams of polyvinyl alcohol, and in some samples, further adding a UV absorber as shown in Table 3.

Compound 3

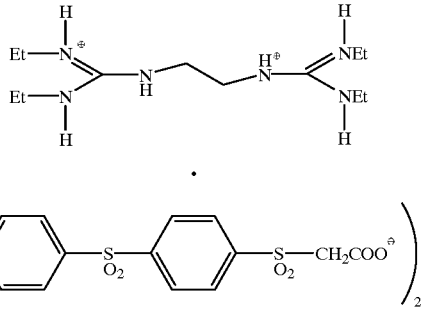

Support

Polyethylene terephthalate supports of 175 μm thick were used. In some samples, a UV absorber was added to the support as shown in Table 3.

Coated sample

With the combination of the UV absorber and the oxidizing agent which were added as shown in Table 3, the non-photosensitive layer, emulsion layer, intermediate layer and emulsion surface protective layer were concurrently applied to the emulsion layer side of the support in the described stacking order and dried. The back surface coating solution was applied to the opposite side of the support to the emulsion layer, obtaining coated samples.

The thus obtained samples were examined for sensitivity, fog, image tone, forced aging fog as in Example 1, finding satisfactory results.

Discoloration during image storage

The sample which had been exposed and developed as in Example 1 was attached to the inside surface of glazing exposed to direct sunlight, and left to stand for one month. The image was visually observed for discoloration and rated according to the following criteria.

○: little tone change

Δ: reference (sample No. 1)

TABLE 3

| Sample | UV absorber addition | | | Discoloration |
|---|---|---|---|---|
| No. | Type | Amount | Site | |
| 1 | — | | | Δ |
| 2 | P-2 | 0.5 g/m$^2$ | support | ○ |
| 3 | 1-8 | 0.5 g/m$^2$ | non-photosensitive layer | ○ |
| 4 | P-2 | 0.5 g/m$^2$ | intermediate layer + back layer | ○ |
| 5 | 1-8 | 0.5 g/m$^2$ | protective layer + back layer | ○ |

It is evident from Table 3 that samples within the scope of the invention are free from image discoloration.

What is claimed is:

1. An imaging material comprising a support, a photothermographic image forming layer comprising organic silver salt, light-sensitive silver halide, reducing agent and binder, on one surface of said support, or a thermographic image forming layer comprising an organic silver salt, reducing agent and binder, on one surface of said support, said image forming layer has an overcoat or protective layer thereon, wherein the overcoat or protective layer comprises a polyvalent metal ion and a phthalic acid compound.

2. The imaging material of claim 1 wherein the polyvalent metal ion is contained in an amount of 10 μmol to 1 mol per square meter of the imaging material.

3. The imaging material of claim 1 wherein the polyvalent metal ion is a metal cation other than alkaline earth metal ions.

4. The imaging material of claim 1 wherein the overcoat or protective layer contains 100 mg/m$^2$ to 5 g/m$^2$ of a polymer bearing a carboxylic acid residue.

5. An imaging material of claim 1 wherein the imaging material contains a reducing agent and binder on the support.

6. An imaging material of claim 1 wherein the imaging material containing reducing agent, a photosensitive silver halide and a binder on the support.

7. An imaging material of claim 1 wherein the image forming layer is a photothermographic image forming layer containing a non-photosensitive organic silver salt, a reducing agent therefor, a photosensitive silver halide and a binder on one surface of the support.

8. The imaging material of claim 1 wherein the imaging material contains a non-photosensitive organic silver salt, a reducing agent therefor, an oxidizing agent, and a binder on the support, and the imaging material further contains a UV absorber at a site other than a layer containing said oxidizing agent.

9. The imaging material of claim 8 wherein the oxidizing agent is of the formula (I):

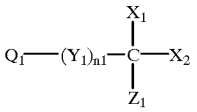

wherein $Q_1$ is an alkyl, aryl or heterocyclic group, each of $X_1$ and $X_2$ is a halogen atom, $Z_1$ is a hydrogen atom or electron attractive group, $Y_1$ is —C(=O)—, —SO— or —$SO_2$—, and letter $n_1$ is equal to 0 or 1.

10. The imaging material of claim 1 wherein the imaging material contains a photosensitive silver halide, a non-photosensitive organic silver salt, a reducing agent therefor, an oxidizing agent, and a binder on the support, and the imaging material further contains a UW absorber at a site other than a layer containing said oxidizing agent.

11. The imaging material of claim 10 wherein the oxidizing agent is of the formula (I):

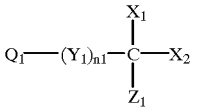

wherein $Q_1$ is an alkyl, aryl or heterocyclic group, each of $X_1$ and $X_2$ is a halogen atom, $Z_1$ is a hydrogen atom or electron attractive group, $Y_1$ is —C(=O)—, —SO— or —$SO_2$—, and letter $n_1$ is equal to 0 or 1.

12. The imaging material of claim 10 wherein the oxidizing agent is solid dispersed.

13. The imaging material of claim 10 wherein the imaging material comprises at least one photosensitive layer containing the photosensitive silver halide, the non-photosensitive organic silver salt, the reducing agent therefor, and the binder, and at least one non-photosensitive layer, the oxidizing agent is contained in said at least one photosensitive layer, and the UV absorber is contained in said at least one non-photosensitive layer.

14. The imaging material of claim 10 wherein the support is a transparent support.

15. The imaging material of claim 10 wherein the UV absorber is contained in layers disposed on opposite sides of a layer containing the non-photosensitive organic silver salt.

16. The imaging material of claim 10 wherein the non-photosensitive organic silver salt is a silver salt of a carboxylic acid.

17. The imaging material of claim 1 wherein the phthalic acid compound is contained in an amount of 0.1 to 50 mol % per mol of silver.

18. The imaging material of claim 1 wherein the image forming layer uses at least 50% by weight based on the entire binder of a polyer latex.

19. The imaging material of claim 1 wherein the polyvalent metal is aluminum (III), chromium (III), palladium (II), zirconium (II), zinc (II), or manganese (II).

* * * * *

UNITED STATES PATENT AND TRADEMARK OFFICE

CERTIFICATE OF CORRECTION

PATENT NO. : 6,093,529 Page 1 of 1
DATED : July 25, 2000
INVENTOR(S) : Hirohiko Tsuzuki, Hisashi Okamura, Itsuo Fujiwara, Yoshiharu Yabuki and Masaki Noro It is certified that error appears in the above-identified patent and that said Letters Patent is hereby corrected as shown below:

Claim 10,
Line 5, change "UW" to -- UV --

Signed and Sealed this

Twenty-eighth Day of August, 2001

*Attest:*

Nicholas P. Godici

NICHOLAS P. GODICI
*Acting Director of the United States Patent and Trademark Office*

*Attesting Officer*